US008235731B1

(12) United States Patent
Poulsen et al.

(10) Patent No.: US 8,235,731 B1
(45) Date of Patent: Aug. 7, 2012

(54) CONNECTOR MODULE AND PATCH PANEL

(75) Inventors: Jeffrey Alan Poulsen, Edmonds, WA (US); Bryan L. Sparrowhawk, Monroe, WA (US); Jason Erickson, Mill Creek, WA (US); Bret Taylor, Seattle, WA (US); Adam Bily, Seattle, WA (US)

(73) Assignee: Leviton Manufacturing Co., Ltd., Melville, NY (US)

( * ) Notice: Subject to any disclaimer, the term of this patent is extended or adjusted under 35 U.S.C. 154(b) by 0 days.

(21) Appl. No.: 13/051,908

(22) Filed: Mar. 18, 2011

(51) Int. Cl.
*H01R 12/00* (2006.01)

(52) U.S. Cl. ..... 439/76.1; 439/676; 439/941

(58) Field of Classification Search ..... 439/76.1, 439/676, 941
See application file for complete search history.

(56) References Cited

U.S. PATENT DOCUMENTS

| | | | | |
|---|---|---|---|---|
| 4,767,338 | A * | 8/1988 | Dennis et al. | 439/455 |
| 6,866,548 | B2 * | 3/2005 | Hashim | 439/676 |
| 7,025,635 | B2 * | 4/2006 | Chang | 439/620.07 |
| 7,029,290 | B2 * | 4/2006 | Wu | 439/76.1 |
| 7,131,862 | B2 * | 11/2006 | Vermeersch | 439/497 |
| 7,448,909 | B2 * | 11/2008 | Regnier et al. | 439/607.05 |
| 7,517,254 | B2 * | 4/2009 | Zhang et al. | 439/668 |
| 7,618,264 | B2 * | 11/2009 | Wu | 439/76.1 |
| 7,651,341 | B2 * | 1/2010 | Wu | 439/76.1 |
| 7,651,342 | B1 * | 1/2010 | Wu | 439/76.1 |
| 7,654,831 | B1 * | 2/2010 | Wu | 439/76.1 |
| 7,658,622 | B2 * | 2/2010 | Bartholomew | 439/76.1 |
| 7,658,651 | B2 * | 2/2010 | Pepe et al. | 439/676 |
| 7,658,652 | B2 * | 2/2010 | Sawatari et al. | 439/676 |
| 7,674,136 | B2 * | 3/2010 | Steinke et al. | 439/676 |
| 7,722,390 | B2 * | 5/2010 | Debenedictis et al. | 439/536 |
| 7,736,176 | B2 * | 6/2010 | Zhang et al. | 439/541.5 |
| 7,794,278 | B2 * | 9/2010 | Cohen et al. | 439/607.09 |
| 7,845,984 | B2 * | 12/2010 | Schaffer et al. | 439/620.18 |
| 7,854,632 | B2 * | 12/2010 | Reeves et al. | 439/620.11 |
| 7,874,879 | B2 * | 1/2011 | Caveney et al. | 439/676 |
| 7,901,238 | B1 * | 3/2011 | Muir et al. | 439/417 |
| 8,011,950 | B2 * | 9/2011 | McGrath et al. | 439/497 |
| 8,062,073 | B1 * | 11/2011 | Szczesny et al. | 439/660 |
| 8,075,348 | B2 * | 12/2011 | Mei et al. | 439/676 |
| 8,096,839 | B2 * | 1/2012 | Abughazaleh et al. | 439/676 |
| 2001/0055916 | A1 * | 12/2001 | Arnett | 439/676 |
| 2003/0119343 | A1 * | 6/2003 | Lin et al. | 439/76.1 |
| 2004/0077222 | A1 * | 4/2004 | AbuGhazaleh et al. | 439/676 |
| 2005/0026509 | A1 * | 2/2005 | Chang | 439/676 |
| 2005/0202722 | A1 * | 9/2005 | Regnier et al. | 439/608 |
| 2006/0030172 | A1 * | 2/2006 | Wu | 439/76.1 |
| 2006/0091545 | A1 * | 5/2006 | Casher et al. | 257/738 |

(Continued)

*Primary Examiner* — Ross Gushi
(74) *Attorney, Agent, or Firm* — Davis Wright Tremaine LLP; George C. Rondeau, Jr.; Heather M. Colburn

(57) ABSTRACT

A substrate operable to construct a male-type connector, a female-type connector, and/or a multi-outlet module. The substrate has a plurality of circuits and an edge card male connector including contacts for each circuit. For each circuit, the substrate has a ground plane connected to one or more of the contacts for the circuit. The ground planes may be implemented as localized, electrically floating, isolated ground planes. The substrate may include multiple layers upon which portions of the circuits and ground planes may be disposed. The ground plane corresponding to each of the plurality of circuits may be located in close proximity to conductive elements of the circuit so as to provide a localized common ground to which energy can be conveyed from the conductive elements to thereby limit an amount of energy radiated outwardly from the conductive elements to surrounding conductors.

45 Claims, 30 Drawing Sheets

U.S. PATENT DOCUMENTS

2006/0094267 A1* 5/2006 Li ..... 439/76.1
2006/0121789 A1* 6/2006 Hashim ..... 439/676
2006/0134946 A1* 6/2006 William Vermeersch ... 439/76.1
2006/0266549 A1* 11/2006 Lin et al. ..... 174/262
2007/0105410 A1* 5/2007 Wu ..... 439/76.1
2007/0178772 A1* 8/2007 Hashim et al. ..... 439/676
2007/0184724 A1* 8/2007 Adriaenssens et al. ..... 439/676
2007/0259573 A1* 11/2007 Machado et al. ..... 439/676
2007/0293094 A1* 12/2007 Aekins ..... 439/676
2008/0214058 A1* 9/2008 Machado et al. ..... 439/676
2008/0305680 A1* 12/2008 Little et al. ..... 439/541.5
2008/0305692 A1* 12/2008 Little et al. ..... 439/676
2009/0104821 A1* 4/2009 Marti et al. ..... 439/676
2009/0191758 A1* 7/2009 Aekins ..... 439/620.01
2009/0197438 A1* 8/2009 Liu et al. ..... 439/76.1
2010/0093227 A1* 4/2010 Kirk ..... 439/676
2011/0281474 A1* 11/2011 Weinmann et al. ..... 439/676
2012/0064779 A1* 3/2012 Wu ..... 439/676

* cited by examiner

CONNECTOR MODULE AND PATCH PANEL

BACKGROUND OF THE INVENTION

1. Field of the Invention

The present invention is directed generally to communications connectors and port modules used with patch panels, and in particular, to multi-cable communications connectors and multi-outlet modules used with patch panels.

2. Description of the Related Art

Presently, to connect multiple communication cables (e.g., Augmented Category 6 cables) together, multiple male and female connectors are used to create separate communication connections for each cable. Further, even though a port module may include multiple forwardly facing outlets, at the back of the port module, each outlet typically has a plurality of insulation displacement connectors that must be connected individually to the wires of a cable. These prior art methods of effecting multiple cable connections are time consuming and may be expensive to implement. Therefore, a need exists for connectors and port modules configured to implement multiple cable connections in a more efficient manner. The present application provides these and other advantages as will be apparent from the following detailed description and accompanying figures.

BRIEF DESCRIPTION OF THE SEVERAL VIEWS OF THE DRAWING(S)

DETAILED DESCRIPTION OF THE INVENTION

Figure 1:
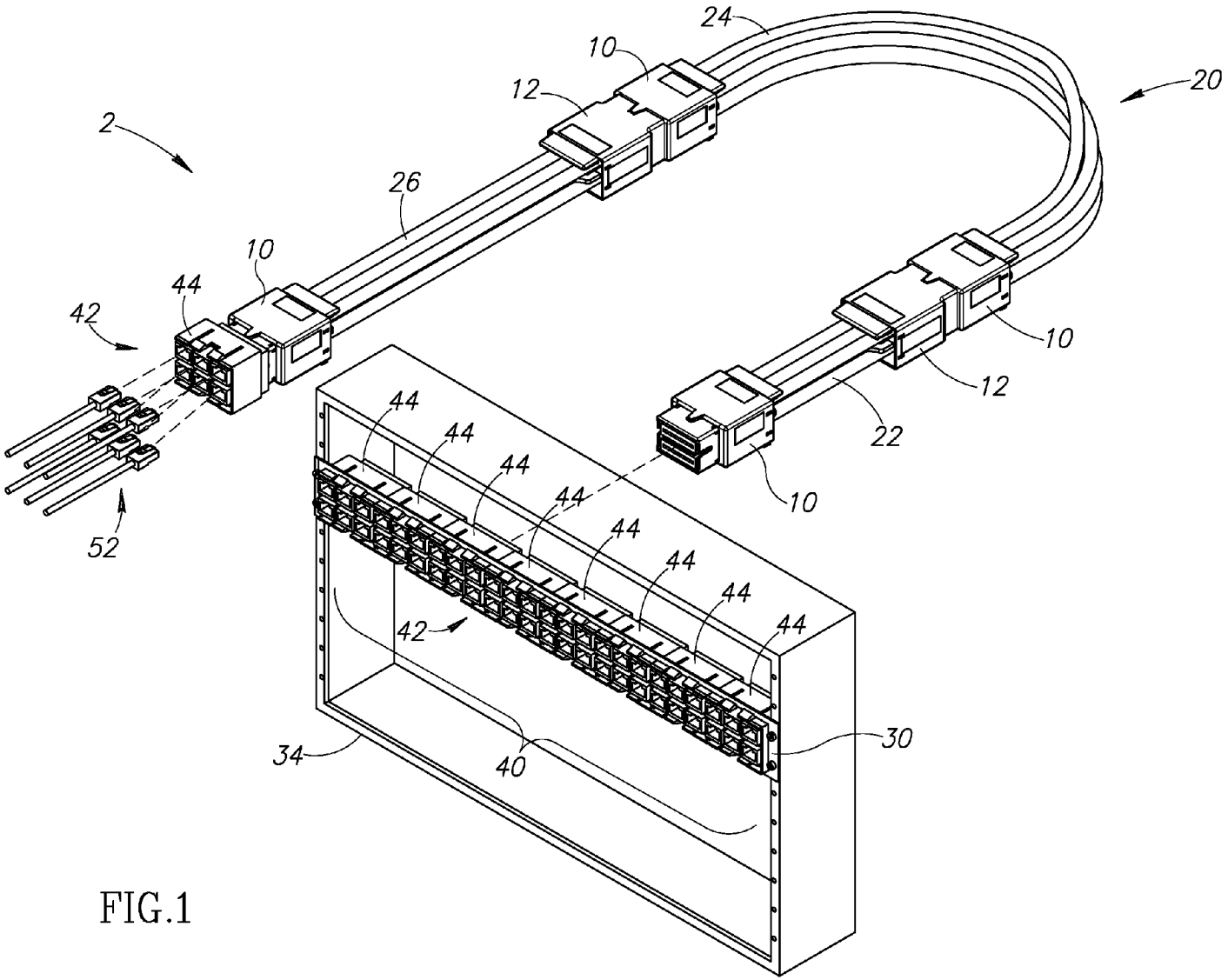
FIG. 1 is a perspective view of a portion of an exemplary communication system including a plurality of multi-outlet modules, a plurality of male-type connectors, and a plurality of female type connectors.

FIG. 1 illustrates a portion of a communication system 2 that includes a plurality of male-type connectors identified individually by reference numeral 10 and a plurality of female-type connectors identified individually by reference numeral 12. The female-type connector 12 is configured to receive and retain a portion of the male-type connector 10 to form both a mechanical and an electrical connection therewith. The male and female-type connectors 10 and 12 may be used to construct trunk cables 20. The trunk cables 20 illustrated in FIG. 1 include a male-female trunk cable 22, a male-male trunk cable 24, and a male-female trunk cable 26. While not illustrated, two female-type connectors 12 may be used to construct a female-female trunk cable (not shown).

The trunk cables 20 may be connected to a patch panel 30 mounted inside a conventional rack 34. One or more multi-outlet modules 40 identified individually by reference numeral 44 may be mounted inside the patch panel 30. In the embodiment illustrated, the patch panel 30 includes eight of the multi-outlet modules 40, which may be configured to fit within one rack unit ("RU"). The multi-outlet module 44 has a plurality of outlets 42 (e.g., RJ-45 type outlets) into which a plurality of plugs 52 (e.g., RJ-45 type plugs) may be inserted.

Figure 2A:
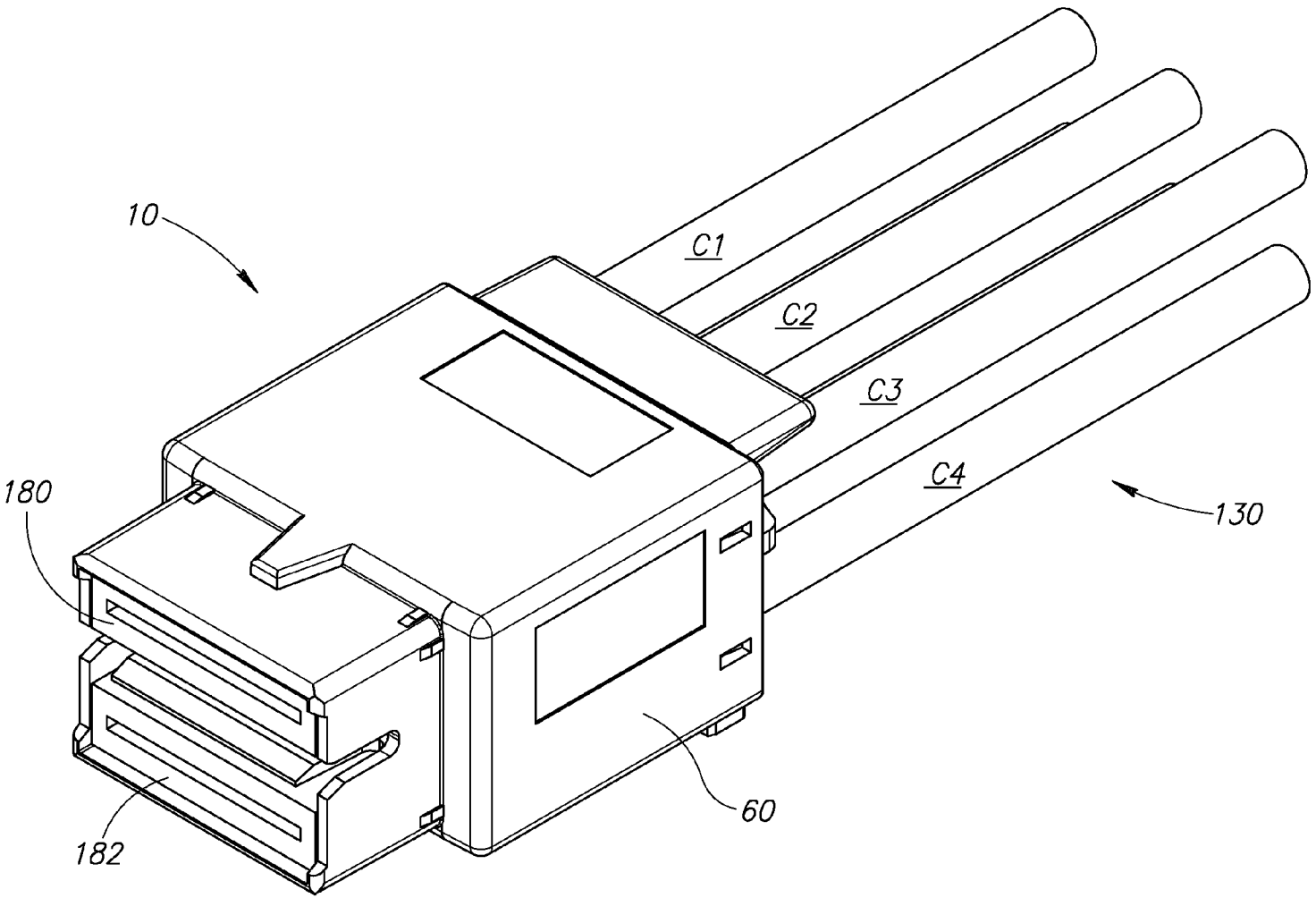
FIG. 2A is an enlarged perspective view of one of the male-type connectors of FIG. 1 terminating six cables.
Figure 2B:
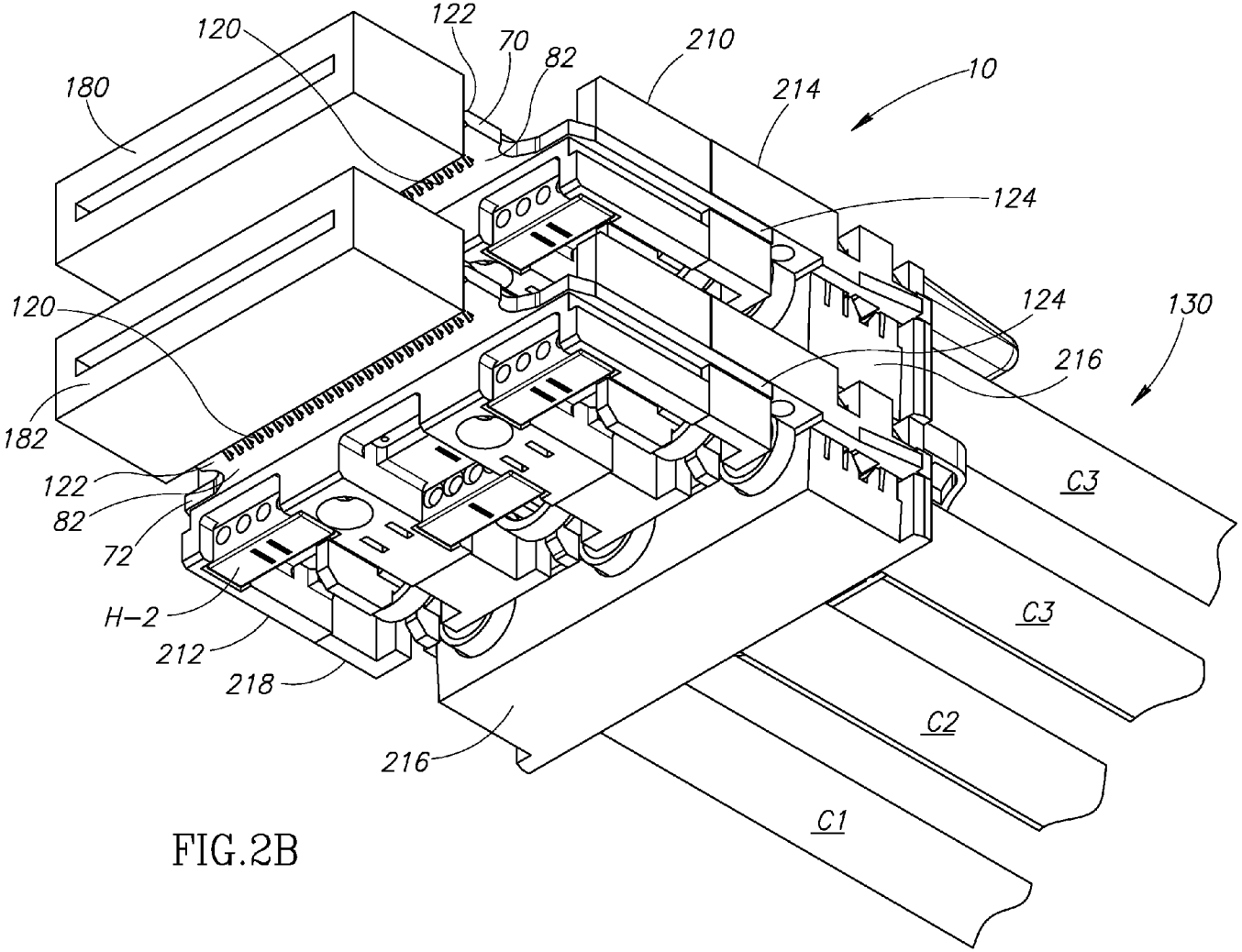
FIG. 2B is a perspective view of the male-type connector of FIG. 2A depicted with its housing removed.
Figure 2C:
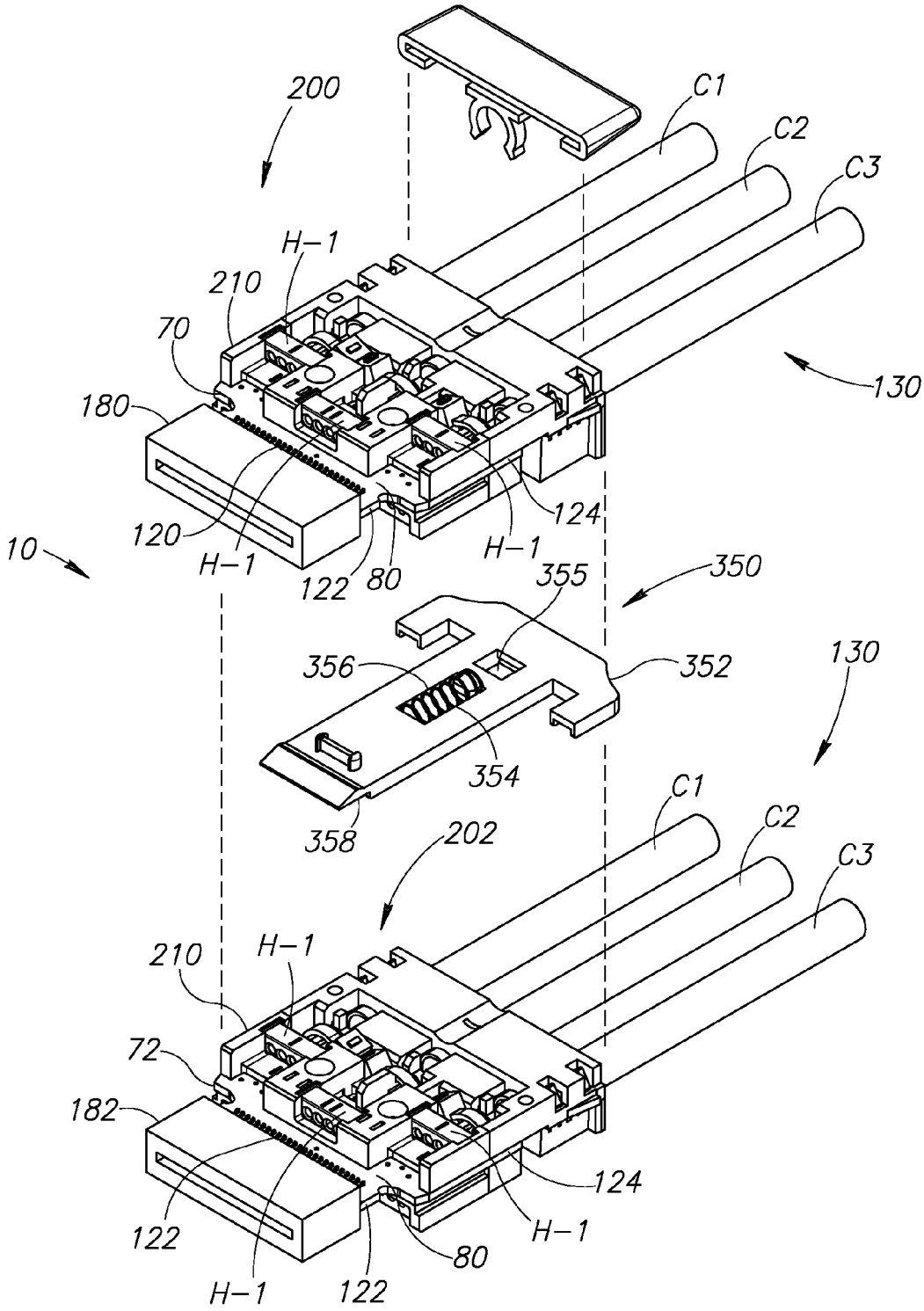
FIG. 2C is a partially exploded perspective view of the male-type connector of FIG. 2B illustrating an upper and lower subassembly with a latching mechanism positioned therebetween.
Figure 2D:
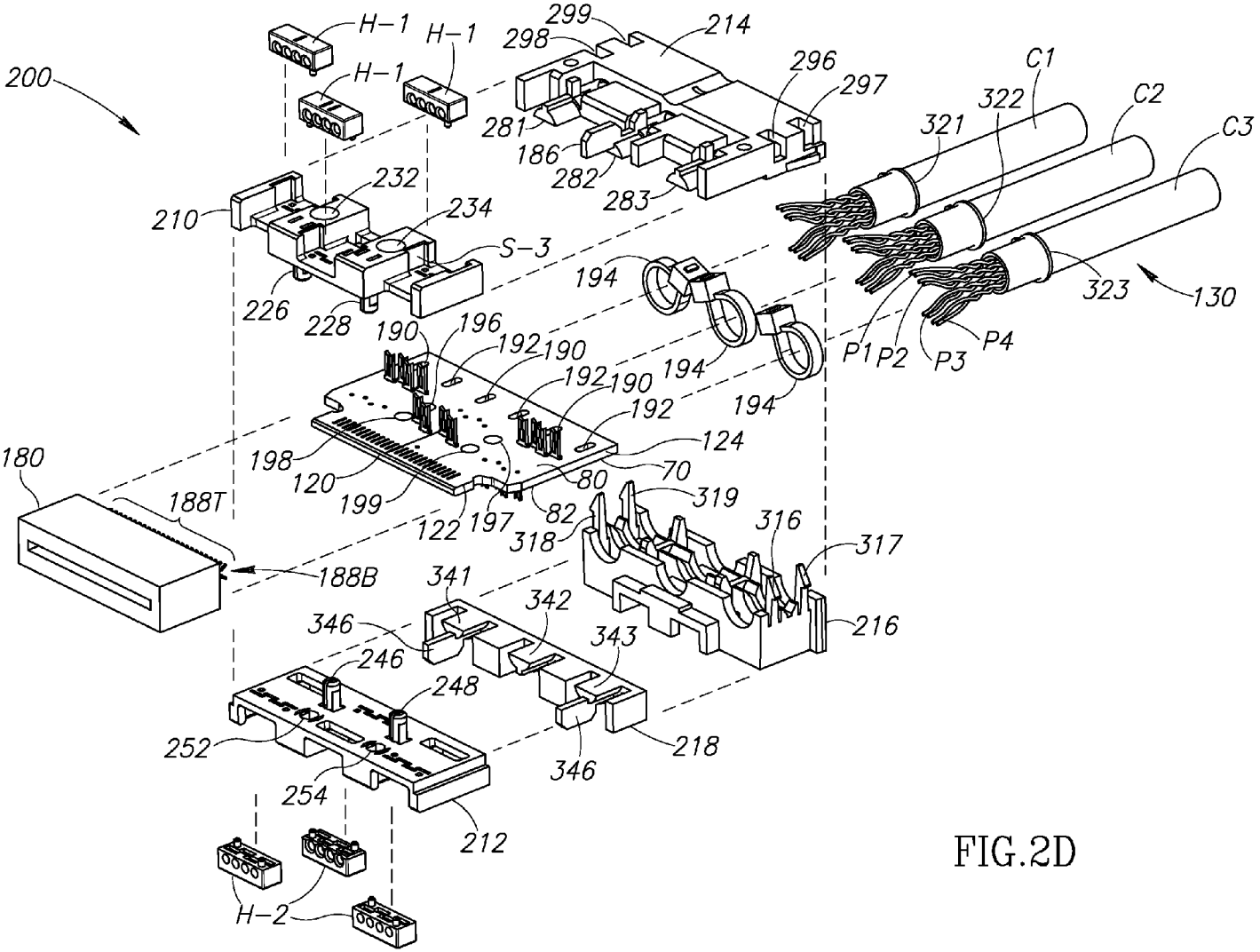
FIG. 2D is an exploded perspective view of the upper subassembly of FIG. 2C, which includes a substrate and a cable attachment assembly.
Figure 2E:
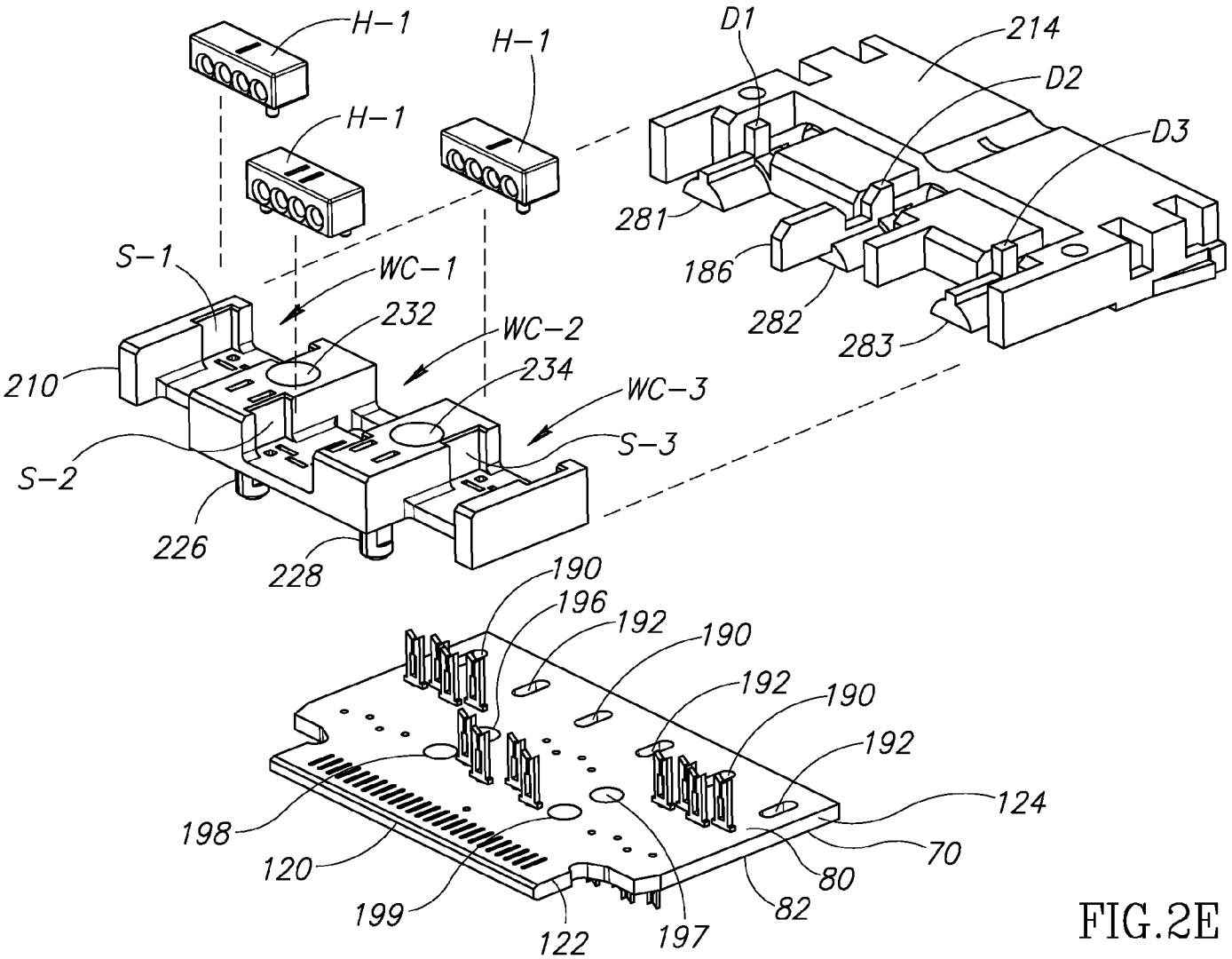
FIG. 2E is an enlarged perspective view of the substrate, a first wire securing member, a first cable securing member, and three multi-wire holders of the subassembly of FIG. 2D.
Figure 2F:
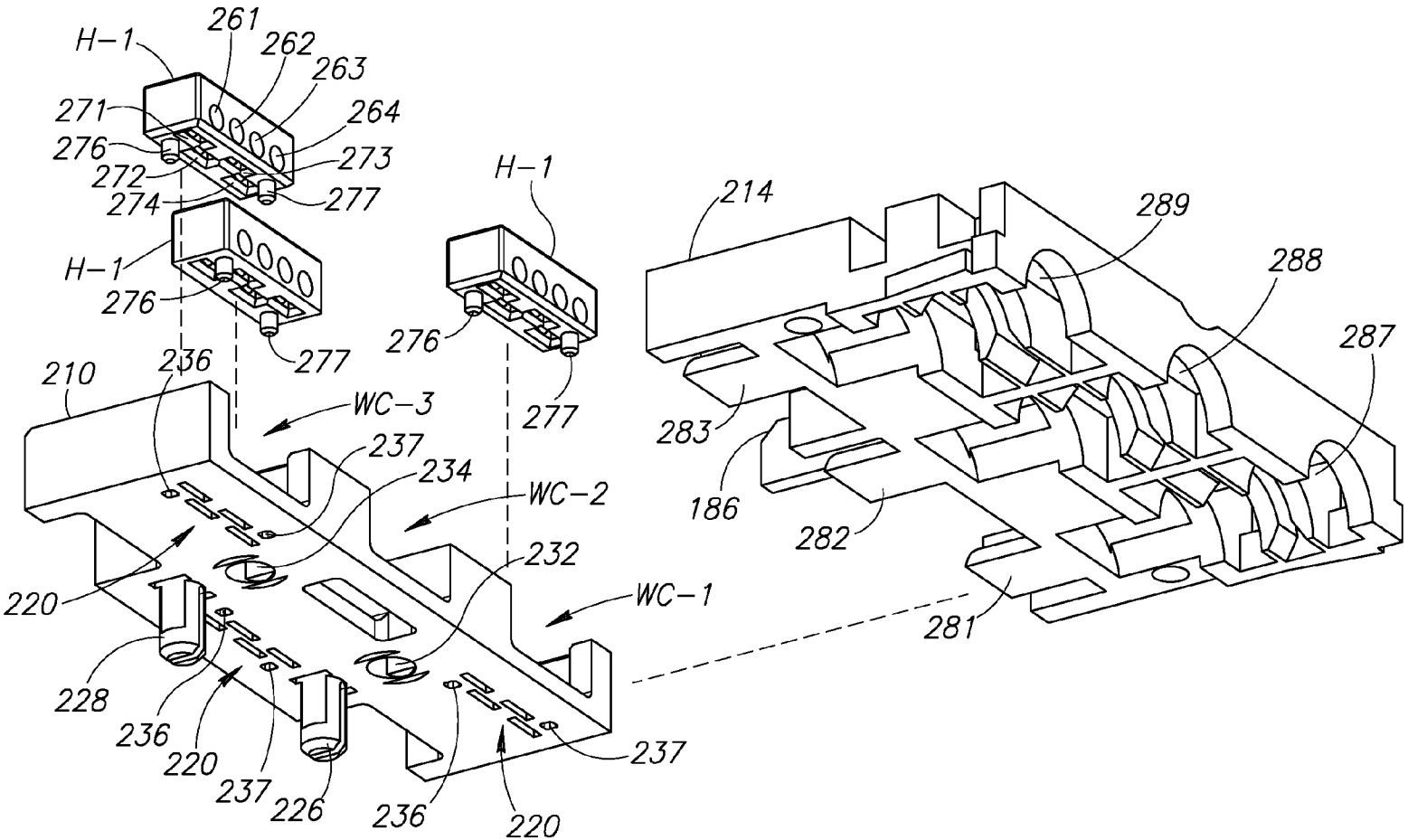
FIG. 2F is an enlarged perspective view of the substrate, the first wire securing member, the first cable securing member, and the three multi-wire holders of the subassembly of FIG. 2D.
Figure 2G:
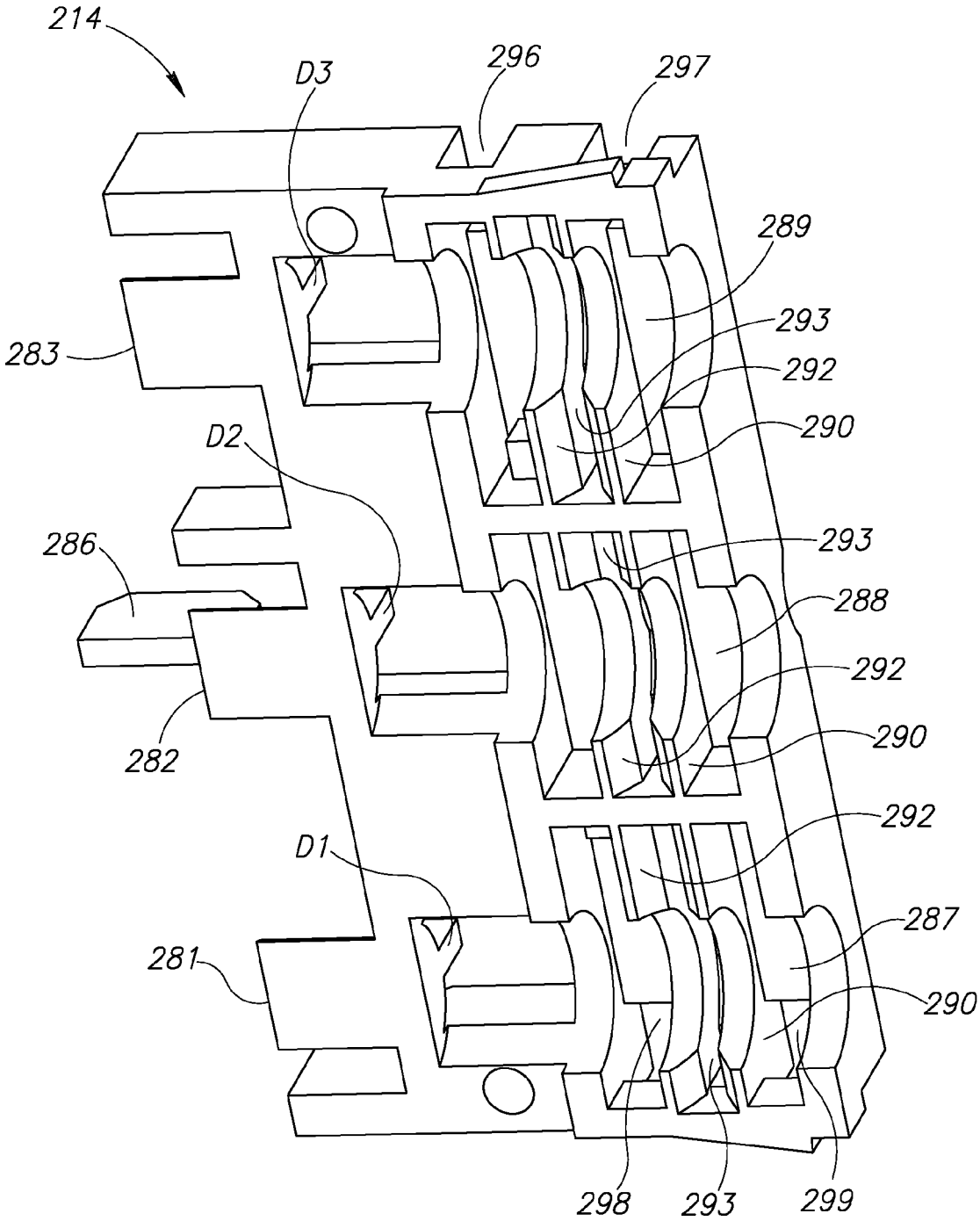
FIG. 2G is an enlarged perspective view of an underside of the first cable securing member of FIG. 2F.
Figure 2H:
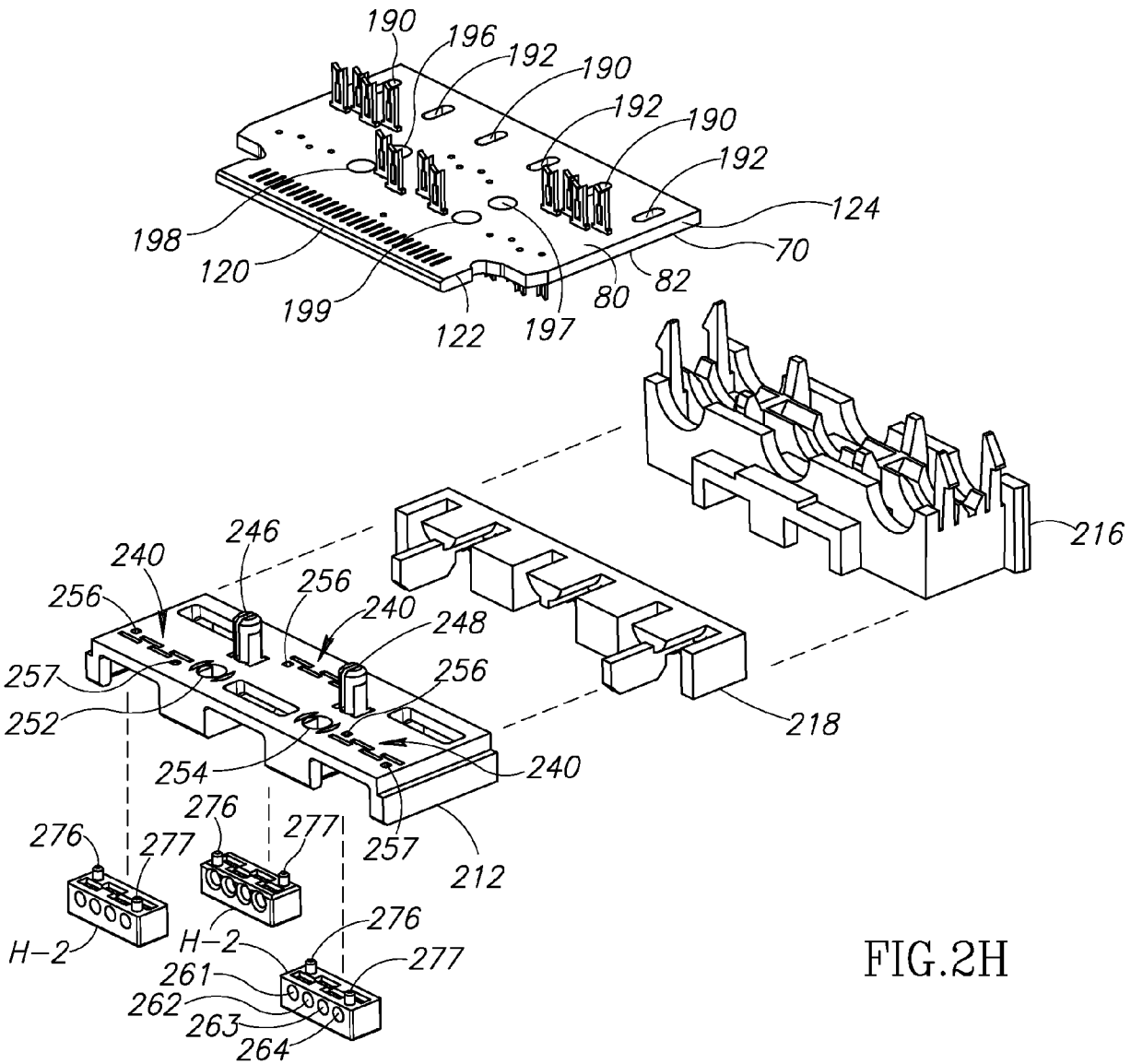
FIG. 2H is an enlarged perspective view of the substrate, a second wire securing member, a second cable securing member, an intermediate member, and three multi-wire holders of the subassembly of FIG. 2D.
Figure 2I:
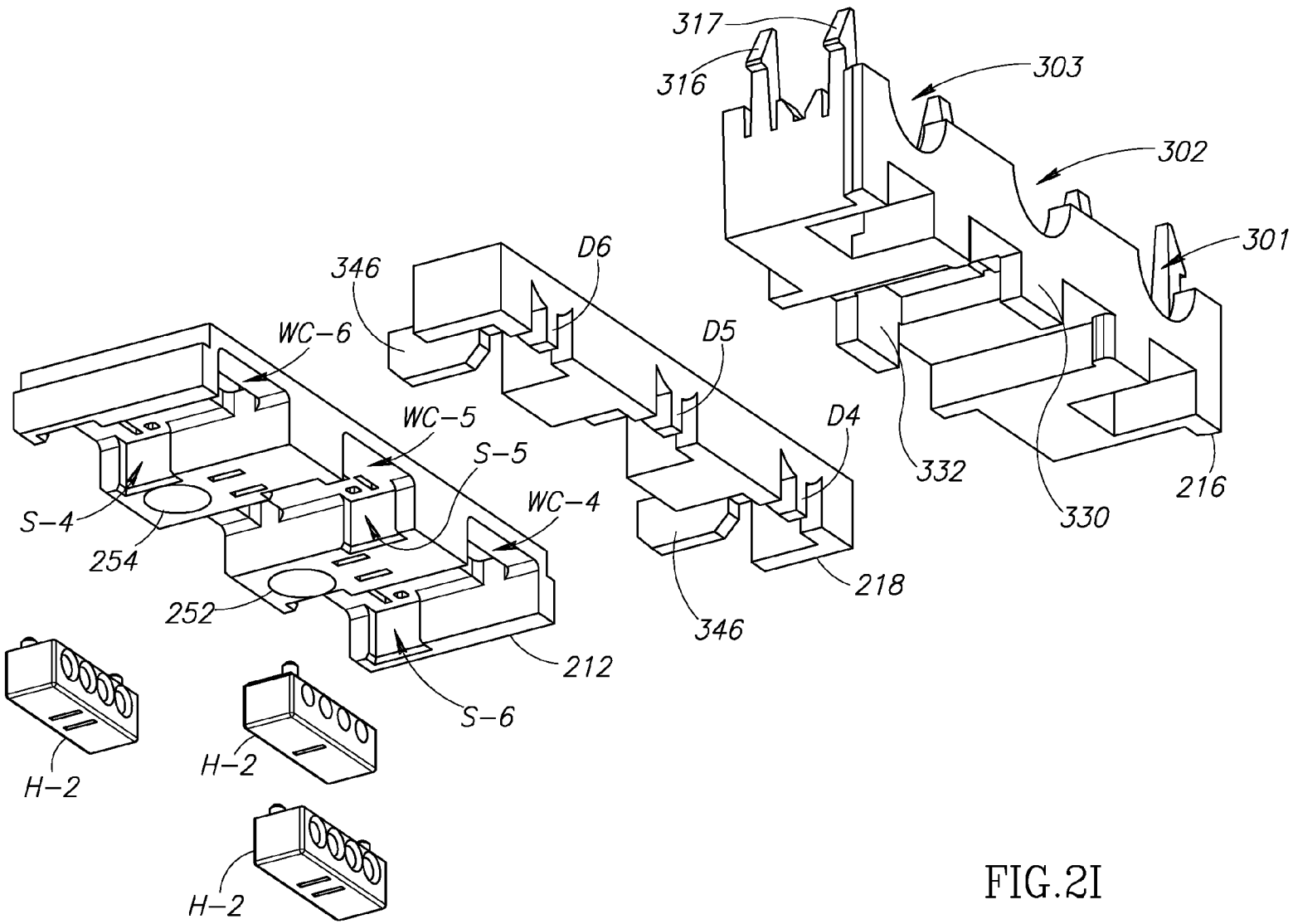
FIG. 2I is an enlarged perspective view of the substrate, the second wire securing member, the second cable securing member, the intermediate member, and the three multi-wire holders of FIG. 2H.
Figure 2J:
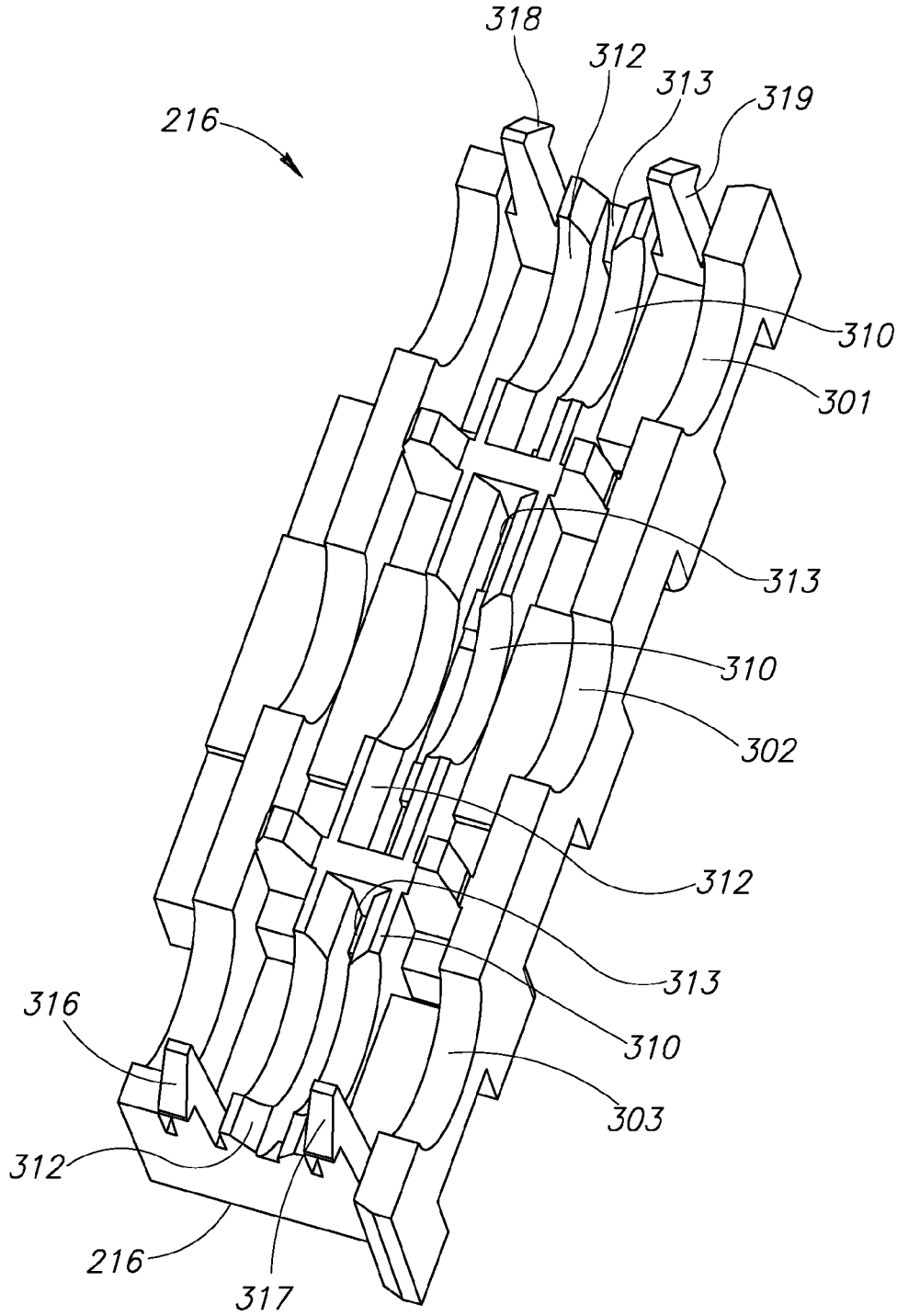
FIG. 2J is an enlarged perspective view of an underside of the second cable securing member of FIG. 2H.
Figure 2K:
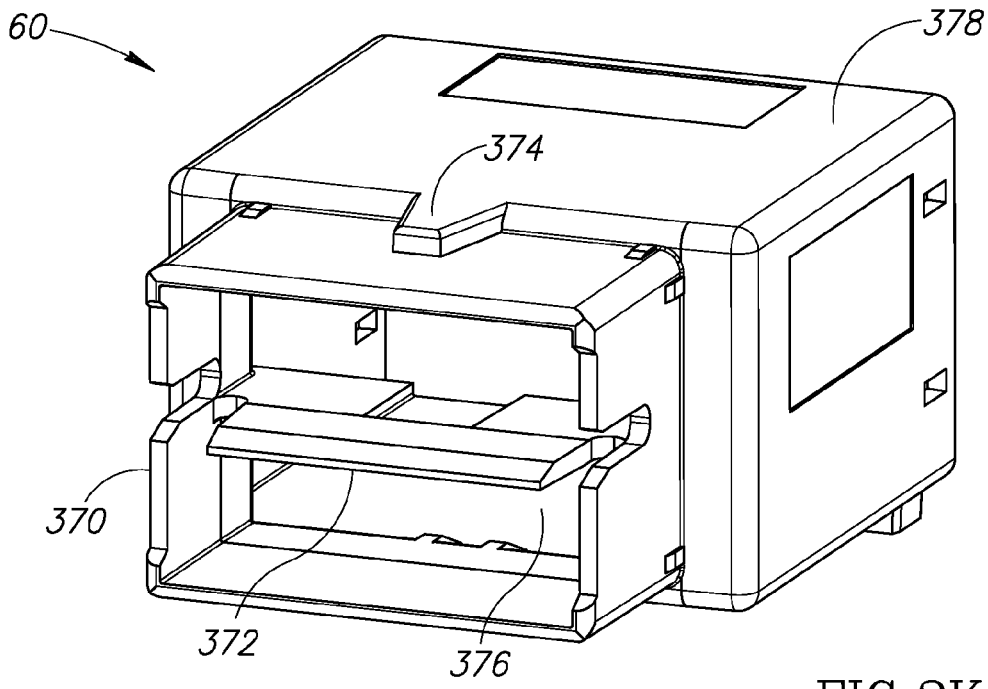
FIG. 2K is an enlarged perspective view of a front portion of the housing of the male-type connector of FIG. 2A.
Figure 2L:
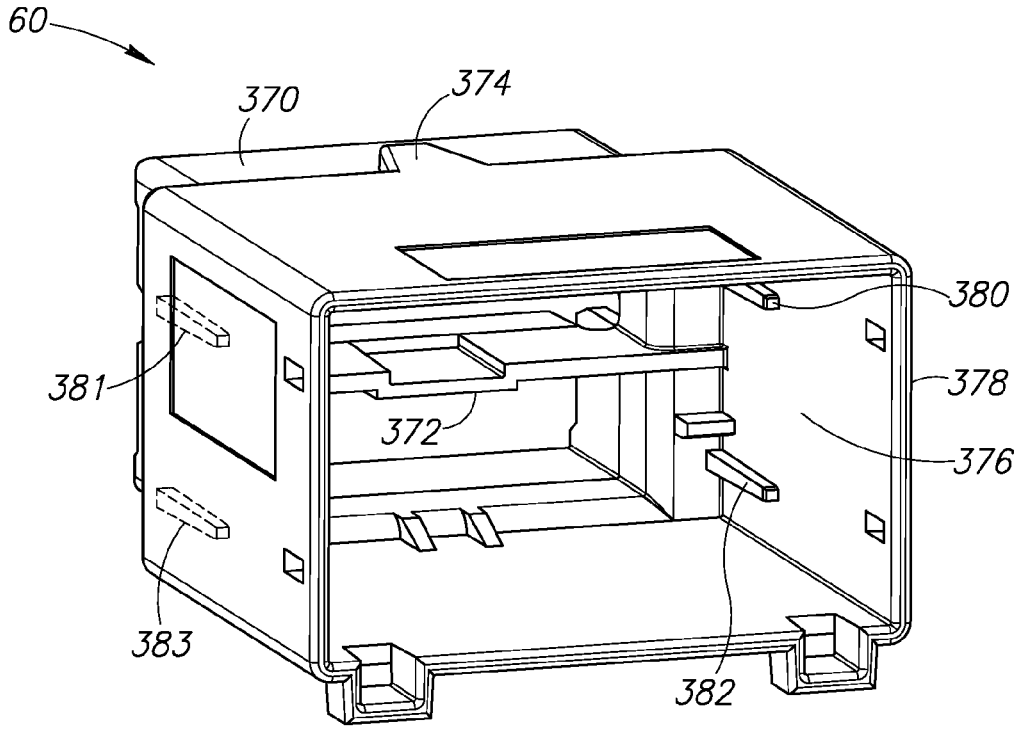
FIG. 2L is an enlarged perspective view of a rear portion of the housing of the male-type connector of FIG. 2A.
Figure 3A:
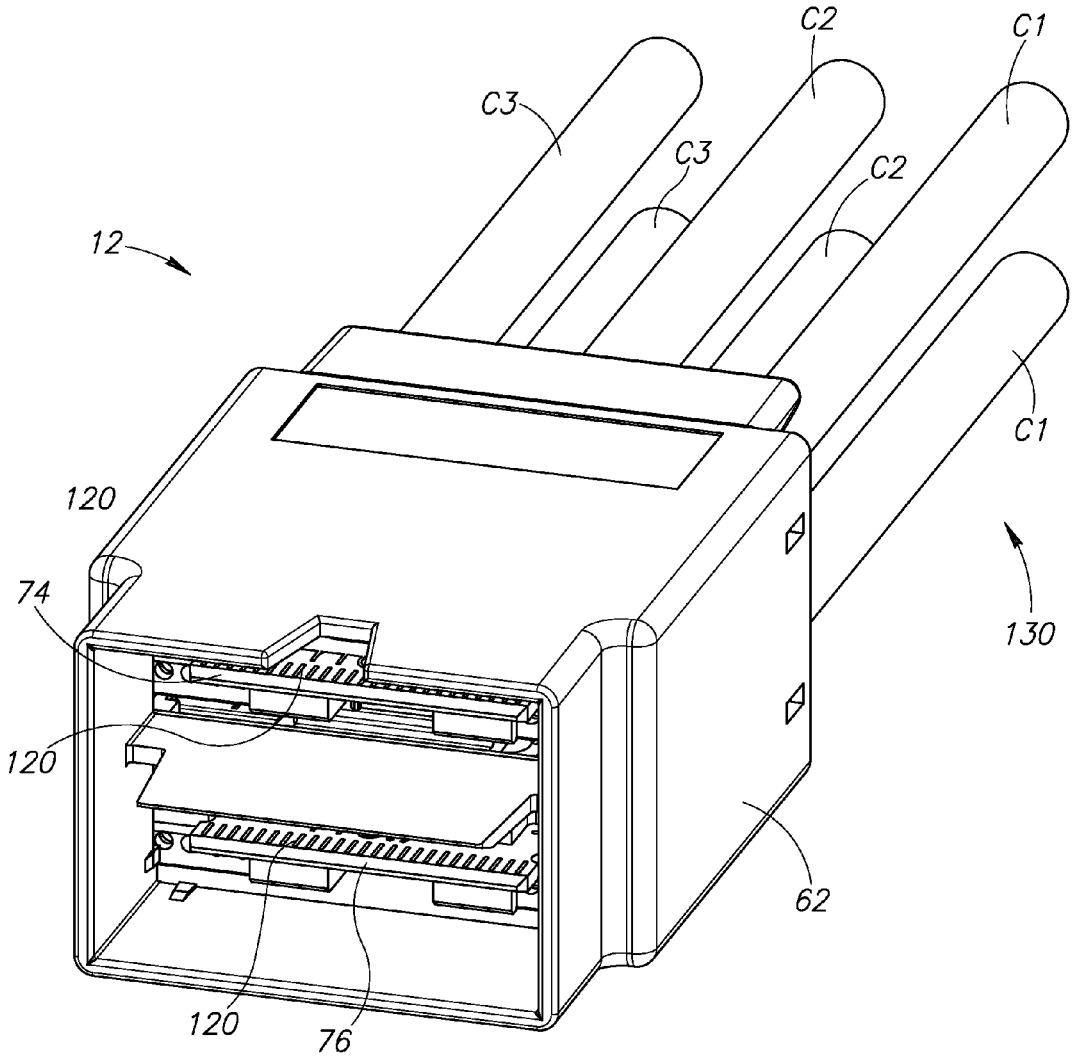
FIG. 3A is an enlarged perspective view of one of the female-type connectors of FIG. 1 terminating six cables.
Figure 3B:
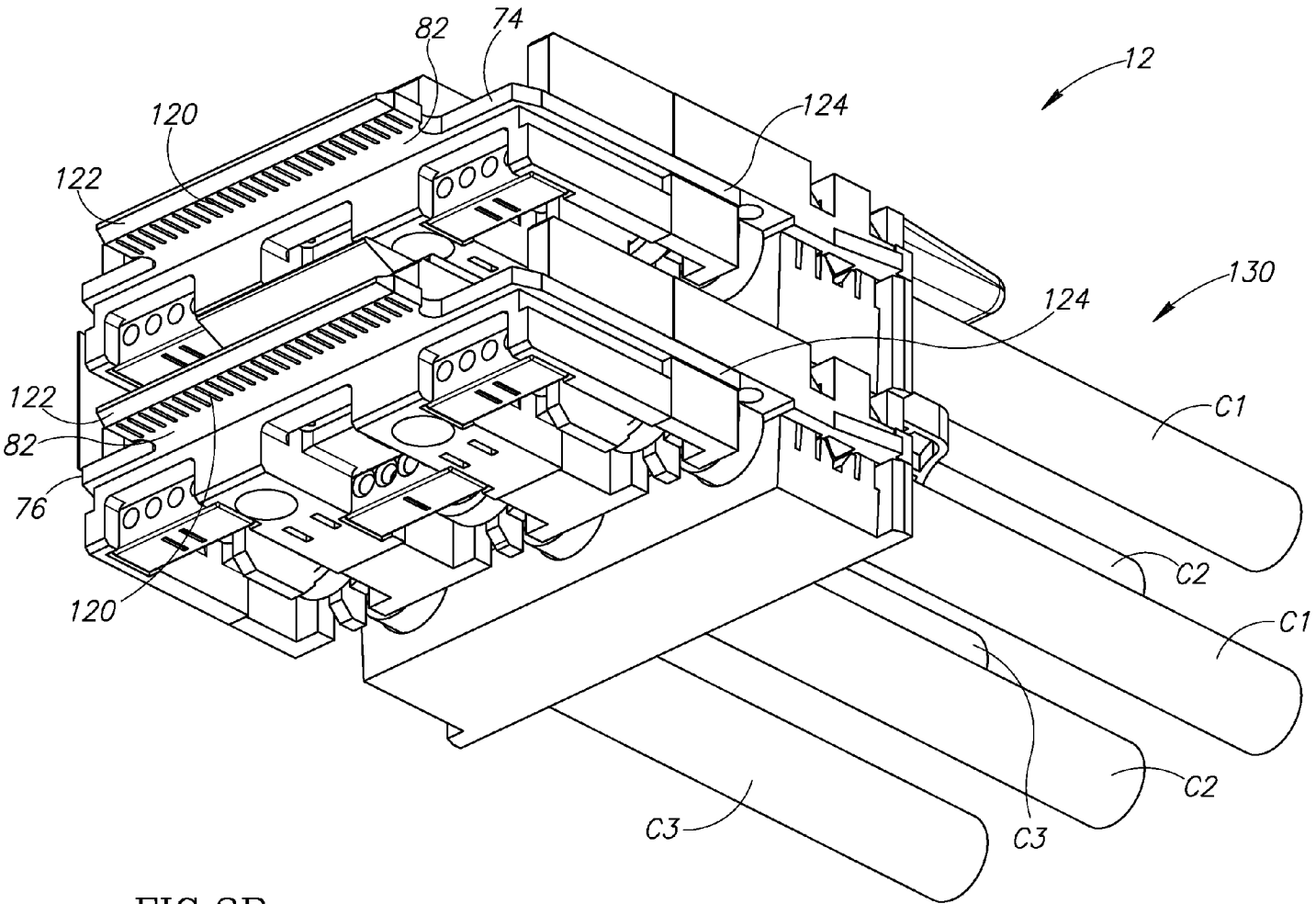
FIG. 3B is a perspective view of the female-type connector of FIG. 3A depicted with its housing removed.
Figure 3C:
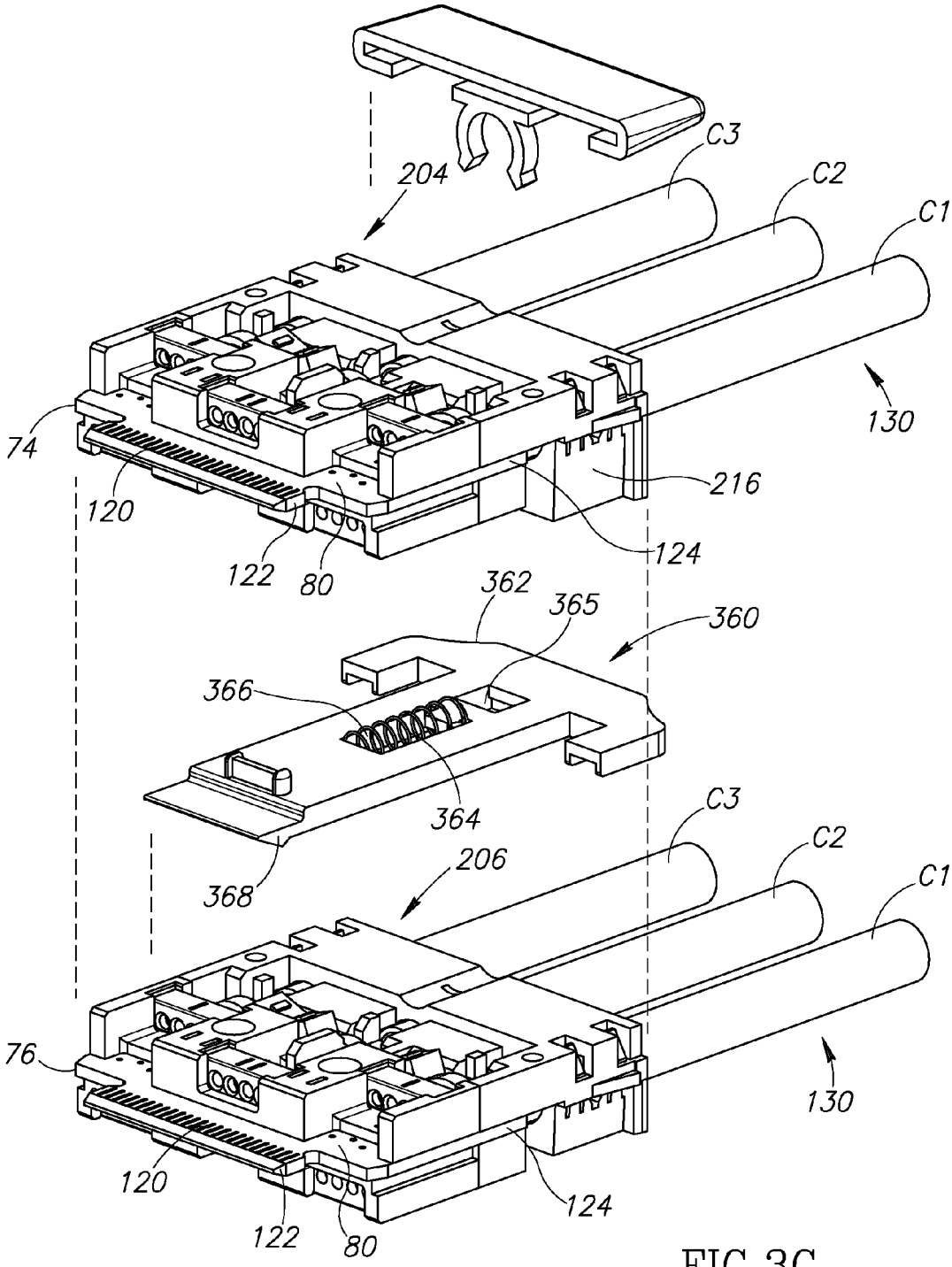
FIG. 3C is a partially exploded perspective view of the female-type connector of FIG. 3B illustrating an upper and lower subassembly with a latching mechanism positioned therebetween.
Figure 3D:
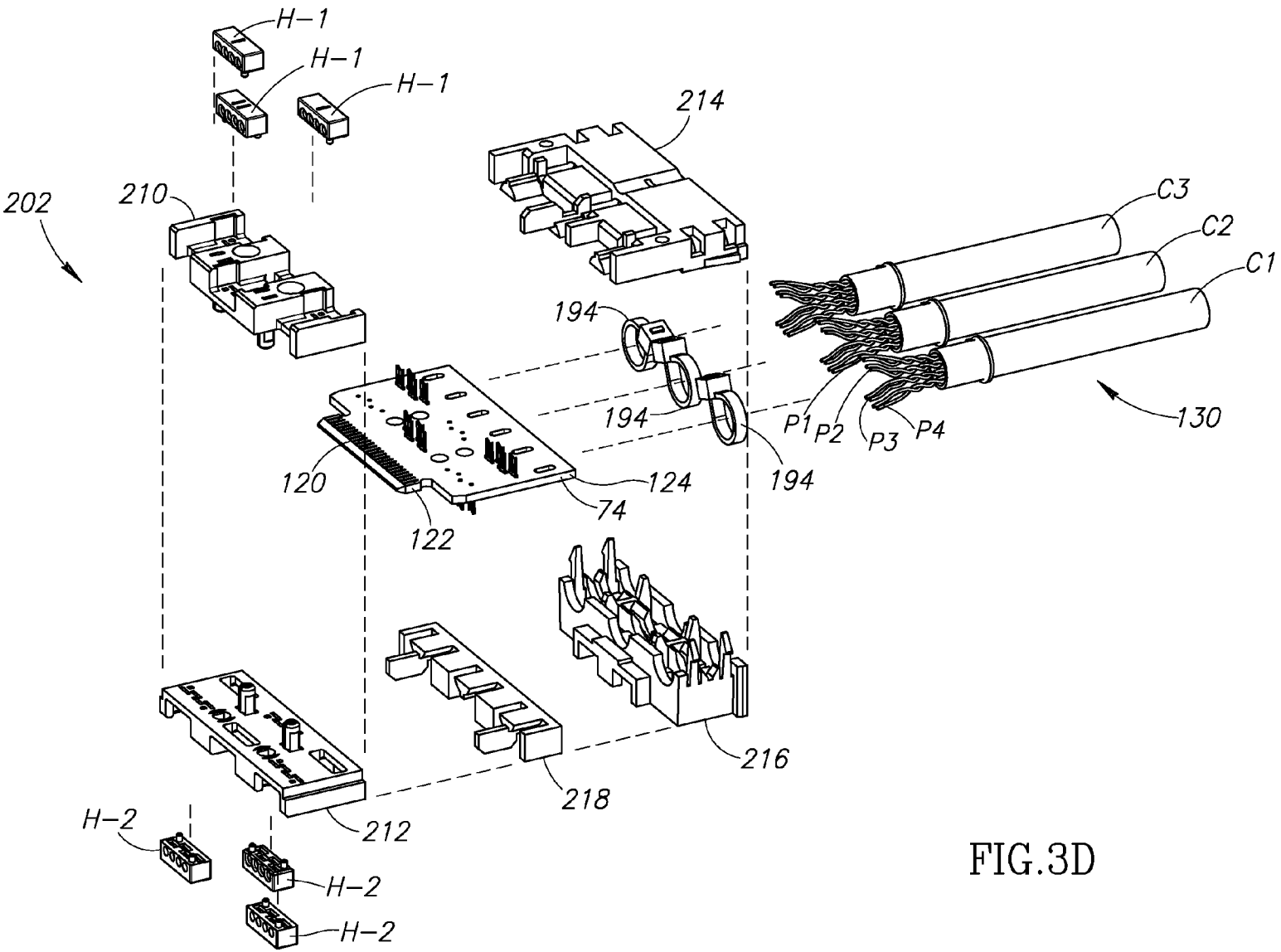
FIG. 3D is an exploded perspective view of the upper subassembly of FIG. 3C, which includes a substrate and a cable attachment assembly.

The male-type connector 10 is illustrated in greater detail in FIGS. 2A-2L and the female-type connector 12 is illustrated in greater detail in FIGS. 3A-3F. Turning to FIG. 2A, the male-type connector 10 includes an outer housing 60 and turning to FIG. 3A, the female-type connector 12 includes an outer housing 62. FIGS. 2B and 2C illustrate the male-type connector 10 with its housing 60 removed. Similarly, FIGS. 3B and 3C illustrate the female-type connector 12 with its housing 62 removed.

Turning to FIGS. 2B, 2C, 3B, and 3C, in the embodiments illustrated, the male and female-type connectors 10 and 12 each include one or more substrates upon which a plurality of circuits (described below) are mounted. For ease of illustration, in the embodiments illustrated, the male-type connector 10 is illustrated as including a first and second substrate 70 and 72 and the female-type connector 12 is illustrated as including a first and second substrate 74 and 76.

The substrates 70, 72, 74, and 76 are substantially identical to one another. In the figures, the substrates 70, 72, 74, and 76 have each been illustrated as a printed circuit board. In such implementations, the substrates 70, 72, 74, and 76 may be characterized as being cable interface boards. Inside the male-type connector 10, the substrates 70 and 72 are spaced apart and substantially parallel to one another and inside the female-type connector 12, the substrates 74 and 76 are spaced apart and substantially parallel to one another. The substrates 70, 72, 74, and 76 each include a first side 80 opposite a second side 82. In the embodiment illustrated, inside the male-type connector 10, the second side 82 of the first substrate 70 is adjacent the first side 80 of the second substrate 72. Similarly, inside the female-type connector 12, the second side 82 of the first substrate 74 is adjacent the first side 80 of the second substrate 76.

Because the substrates 70, 72, 74, and 76 are substantially identical to one another, only the substrate 70 will be described in detail. However, those of ordinary skill in the art appreciate that the substrates 72, 74, and 76 each have substantially identical structures to those described with respect to the substrate 70.

Figure 4A:
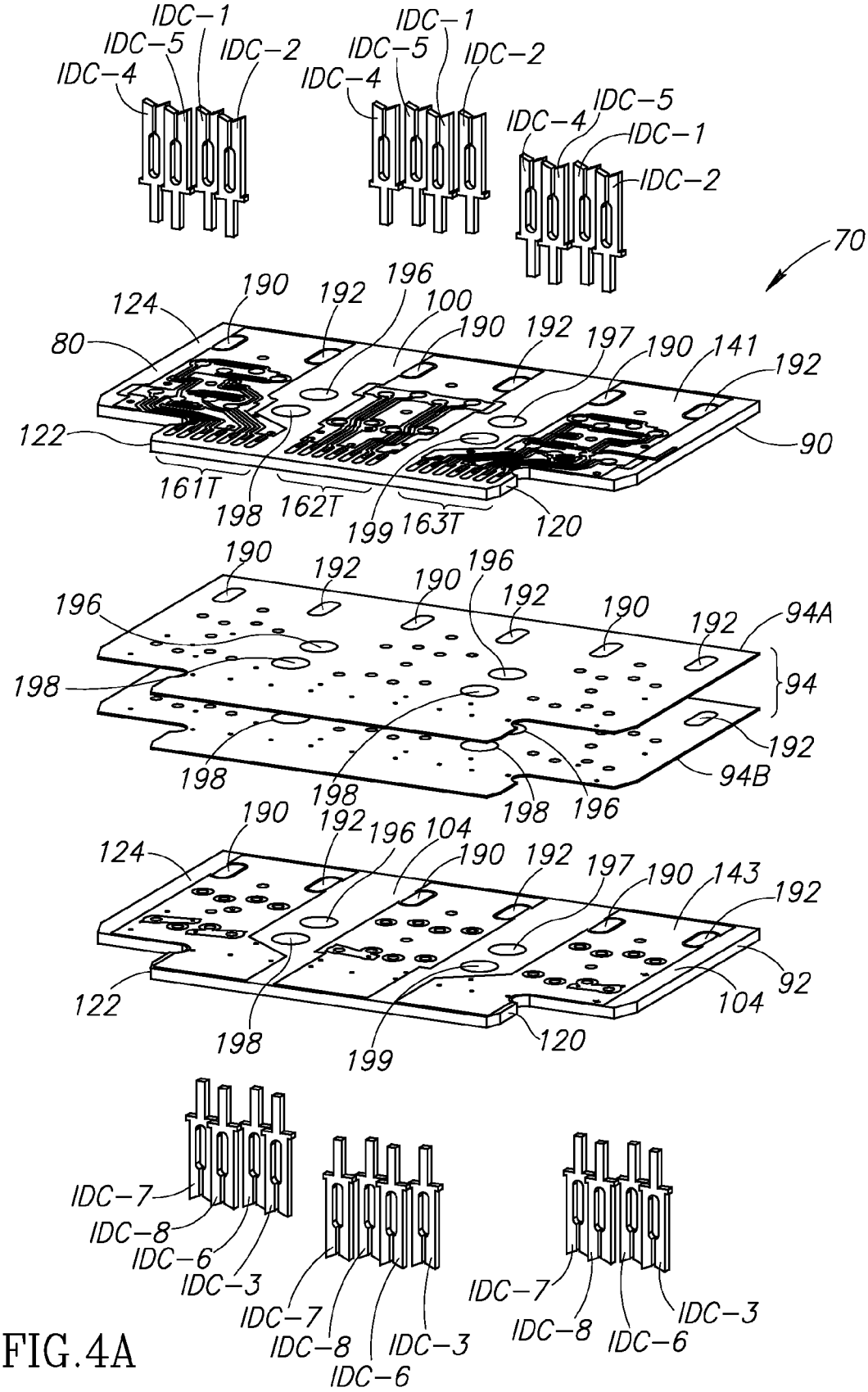
FIG. 4A is an enlarged partially exploded perspective view of the substrate of the upper subassembly of FIG. 2D.
Figure 4B:
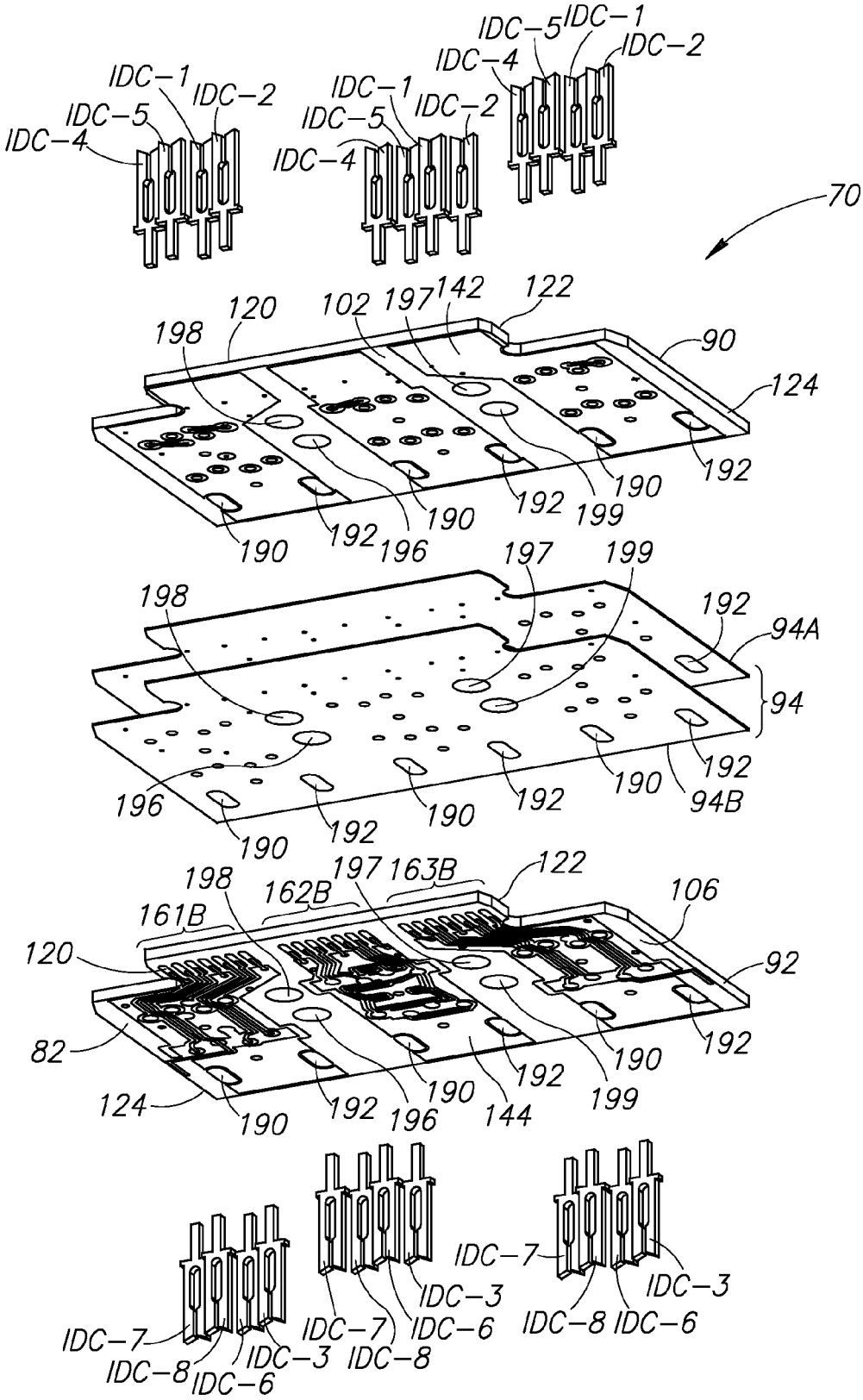
FIG. 4B is a partially exploded perspective view of the substrate of FIG. 4A.

FIGS. 4A-4F illustrate the substrate 70 in greater detail. Turning to FIGS. 4A and 4B, the substrate 70 includes a first substrate layer 90 and a second substrate layer 92 with an insulating layer 94 positioned between the first and second substrate layers. By way of a non-limiting example, the first and second substrate layers 90 and 92 may be constructed from a conventional core material used to construct conventional printed circuit boards and the insulating layer 94 may be constructed from a pre-impregnated material used to construct conventional printed circuit boards commonly referred to as "prepreg." By way of a non-limiting example, the insulating layer 94 may include a first insulating layer 94A adjacent the first layer 90 and a second insulating layer 94B adjacent the second layer 92.

The first layer 90 has a first surface 100 opposite a second surface 102 and the second layer 92 has a first surface 104 opposite a second surface 106. The second surface 102 of the first layer 90 is adjacent the insulating layer 94 and the first surface 104 of the second layer 92 is adjacent the insulating layer 94.

The substrate 70 includes an edge card male connector 120 along a first edge portion 122. As may be seen in FIG. 2D, the substrate 70 is configured to terminate a plurality of cables 130. In the embodiment illustrated, the cables 130 are attached to a second edge portion 124 of the substrate 70 opposite the first edge portion 122. Depending upon the implementation details, two or more of the cables 130 may be housed inside a single outer covering or sheath (not shown). However, embodiments in which separate cables are connected to the substrate 70 are within the scope of the present teachings.

In the embodiment illustrated, the substrate 70 is configured to terminate three cables "C1," "C2," and "C3." The cables "C1," "C2," and "C3" are substantially identical to one another. Therefore, only the cable "C1" will be described in detail. However, those of ordinary skill in the art appreciate that the cables "C2" and "C3" each include substantially identical structures to those described with respect to the cable "C1."

Figure 5:
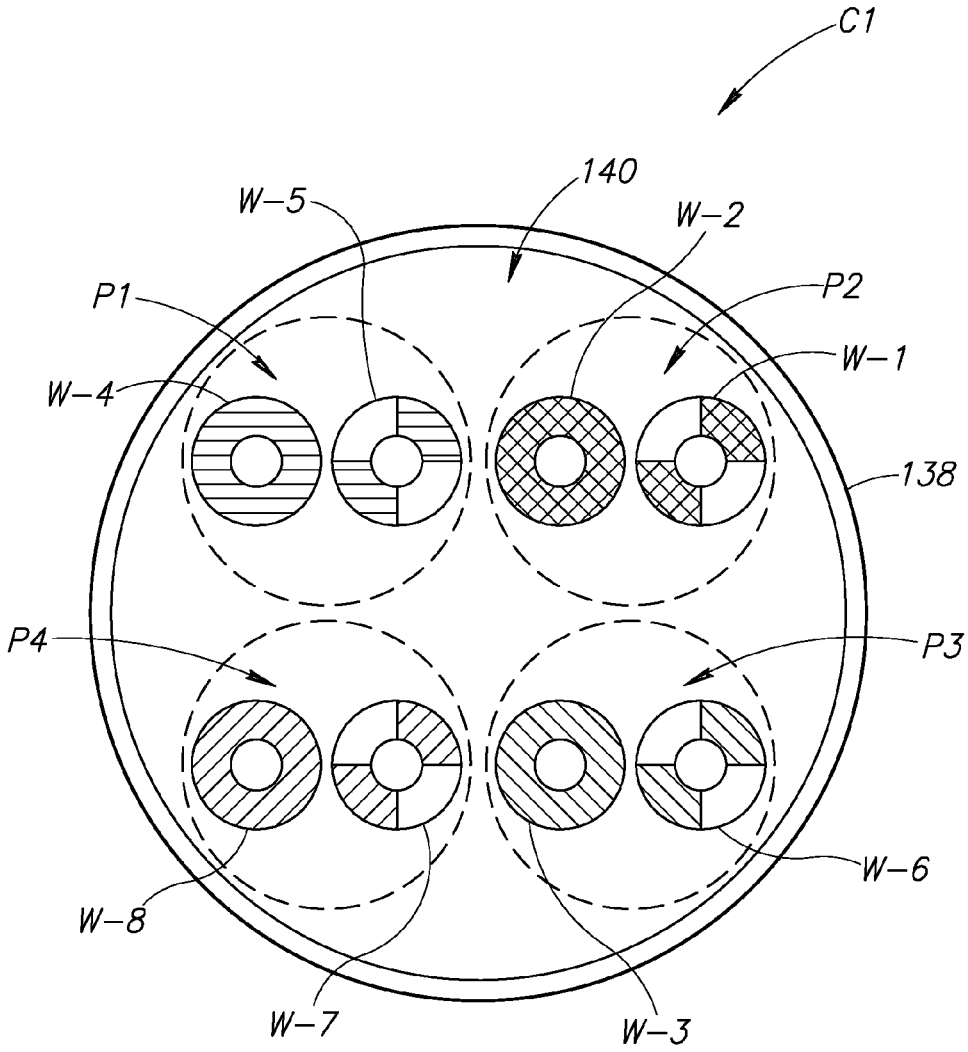
FIG. 5 is an enlarged lateral cross-section of one of the cables of FIGS. 2A and 3A.

Turning to FIG. 5, the cable "C1" includes a plurality of elongated wires 140 surrounded by an elongated outer cable sheath 138. In the embodiment illustrated, the cable "C1" includes eight wires "W-1" to "W-8." The eight wires "W-1" to "W-8" may be organized into twisted-wire pairs "P1" to "P4" each used to transmit a differential signal. For ease of illustration, the twisted-wire pair "P1" will be described as including the wires "W-4" and "W-5," the twisted-wire pair "P2" will be described as including the wires "W-1" and "W-2," the twisted-wire pair "P3" will be described as including the wires "W-3" and "W-6," and the twisted-wire pair "P4" will be described as including the wires "W-7" and "W-8."

Returning to FIGS. 4A and 4B, the substrate 70 may be conceptualized as including four layers of various conductive elements. A top layer 141 positioned on the first surface 100 of the first layer 90, a first inner layer 142 positioned on the second surface 102 of the first layer 90, a second inner layer 143 positioned on the first surface 104 of the second layer 92, and a bottom layer 144 positioned on the second surface 106 of the second layer 92. The first surface 80 (see FIG. 2E) of the substrate 70 corresponds to the top layer 141 and the second surface 82 (see FIG. 2B) of the substrate 70 corresponds to the bottom layer 144. As is apparent to those of ordinary skill in the art, the assignment of the terms "top" and "bottom" to the layers 141 and 144, respectively, is arbitrary and not intended to be limiting.

Elements including or constructed from conductive material (e.g., traces, printed wires, lands, pads, planes, and the like) are categorized herein in two groups. The first group includes signal carrying conductive path elements (e.g., traces, printed wires, and the like), which may be connected to various ancillary conductive elements and are referred to collectively as "conductive elements." Turning to FIGS. 4C-4F, a separate circuit for each of the cables "C1," "C2," and "C3" (see FIG. 2C) is mounted on one or more of the layers 141-144 of the substrate 70. By way of a non-limiting example, a first circuit 151 is mounted on the substrate 70 for the cable "C1," a second circuit 152 is mounted on the substrate 70 for the cable "C2," and a third circuit 153 is mounted on the substrate 70 for the cable "C3." Each of the circuits 151, 152, and 153 includes conductive elements belonging to the first group.

The second group includes specialized ground planes. Such specialized ground planes may be implemented as localized, electrically floating, isolated ground planes ("LEFIGPs"). The substrate 70 includes ground planes "GP-1," "GP-2," and "GP-3" for the circuits 151, 152, and 153, respectively. Each of the ground planes "GP-1," "GP-2," and "GP-3" illustrated is implemented as a LEFIGP. Each of the ground planes "GP-1," GP-2," and "GP-3" is disconnected from and electrically isolated from the others. However, each of the ground planes "GP-1," GP-2," and "GP-3" may be electrically connected to similar corresponding structures on adjacent mated substrates (not shown) and/or additional local shield elements such as those used to shroud outlets 500-1 to 500-3 (illustrated in FIGS. 6C and 6D).

Each of the ground planes "GP-1," "GP-2," and "GP-3" is disconnected from the conductive elements (e.g., traces) of the circuits 151, 152, and 153. However, the ground planes "GP-1," "GP-2," and "GP-3" are positioned relative to the circuits 151, 152, and 153, respectively, to receive energy radiated outwardly from the conductive elements of the circuits 151, 152, and 153, respectively. For example, the ground planes "GP-1," "GP-2," and "GP-3" may be positioned in close proximity to the circuits 151, 152, and 153, respectively, to receive energy radiated outwardly from the conductive elements of the circuits 151, 152, and 153, respectively.

When elements including or constructed from conductive material (e.g., the conductive elements of a circuit or ground plane) are positioned on different layers, they may be interconnected by vertically oriented conductive elements, such as vertical interconnect accesses ("VIAs") (e.g., a VIA "V-GP" and VIAs "V-1" to "V-8" depicted in FIGS. 4C-4F).

In a conventional communication connector (not shown), the wires of a cable are typically connected (e.g., soldered) to a circuit on the same side of the substrate. In contrast, returning to FIG. 2D, some of the wires "W-1" to "W-8" (see FIG. 5) of each of the cables "C1," "C2," and "C3" are connected to the circuits 151, 152 and 153 (see FIGS. 4C-4F), respectively, on the first side 80 of the substrate 70 and some of the wires of each of the cables are connected to the circuits on the second side 82 of the substrate. Thus, the wires "W-1" to "W-8" straddle or flank the second edge portion 124 of the substrate 70. In the embodiment illustrated, the twisted-wire pairs "P1" and "P2" are connected to the first side 80 of the substrate 70 (which corresponds to the top layer 141) and the twisted-wire pairs "P3" and "P4" are connected to the second side 82 of the substrate 70 (which corresponds to the bottom layer 144).

The wires "W1" to "W8" of the cables "C1," "C2," and "C3" may be soldered to the circuits 151, 152 and 153, respectively. Alternatively, returning to FIGS. 4A and 4B, insulation displacement connectors "IDC-1" to "IDC-8" may be used to form electrical connections between the wires "W1" to "W8" of the cables "C1," "C2," and "C3" (see FIG. 2D) and the circuits 151, 152 and 153 (see FIGS. 4C-4F), respectively. Returning to FIGS. 4C-4F, for each of the circuits 151, 152, and 153, the insulation displacement connectors "IDC-4," "IDC-5," "IDC-1," and "IDC-2" (see FIGS. 4A and 4B) may be connected to the circuit by inserting them into the VIAs "V-4," "V-5," "V-1," and "V-2," respectively, on the first side 80 of the substrate 70. For each of the circuits 151, 152, and 153, the insulation displacement connectors "IDC-7," "IDC-8," "IDC-6," and "IDC-3" (see FIGS. 4A and 4B) may be connected to the circuit by inserting them into the VIAs "V-7," "V-8," "V-6," and "V-3," respectively, on the second side 82 of the substrate 70.

To help reduce crosstalk, on the first side 80 of the substrate 70, the insulation displacement connectors "IDC-4," "IDC-5," "IDC-1," and "IDC-2" connected to the circuit 152 may be offset from those insulation displacement connectors "IDC-4," "IDC-5," "IDC-1," and "IDC-2" connected to the circuits 151 and 153 relative to the edge card male connector 120. In other words, the insulation displacement connectors "IDC-4," "IDC-5," "IDC-1," and "IDC-2" connected to the circuits 151, 152, and 153 are not aligned along the second edge portion 124 of the substrate 70. Further, on the second side 82 of the substrate 70, the insulation displacement connectors "IDC-7," "IDC-8," "IDC-6," and "IDC-3" connected to the circuit 152 may be offset from those insulation displacement connectors "IDC-7," "IDC-8," "IDC-6," and "IDC-3" of the circuits 151 and 153 relative to the edge card male connector 120. In other words, the insulation displacement connectors "IDC-7," "IDC-8," "IDC-6," and "IDC-3" connected to the circuits 151, 152, and 153 are not aligned along the second edge portion 124 of the substrate 70.

In the embodiment illustrated, the insulation displacement connectors "IDC-4," "IDC-5," "IDC-1," and "IDC-2" connected to the circuit 151 on the first side 80 of the substrate 70 are offset from the insulation displacement connectors "IDC-7," "IDC-8," "IDC-6," and "IDC-3" connected to the circuit 151 on the second side 82 of the substrate 70. The insulation displacement connectors "IDC-4," "IDC-5," "IDC-1," and "IDC-2" of the circuit 152 on the first side 80 of the substrate 70 are offset from the insulation displacement connectors "IDC-7," "IDC-8," "IDC-6," and "IDC-3" of the circuit 152 on the second side 82 of the substrate 70. The insulation displacement connectors "IDC-4," "IDC-5," "IDC-1," and "IDC-2" connected to the circuit 153 on the first side 80 of the substrate 70 are offset from the insulation displacement connectors "IDC-7," "IDC-8," "IDC-6," and "IDC-3" connected to the circuit 153 on the second side 82 of the substrate 70.

As mentioned above, the substrate 70 includes the ground planes "GP-1," "GP-2," and "GP-3," for the circuits 151, 152, and 153, respectively (see FIGS. 4C-4F). The ground plane "GP-1" may be characterized as being associated with the circuit 151. The ground plane "GP-2" may be characterized as being associated with the circuit 152. The ground plane "GP-3" may be characterized as being associated with the circuit 153. Each of the ground planes "GP-1," GP-2," and "GP-3" is constructed from conductive material positioned on each of four different layers "GPL1," "GPL2," "GPL3," and "GPL4" (see FIGS. 4C-4F). Each of the circuits 151, 152, and 153 includes conductive elements (e.g., traces "TC-1" to "TC-8"). These conductive elements may be arranged in pairs (e.g., a first pair of conductive elements "TC-4" and "TC-5," a second pair of conductive elements "TC-1" and "TC-2," a third pair of conductive elements "TC-3" and "TC-6," and a fourth pair of conductive elements "TC-7" and "TC-8"). Each of the ground planes "GP-1," GP-2," and "GP-3" is positioned in close proximity to the conductive elements of the circuit associated with the ground plane to contain electromagnetic fields within the associated circuit by providing a localized common ground to which energy can be conveyed rather than radiated outwardly to other conductors within the circuit itself and/or surrounding circuits.

It is often desirable to have the impedance-to-ground of one conductive element of a pair of conductive elements substantially equal to the impedance-to-ground of the other conductive element of the pair. This fosters a condition referred to as "balanced to ground," which is known to be the best case condition for minimizing crosstalk between the pair of conductors and other surrounding conductors. The conductive material that makes up ground planes "GP-1," GP-2," and "GP-3" provide a localized common ground plane for the circuits 151, 152, and 153, respectively. While the overall impedance-to-ground of any conductive element is influenced by additional factors, (such as the length and thickness of the conductive element), the dimensional relationship between each of the paired conductive elements and the conductive components of the associated ground plane at any particular point along the length of the conductive element may be varied to control the impedance of that conductive element to the localized common ground at that particular point. By controlling this impedance along the length of a pair of conductive elements, the overall common mode impedance of the pair may be controlled. In addition, the differential mode impedance of a pair of conductive elements may also be controlled at any point along the length of the pair by varying these impedances; however, this impedance is also influenced significantly by the dimensional relationship between the two paired conductive elements.

Figure 4C:
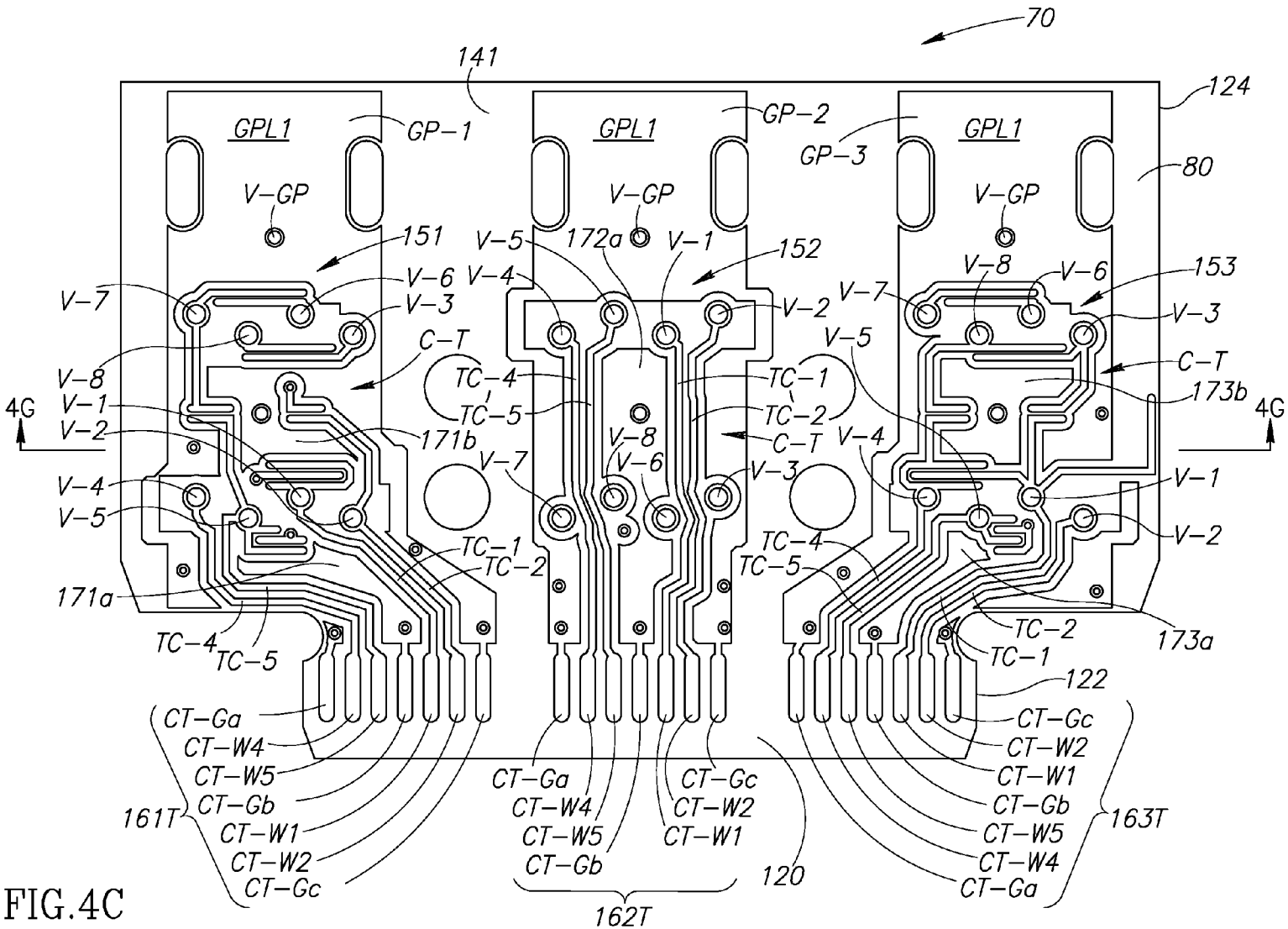
FIG. 4C is a top view of a top layer of the substrate of FIG. 4A.
Figure 4D:
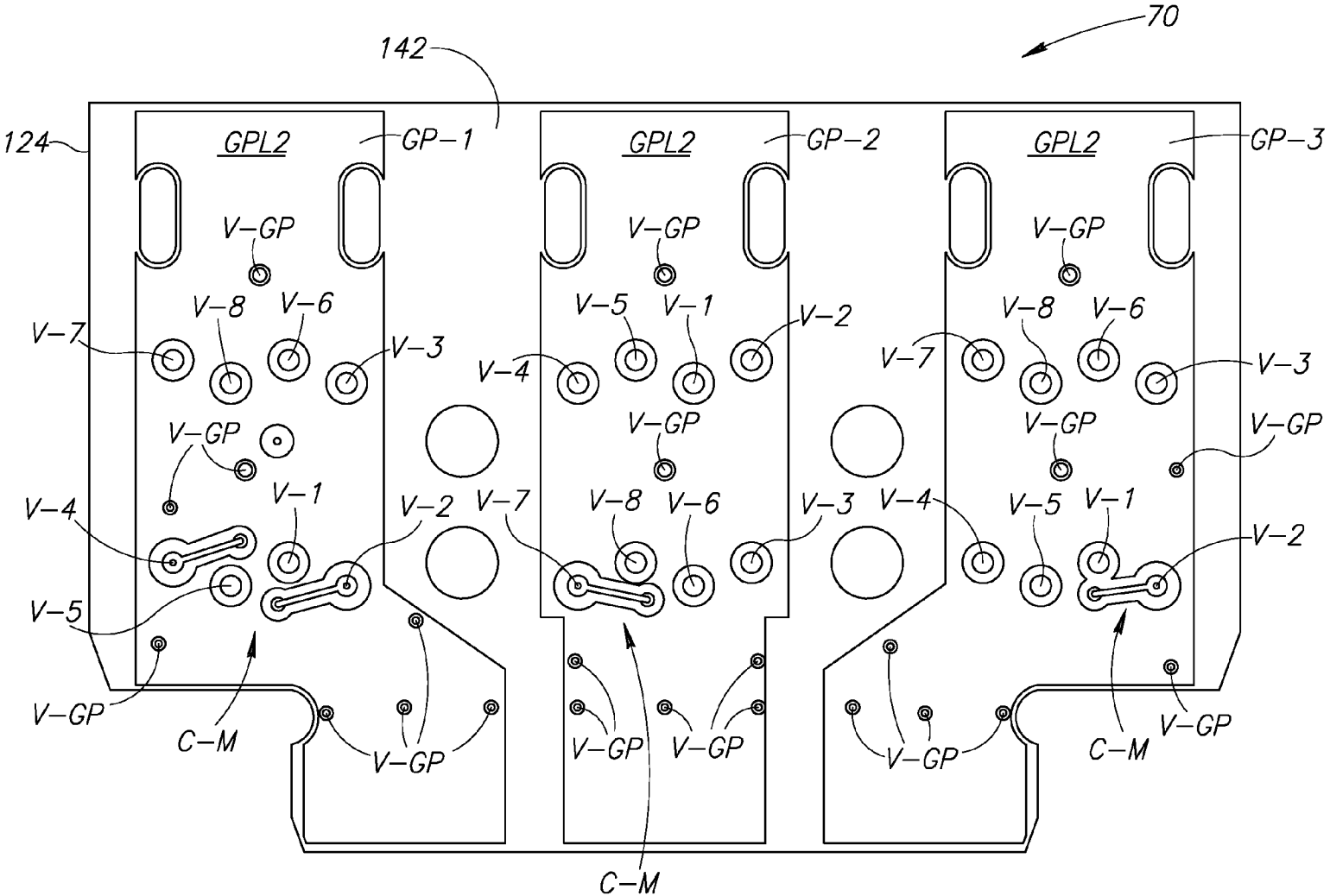
FIG. 4D is a top view of a first inner layer of the substrate of FIG. 4A.
Figure 4E:
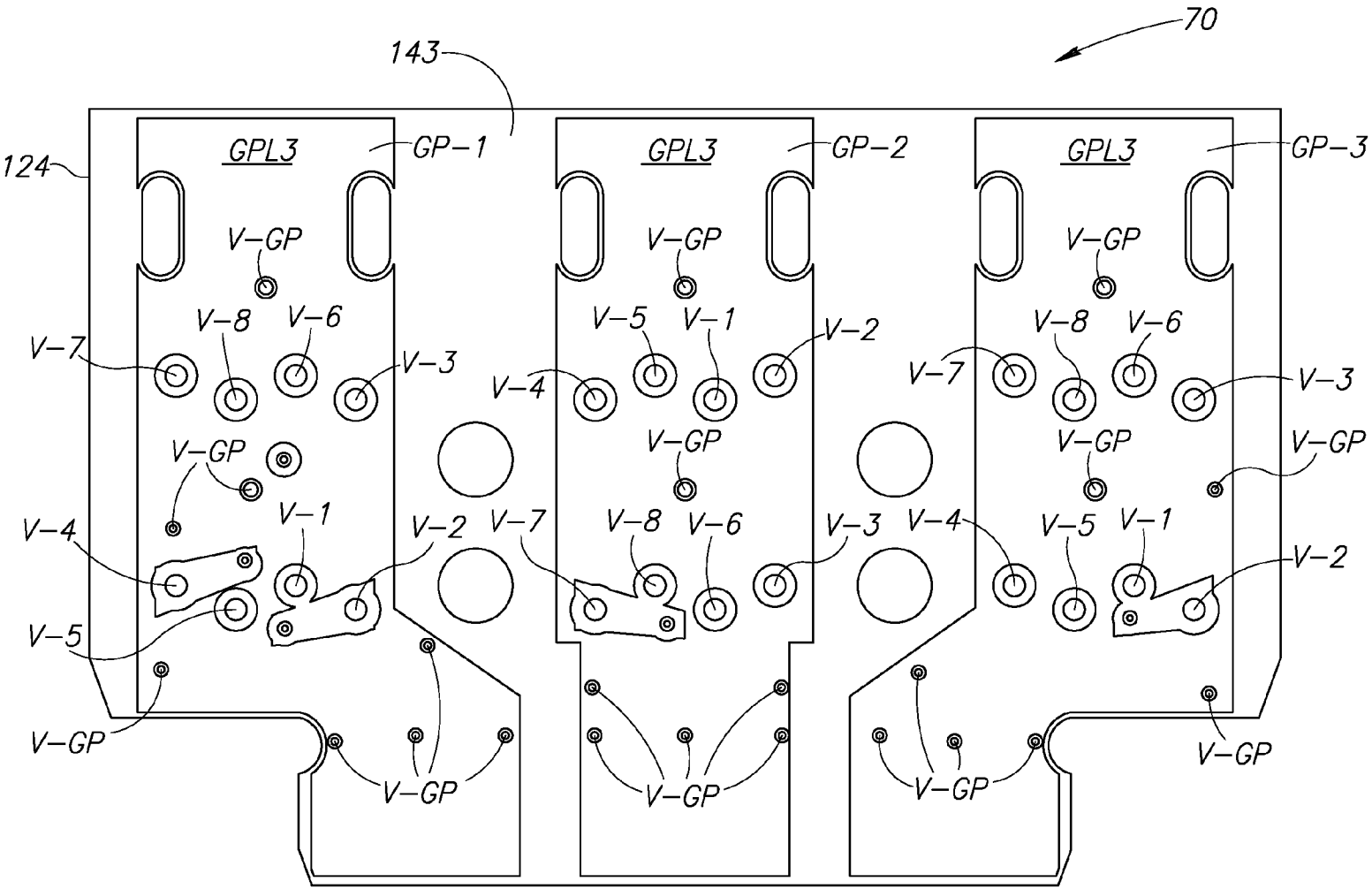
FIG. 4E is a top view of a second inner layer of the substrate of FIG. 4A.
Figure 4F:
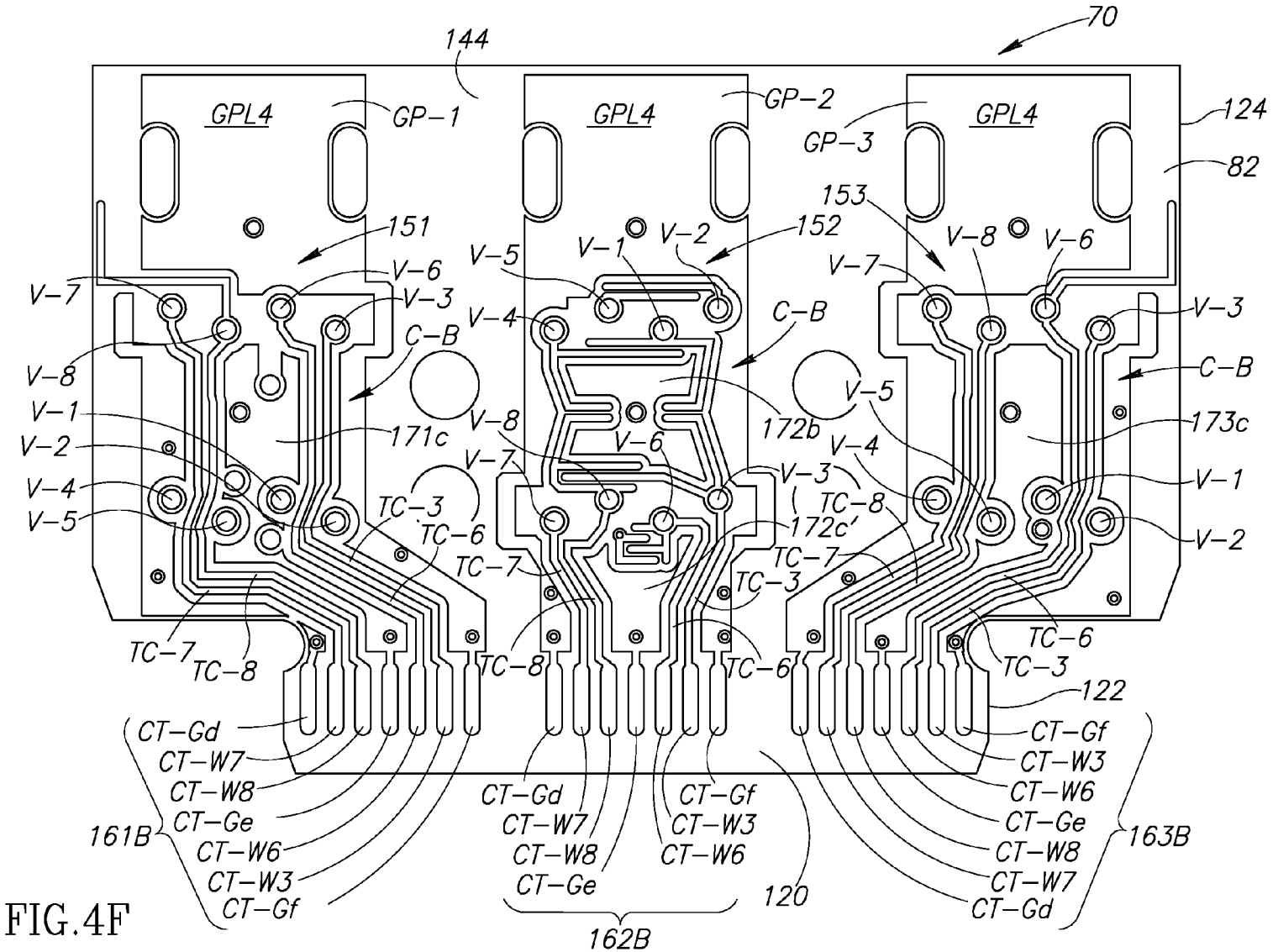
FIG. 4F is a top view of a bottom layer of the substrate of FIG. 4A.
Figure 4G:
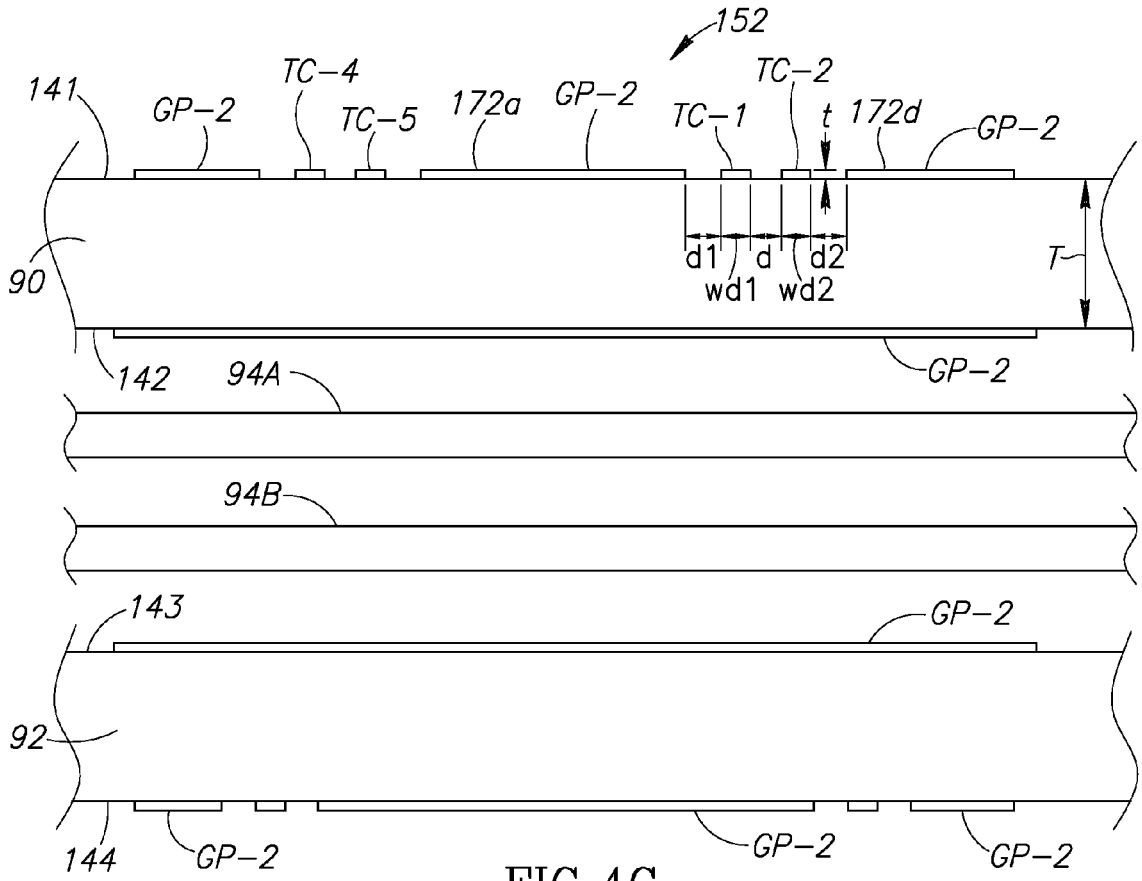
FIG. 4G is an exploded enlarged partial cross-sectional view of the substrate of FIGS. 4A-4F cross-sectioned along the 4G-4G line of FIG. 4C illustrating a pair of traces "TC-1" and "TC-2" positioned on the top layer of the substrate.

FIG. 4G illustrates a cross-section of a portion of the substrate 70 at a particular location that includes the circuit 152 and the ground plane "GP-2." The circuit 152 includes a pair of conductive elements, e.g., traces "TC-1" and "TC-2," positioned on the top layer 141. The top layer 141 is on the first substrate layer 90, which has a thickness "T." As illustrated in FIG. 4G, at this particular location, the traces "TC-1" and "TC-2" are spaced apart by a distance "d." The trace "TC-1" has a width "wd1" and is spaced apart from an adjacent portion 172*a* of the ground plane "GP-2" by a distance "d1." The trace "TC-2" has a width "wd2" and is spaced apart from an adjacent portion 172*d* of the ground plane "GP-2" by a distance "d2."

By way of a non-limiting example, the traces "TC-1" and "TC-2," and the ground plane "GP-2" will be used to explain the relationship between a pair of conductive elements, in this case the traces "TC-1" and "TC-2," and their associated ground plane "GP-2." However it is understood that the same general relationship applies to any of the other pairs of conductive elements in the circuits 151, 152, and 153 and their respective ground planes "GP-1," GP-2," and "GP-3."

Figure 4H:
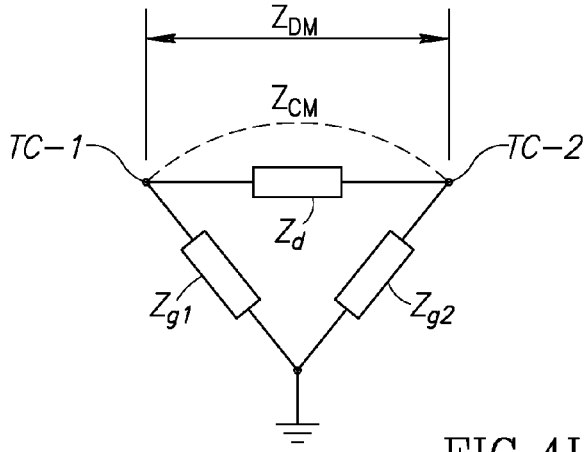
FIG. 4H is a circuit diagram illustrating impedances associated with the pair of traces "TC-1" and "TC-2" illustrated in FIG. 4G.

FIG. 4H is an electrical diagram modeling the impedances associated with the traces "TC-1" and "TC-2." An impedance "$Z_d$" is the impedance between the traces "TC-1" and "TC-2." An impedance "$Z_{g1}$" is the impedance between the trace "TC-1" and ground (also referred to as the impedance to ground). An impedance "$Z_{g2}$" is the impedance between the trace "TC-2" and ground (also referred to as the impedance to ground). As explained above, it may be desirable for impedances "$Z_{g1}$" and "$Z_{g2}$" to be substantially equal to one another.

Figure 6A:
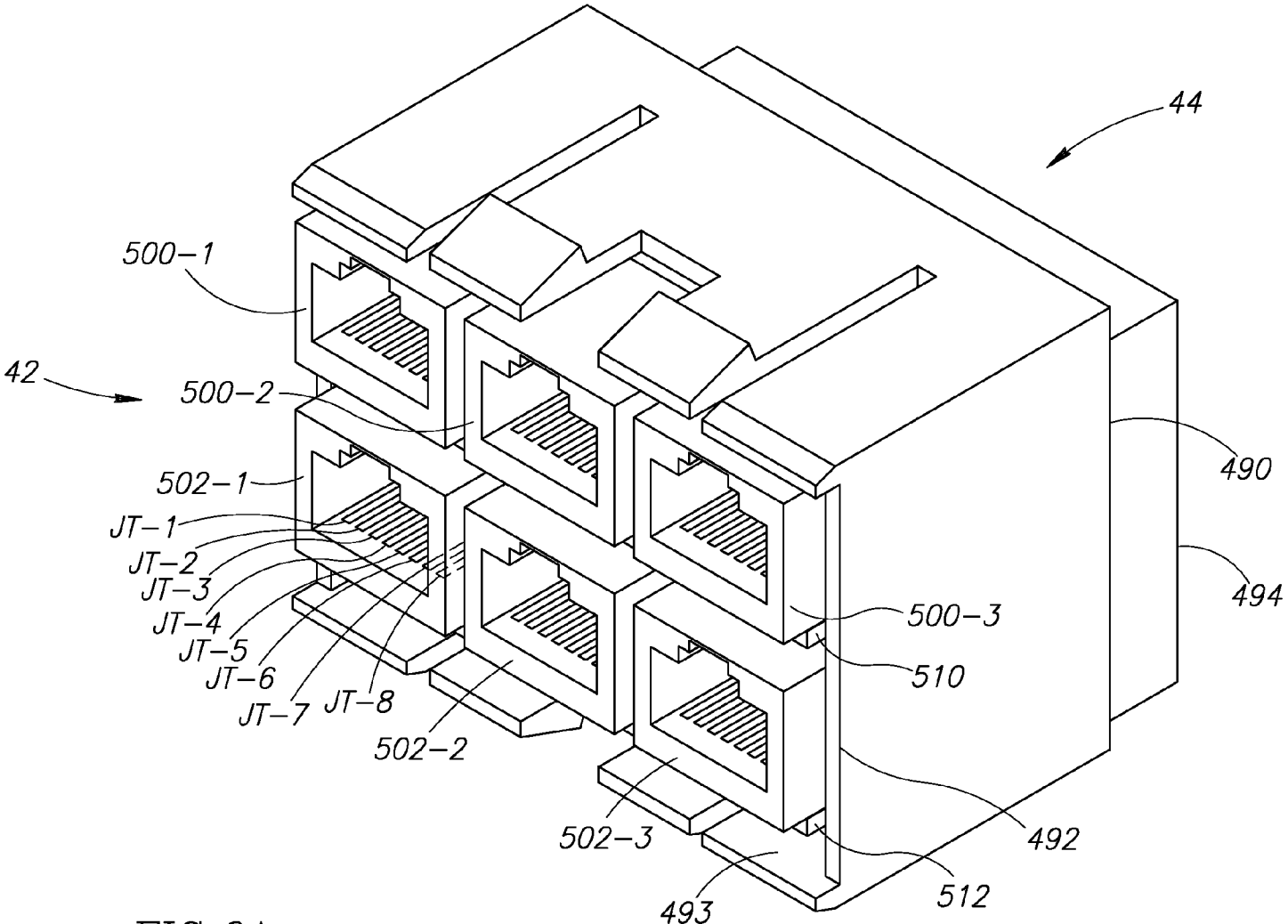
FIG. 6A is an enlarged perspective view of a frontward facing portion of one of the multi-outlet modules of FIG. 1.

Two impedances that are important for properly matching a connector (e.g., the male-type connector 10 and the female-type connector 12, both illustrated in FIG. 1, and outlets 500-1 through 500-3 and outlets 502-1 through 502-3, illustrated in FIG. 6A, and the like) to a system (not shown) within which the connector is to be utilized, are a differential mode impedance "$Z_{DM}$," and a common mode impedance "$Z_{CM}$." For a balanced transmission system, these impedances are a function of the impedances "$Z_d$," "$Z_{g1}$," and "$Z_{g2}$" and can be calculated using the following equations:

$$Z_{DM} = \frac{Z_d(Z_{g1} + Z_{g2})}{(Z_d + Z_{g1} + Z_{g2})}$$

$$Z_{CM} = \frac{Z_{g1} * Z_{g2}}{Z_{g1} + Z_{g2}}$$

In addition, a percentage "$Z_{cmUNBAL}$," which is a measure of the inequality of the two common mode impedances "$Z_{g1}$" and "$Z_{g2}$," can be calculated using the following equation:

$$Z_{cmUNBAL} = \frac{|Z_{g1} - Z_{g2}|}{(Z_{g1} + Z_{g2})/2} * 100$$

Thus, the impedance "$Z_{CM}$" and the percentage "$Z_{cmUNBAL}$" may each be determined as a function of the impedances "$Z_{g1}$" and "$Z_{g2}$." The impedance "$Z_{DM}$" may be determined as a function of impedances "$Z_d$," "$Z_{g1}$," and "$Z_{g2}$." Furthermore, each of these impedances may be considered at either one specific point along the length of the pair of traces "TC-1" and "TC-2," or as an overall average impedance representative of the entire length of the traces.

Once a specific substrate is chosen for the first and second substrate layers 90 and 92, having a specific dielectric constant "e", and thickness "T," and a path thickness "t," and lengths of the traces "TC-1" and "TC-2" are chosen, the overall average value of the impedance "$Z_d$" between the traces "TC-1" and "TC-2," may be determined primarily as a function of the average value of the widths "wd1" and "wd2" and the average value of the distance "d" along the length of the pair of traces. Furthermore, the overall average value of the impedance "$Z_{g1}$" between the trace "TC-1" and ground may be determined primarily as a function of the average value of the width "wd1," and the average value of the distance "d1" along the length trace "TC-1." Likewise, the overall average value of the impedance "$Z_{g2}$" between the trace "TC-2" and ground may be determined primarily as a function of the average value of the width "wd2" of the trace "TC-2" and the average value of the distance "d2" between the trace "TC-2" and the ground plane "GP-2" along the length of trace "TC-2."

While the general relationship between the physical and electrical properties of individual segments of the conductive elements with specific dimensional relationships to other conductive elements, including conventional ground elements, are well understood by those of ordinary skill in the art, in the specific case of the complex circuits presented here, (which include traces having continuously varying physical relationships to other conductive elements, ground planes, and ancillary electrically conductive elements as defined previously herein) an electrical performance analysis of the circuits may be accomplished through a successive process of electro-magnetic field simulation, circuit fabrication, and testing. The electrical performance analyses may be used to determine final values of the various parameters (e.g., the substrate material, the thickness "T," the width "wd1," the width "wd2," the distance "d," the distance "d1," the distance "d2," an average conductive element length, the path thickness "t," and the like) used to construct the conductive elements of the circuits 151, 152, and 153 and the ground planes "GP-1," GP-2," and "GP-3."

Once the overall average values of the impedances "$Z_d$," "$Z_{g1}$," and "$Z_{g2}$" are established, the overall average values for the differential mode impedance "$Z_{DM}$," the common mode impedance "$Z_{CM}$," and the percentage "$Z_{cmUNBAL}$" may be calculated using the equations above. Such parameters may also be empirically determined using appropriate test methods.

It is desirable to design the aforementioned physical and electrical characteristics of the conductive elements, such as the traces "TC-1" and "TC-2," and the substrate 70, such that the overall average values for the differential mode impedance "$Z_{DM}$," and the common mode impedance "$Z_{CM}$" for the conductive elements equal the differential mode impedance and the common mode impedance, respectively, of a system (not shown) in which a connector (e.g., the male-type connector 10, the female-type connector 12, the multi-outlet module 44, all of FIG. 1, and the like) incorporating the substrate 70 is intended to be used.

At the same time, it is also desirable to design the aforementioned physical and electrical characteristic of the conductive elements (e.g., the traces "TC-1" and "TC-2") and the substrate 70, such that the overall average value of the impedance "$Z_{g1}$," and the overall average value of the impedance "$Z_{g2}$" are approximately equal to minimize the percentage "$Z_{cmUNBAL}$."

Values for the conductive element widths "wd1" and "wd2" and the distances "d1" and "d2" may be adjusted at any point along the length of the conductive elements (e.g., the traces "TC-1" and "TC-2") such that the overall average value of the common mode impedance "$Z_{CM}$" of the conductive elements is substantially identical to the common mode impedance of a system (not shown) in which the substrate 70 (e.g., when incorporated into the male-type connector 10, the female-type connector 12, and the like) is intended to be utilized.

At the same time, the effect of each of these values on the overall value of the differential mode impedance "$Z_{DM}$" may be considered. However, for differential mode impedance, the distance "d" also plays a significant role in determining the overall value of the common mode impedance "$Z_{CM}$" of the traces "TC-1" and "TC-2." Therefore, in the case of the differential mode impedance "$Z_{DM}$," the values of the widths "wd1" and "wd2" and the distances "d," "d1," and "d2" may be adjusted at any point along the length of the traces "TC-1" and "TC-2," such that the overall value of the differential mode impedance "$Z_{DM}$" of the pair of traces is substantially equal to the differential mode impedance of a system (not shown) in which the substrate 70 (e.g., when incorporated into the male-type connector 10, the female-type connector 12, and the like) is intended to be utilized.

The values of the widths "wd1" and "wd2" and the distances "d," "d1," and "d2" may be selected such that the overall value of the differential mode impedance "$Z_{DM}$" for the traces "TC-1" and "TC-2," (and optionally one or more other pairs of conductors positioned on the first substrate layer 90) is equal to the system impedance of a system (not shown) for which the substrate 70 (e.g., when incorporated into the male-type connector 10, the female-type connector 12, and the like) is intended to be utilized. At the same time, the effect of each of these values on the overall value of the common mode impedance "$Z_{CM}$" may also be considered. This relationship is understood by those of ordinary skill in the art and will not be described in detail.

The values for the widths "wd1" and "wd2" and the distances "d," "d1," and "d2" may be adjusted at any point along the length of the conductive elements (e.g., the traces "TC-1" and "TC-2") to adjust for anomalies in the differential mode impedance "$Z_{DM}$" elsewhere along the conductive elements or related to other conductive elements associated therewith, such that the average overall value of the differential mode impedance "$Z_{DM}$" for the pair of conductive elements equals the differential mode impedances of a system (not shown) in which the substrate 70 (e.g., when incorporated into the male-type connector 10, the female-type connector 12, and the like) is intended to be utilized.

In addition, the overall value of the common mode impedance unbalance percentage "$Z_{cmUNBAL}$" for the conductive elements (such as the traces "TC-1" and "TC-2") may be adjusted by modifying the average values of the impedance "$Z_{g1}$," which may be accomplished by adjusting the average values of distance "d1" and the width "wd1." Likewise, the average values of the impedance "$Z_{g2}$" may be modified by adjusting the average values of the distance "d2" and the width "wd2."

The values of the distance "d1" and the width "wd1" may be adjusted at any point along the length of one of a pair of conductive elements (such as the trace "TC-1") to adjust for anomalies in the impedance "$Z_{g1}$" elsewhere along the conductive element such that overall average impedance "$Z_{g1}$" remains substantially equal to the overall average impedance "$Z_{g2}$." Likewise, the values for distance "d2" and the width "wd2" may be adjusted at any point along the length of the other of the pair of conductive elements (such as the trace "TC-2") to adjust for anomalies in the impedance "$Z_{g2}$" elsewhere along the conductive element, such that overall impedance "$Z_{g2}$" remains substantially equal to the overall average impedance "$Z_{g1}$."

While the relationship between the physical and electrical properties of individual segments of the conductive elements (such as traces and their associated ground elements), and the relationship between the physical and electrical properties of any of individual ancillary conductive elements associated with the traces to their associated ground elements, can be analyzed using conventional mathematical algorithms, in the case of the complex circuits presented here, (which include a series of interconnected traces and ancillary conductive elements all having continuously varying physical relationships with conductive elements of their associated ground plane), the electrical performance of the circuits is best analyzed through a successive process of electro-magnetic field simulation, circuit fabrication and testing.

In the embodiment illustrated, the ground planes "GP-1" to "GP-3" each include conductive material positioned on the four layers "GPL1" to "GPL4" interconnected by the VIAs "V-GP." Referring to FIG. 4C, the first layer "GPL1" is positioned on the top layer 141. Referring to FIG. 4D, the second layer "GPL2" is positioned on the first inner layer 142. Referring to FIG. 4E, the third layer "GPL3" is positioned on the second inner layer 143. Referring to FIG. 4F, the fourth layer "GPL4" is positioned on the bottom layer 144. For each of the ground planes "GP-1," "GP-2," and "GP-3," the layers "GPL1" to "GPL4" are substantially aligned with one another.

Turning to FIG. 4C, on the top layer 141, the substrate 70 includes seven contacts 161T on the edge card male connector 120 for the circuit 151 and the ground plane "GP-1." On the top layer 141, the first layer "GPL1" of the ground plane "GP-1" is electrically connected to the contacts "CT-Ga," "CT-Gb," and "CT-Gc" of the contacts 161T. Turning to FIG. 4F, on the bottom layer 144, the substrate 70 includes seven contacts 161B for the circuit 151 and the ground plane "GP-1." On the bottom layer 144, the fourth layer "GPL4" of the ground plane "GP-1" is electrically connected to the contacts "CT-Gd," "CT-Ge," and "CT-Gf" of the contacts 161B. The contacts 161T on the top layer 141 are registered with the contacts 161B on the bottom layer 144.

Turning again to FIG. 4C, on the top layer 141, the substrate 70 includes seven contacts 162T on the edge card male connector 120 for the circuit 152 and the ground plane "GP-2." On the top layer 141, the first layer "GPL1" of the ground plane "GP-2" is electrically connected to the contacts "CT-Ga," "CT-Gb," and "CT-Gc" of the contacts 162T. Turning to FIG. 4F, on the bottom layer 144, the substrate 70 includes seven contacts 162B for the circuit 152 and the ground plane "GP-2." On the bottom layer 144, the fourth layer "GPL4" of the ground plane "GP-2" is electrically connected to the contacts "CT-Gd," "CT-Ge," and "CT-Gf" of the contacts 162B. The contacts 162T on the top layer 141 are registered with the contacts 162B on the bottom layer 144.

Turning again to FIG. 4C, on the top layer 141, the substrate 70 includes seven contacts 163T on the edge card male connector 120 for the circuit 153 and the ground plane "GP-3." On the top layer 141, the first layer "GPL1" of the ground plane "GP-3" is electrically connected to the contacts "CT- Ga," "CT-Gb," and "CT-Gc" of the contacts 163T. Turning to FIG. 4F, on the bottom layer 144, the substrate 70 includes seven contacts 163B for the circuit 153 and the ground plane "GP-3." On the bottom layer 144, the fourth layer "GPL4" of the ground plane "GP-3" is electrically connected to the contacts "CT-Gd," "CT-Ge," and "CT-Gf" of the contacts 163B. The contacts 163T on the top layer 141 are registered with the contacts 163B on the bottom layer 144.

Referring to FIGS. 4C, 4D, and 4F, each of the circuits 151, 152, and 153 has a first portion "C-T" positioned on the top layer 141, a second portion "C-M" positioned on the first inner layer 142, and a third portion "C-B" positioned on the bottom layer 144. The first, second, and third portions "C-T," "C-M," and "C-B" illustrated each include one or more conventional circuit traces. While the paths of the traces used to construct the first, second, and third portions "C-T," "C-M," and "C-B" of the circuits 151, 152, and 153 may vary from one another, in each of the circuits 151, 152, and 153, the traces of the first portion "C-T" (on the top layer 141 illustrated in FIG. 4C) connect the wire "W-4" (see FIG. 5) of one of the cables "C1," "C2," and "C3" (see FIG. 2D) to a contact "CT-W4," the wire "W-5" (see FIG. 5) of one of the cables to a contact "CT-W5," the wire "W-1" (see FIG. 5) of one of the cables to a contact "CT-W1," and the wire "W-2" (see FIG. 5) of one of the cables to a contact "CT-W2." Further, in each of the circuits 151, 152, and 153, the traces of the third portion "C-B" (on the bottom layer 144 illustrated in FIG. 4F) connect the wire "W-3" (see FIG. 5) of one of the cables "C1," "C2," and "C3" (see FIG. 2D) to a contact "CT-W3," the wire "W-6" (see FIG. 5) of one of the cables to a contact "CT-W6," the wire "W-7" (see FIG. 5) of one of the cables to a contact "CT-W7," and the wire "W-8" (see FIG. 5) of one of the cables to a contact "CT-W8."

In some embodiments (not shown), the cables "C1," "C2," and "C3" may be secured to either the first side 80 or the second side 82 of the substrate 70. In such embodiments, through-holes (not shown) may be formed in the substrate 70 to provide passageways for the wires "W-4," "W-5," "W-1," and "W-2" from the second side 82 of the substrate 70 to the first side 80 of the substrate, or passageways for the wires "W-7," "W-8," "W-3," and "W-6" from the first side 80 of the substrate 70 to the second side 82 of the substrate, whichever is applicable.

Circuit 151

Turning to the circuit 151 having portions illustrated in each of FIGS. 4C, 4D, and 4F, as mentioned above, the twisted-wire pairs "P1" and "P2" (see FIG. 5) of the cable "C1" (see FIG. 5) are connected to the circuit 151 on the top layer 141 (e.g., using the insulation displacement connectors "IDC-4," "IDC-5," "IDC-1," and "IDC-2" illustrated in FIGS. 4A and 4B) and the twisted-wire pairs "P3" and "P4" (see FIG. 5) of the cable "C1" (see FIG. 5) are connected to the circuit 151 on the bottom layer 144 (e.g., using the insulation displacement connectors "IDC-3," "IDC-6," "IDC-7," and "IDC-8" illustrated in FIGS. 4A and 4B).

The wires "W-4" and "W-5" of the twisted-wire pair "P1" of the cable "C1" are connected to the VIAs "V-4" and "V-5," respectively, of the circuit 151 (e.g., by the insulation displacement connectors "IDC-4" and "IDC-5," respectively). On the top layer 141, the VIA "V-4" is connected to the contact "CT-W4" of the contacts 161T by a trace "TC-4." Thus, the wire "W-4" of the cable "C1" is connected to the contact "CT-W4" of the contacts 161T. On the top layer 141, the VIA "V-5" is connected to the contact "CT-W5" of the contacts 161T by a trace "TC-5." Thus, the wire "W-5" of the cable "C1" is connected to the contact "CT-W5" of the contacts 161T.

The wires "W-1" and "W-2" of the twisted-wire pair "P2" of the cable "C1" are connected to the VIAs "V-1" and "V-2," respectively, of the circuit 151 (e.g., by the insulation displacement connectors "IDC-1" and "IDC-2," respectively). On the top layer 141, the VIA "V-1" is connected to the contact "CT-W1" of the contacts 161T by a trace "TC-1." Thus, the wire "W-1" of the cable "C1" is connected to the contact "CT-W1" of the contacts 161T. On the top layer 141, the VIA "V-2" is connected to the "CT-W2" of the contacts 161T by a trace "TC-2." Thus, the wire "W-2" of the cable "C1" is connected to the contact "CT-W2" of the contacts 161T.

The wires "W-3" and "W-6" of the twisted-wire pair "P3" of the cable "C1" are connected to the VIAs "V-3" and "V-6," respectively, of the circuit 151 (e.g., by the insulation displacement connectors "IDC-3" and "IDC-6," respectively). On the bottom layer 144, the VIA "V-3" is connected to the contact "CT-W3" of the contacts 161B by a trace "TC-3." Thus, the wire "W-3" of the cable "C1" is connected to the contact "CT-W3" of the contacts 161B. On the bottom layer 144, the VIA "V-6" is connected to the contact "CT-W6" of the contacts 161B by a trace "TC-6." Thus, the wire "W-6" of the cable "C1" is connected to the contact "CT-W6" of the contacts 161B.

The wires "W-7" and "W-8" of the twisted-wire pair "P4" of the cable "C1" are connected to the VIAs "V-7" and "V-8," respectively, of the circuit 151 (e.g., by the insulation displacement connectors "IDC-7" and "IDC-8," respectively). On the bottom layer 144, the VIA "V-7" is connected to the contact "CT-W7" of the contacts 161B by a trace "TC-7." Thus, the wire "W-7" of the cable "C1" is connected to the contact "CT-W7" of the contacts 161B. On the bottom layer 144, the VIA "V-8" is connected to the contact "CT-W8" of the contacts 161B by a trace "TC-8." Thus, the wire "W-8" of the cable "C1" is connected to the contact "CT-W8" of the contacts 161B.

On the top layer 141, within the contacts 161T, the contact "CT-Gb" (which is connected to the first layer "GPL1" of the ground plane "GP-1") is positioned between the contacts "CT-W4" and "CT-W5" connected to the twisted-wire pair "P1" and the contacts "CT-W1" and "CT-W2" connected to the twisted-wire pair "P2." This may help improve isolation between the twisted-wire pair "P1" and the twisted-wire pair "P2" of the cable "C1." This arrangement also positions the contacts "CT-W4" and "CT-W5" connected to the twisted-wire pair "P1" between the contacts "CT-Ga" and "CT-Gb" connected to the first layer "GPL1" of the ground plane "GP-1." This arrangement further positions the contacts "CT-W1" and "CT-W2" connected to the twisted-wire pair "P2" between the contacts "CT-Gb" and "CT-Gc" connected to the first layer "GPL1" of the ground plane "GP-1." Further, this arrangement may improve isolation between the circuits 151 and 152 by positioning the contact "CT-Gc" of the contacts 161T (connected to the first layer "GPL1" of the ground plane "GP-1") and the contact "CT-Ga" of the contacts 162T (connected to the first layer "GPL1" of the ground plane "GP-2") between the contacts "CT-W1" and "CT-W2" of the contacts 161T connected to the twisted-wire pair "P2" in the circuit 151 and the contacts "CT-W4" and "CT-W5" of the contacts 162T connected to the twisted-wire pair "P1" in the circuit 152.

Similarly, on the bottom layer 144, within the contacts 161B, the contact "CT-Ge" (which is connected to the fourth layer "GPL4" of the ground plane "GP-1") is positioned between the contacts "CT-W3" and "CT-W6" connected to the twisted-wire pair "P3" and the contacts "CT-W7" and "CT-W8" connected to the twisted-wire pair "P4." This may help improve isolation between the twisted-wire pair "P3" and the twisted-wire pair "P4." This arrangement also positions the contacts "CT-W3" and "CT-W6" connected to the twisted-wire pair "P3" between the contacts "CT-Ge" and "CT-Gf" connected to the fourth layer "GPL4" of the ground plane "GP-1." This arrangement further positions the contacts "CT-W7" and "CT-W8" connected to the twisted-wire pair "P4" between the contacts "CT-Gd" and "CT-Ge" connected to the fourth layer "GPL4" of the ground plane "GP-1." Further, this arrangement may improve isolation between the circuits 151 and 152 by positioning the contact "CT-Gf" of the contacts 161B (connected to the fourth layer "GPL4" of the ground plane "GP-1") and the contact "CT-Gd" of the contacts 162B (connected to the fourth layer "GPL4" of the ground plane "GP-2") between the contacts "CT-W3" and "CT-W6" of the contacts 161B connected to the twisted-wire pair "P3" in the circuit 151 and the contacts "CT-W7" and "CT-W8" of the contacts 162B connected to the twisted-wire pair "P4" in the circuit 152.

To further improve isolation, on the top layer 141, the first layer "GPL1" of the ground plane "GP-1" has portions 171*a* and 171*b* positioned between the traces "TC-4" and "TC-5," connected to the VIAs "V-4" and "V-5," respectively, and the traces "TC-1" and "TC-2," connected to the VIAs "V-1" and "V-2," respectively. Similarly, on the bottom layer 144, the fourth layer "GPL4" of the ground plane "GP-1" has portion 171*c* positioned between the traces "TC-3" and "TC-6," connected to the VIAs "V-3" and "V-6," respectively, and the traces "TC-7" and "TC-8," connected to the VIAs "V-7" and "V-8," respectively.

To improve isolation between the circuit 151 and nearby circuits (e.g., the circuit 152), portions of the first layer "GPL1" of the ground plane "GP-1" substantially surround the first portion "C-T" of the circuit 151, portions of the second layer "GPL2" of the ground plane "GP-1" substantially surround the second portion "C-M" of the circuit 151, and portions of the fourth layer "GPL4" of the ground plane "GP-1" substantially surround the third portion "C-B" of the circuit 151.

Circuit 152

Turning to the circuit 152 having portions illustrated in each of FIGS. 4C, 4D, and 4F, as mentioned above, the twisted-wire pairs "P1" and "P2" (see FIG. 5) of the cable "C2" (see FIG. 2D) are connected to the circuit 152 on the top layer 141 (e.g., using the insulation displacement connectors "IDC-4," "IDC-5," "IDC-1," and "IDC-2" illustrated in FIGS. 4A and 4B) and the twisted-wire pairs "P3" and "P4" (see FIG. 5) of the cable "C2" (see FIG. 2D) are connected to the circuit 152 on the bottom layer 144 (e.g., using the insulation displacement connectors "IDC-3," "IDC-6," "IDC-7," and "IDC-8" illustrated in FIGS. 4A and 4B).

The wires "W-4" and "W-5" of the twisted-wire pair "P1" of the cable "C2" are connected to the VIAs "V-4" and "V-5," respectively, of the circuit 152 (e.g., by the insulation displacement connectors "IDC-4" and "IDC-5," respectively). On the top layer 141, the VIA "V-4" is connected to the contact "CT-W4" of the contacts 162T by a trace "TC-4." Thus, the wire "W-4" of the cable "C2" is connected to the contact "CT-W4" of the contacts 162T. On the top layer 141, the VIA "V-5" is connected to the contact "CT-W5" of the contacts 162T by a trace "TC-5." Thus, the wire "W-5" of the cable "C2" is connected to the contact "CT-W5" of the contacts 162T.

The wires "W-1" and "W-2" of the twisted-wire pair "P2" of the cable "C2" are connected to the VIAs "V-1" and "V-2," respectively, of the circuit 152 (e.g., by the insulation displacement connectors "IDC-1" and "IDC-2," respectively). On the top layer 141, the VIA "V-1" is connected to the contact "CT-W1" of the contacts 162T by a trace "TC-1." Thus, the wire "W-1" of the cable "C2" is connected to the contact "CT-W1" of the contacts 162T. On the top layer 141, the VIA "V-2" is connected to the "CT-W2" of the contacts 162T by a trace "TC-2." Thus, the wire "W-2" of the cable "C2" is connected to the contact "CT-W2" of the contacts 162T.

The wires "W-3" and "W-6" of the twisted-wire pair "P3" of the cable "C2" are connected to the VIAs "V-3" and "V-6," respectively, of the circuit 152 (e.g., by the insulation displacement connectors "IDC-3" and "IDC-6," respectively). On the bottom layer 144, the VIA "V-3" is connected to the contact "CT-W3" of the contacts 162B by a trace "TC-3." Thus, the wire "W-3" of the cable "C2" is connected to the contact "CT-W3" of the contacts 162B. On the bottom layer 144, the VIA "V-6" is connected to the contact "CT-W6" of the contacts 162B by a trace "TC-6." Thus, the wire "W-6" of the cable "C2" is connected to the contact "CT-W6" of the contacts 162B.

The wires "W-7" and "W-8" of the twisted-wire pair "P4" of the cable "C2" are connected to the VIAs "V-7" and "V-8," respectively, of the circuit 152 (e.g., by the insulation displacement connectors "IDC-7" and "IDC-8," respectively). On the bottom layer 144, the VIA "V-7" is connected to the contact "CT-W7" of the contacts 162B by a trace "TC-7." Thus, the wire "W-7" of the cable "C2" is connected to the contact "CT-W7" of the contacts 162B. On the bottom layer 144, the VIA "V-8" is connected to the contact "CT-W8" of the contacts 162B by a trace "TC-8." Thus, the wire "W-8" of the cable "C2" is connected to the contact "CT-W8" of the contacts 162B.

On the top layer 141, within the contacts 162T, the contact "CT-Gb" (which is connected to the first layer "GPL1" of the ground plane "GP-2") is positioned between the contacts "CT-W4" and "CT-W5" connected to the twisted-wire pair "P1" of the cable "C2" and the contacts "CT-W1" and "CT-W2" connected to the twisted-wire pair "P2" of the cable "C2." This arrangement may help improve isolation between the twisted-wire pairs "P1" and "P2" of the cable "C2." This arrangement also positions the contacts "CT-W4" and "CT-W5" connected to the twisted-wire pair "P1" of the cable "C2" between the contacts "CT-Ga" and "CT-Gb" connected to the first layer "GPL1" of the ground plane "GP-2." This arrangement further positions the contacts "CT-W1" and "CT-W2" connected to the twisted-wire pair "P2" of the cable "C2" between the contacts "CT-Gb" and "CT-Gc" connected to the first layer "GPL1" of the ground plane "GP-2." Further, may improve isolation between the circuits 151 and 152 by positioning the contact "CT-Gc" of the contacts 162T (connected to the first layer "GPL1" of the ground plane "GP-2") and the contact "CT-Ga" of the contacts 163T (connected to the first layer "GPL1" of the ground plane "GP-3") between the contacts "CT-W1" and "CT-W2" of the contacts 162T connected to the twisted-wire pair "P2" in the circuit 152 and the contacts "CT-W4" and "CT-W5" of the contacts 163T connected to the twisted-wire pair "P1" in the circuit 153.

Similarly, on the bottom layer 144, within the contacts 162B, the contact "CT-Ge" (which is connected to the fourth layer "GPL4" of the ground plane "GP-2") is positioned between the contacts "CT-W3" and "CT-W6" connected to the twisted-wire pair "P3" of the cable "C2" and the contacts "CT-W7" and "CT-W8" connected to the twisted-wire pair "P4" of the cable "C2." This arrangement may help improve isolation between the twisted-wire pair "P3" and the twisted-wire pair "P4." This arrangement also positions the contacts "CT-W3" and "CT-W6" connected to the twisted-wire pair "P3" of the cable "C2" between the contacts "CT-Ge" and "CT-Gf" connected to the fourth layer "GPL4" of the ground plane "GP-2." This arrangement further positions the contacts "CT-W7" and "CT-W8" connected to the twisted-wire pair "P4" of the cable "C2" between the contacts "CT-Gd" and "CT-Ge" connected to the fourth layer "GPL4" of the ground plane "GP-2." Further, this arrangement positions the contact "CT-Gf" of the contacts 162B (connected to the fourth layer "GPL4" of the ground plane "GP-2") and the contact "CT-Gd" of the contacts 163B (connected to the fourth layer "GPL4" of the ground plane "GP-3") between the contacts "CT-W3" and "CT-W6" of the contacts 162B connected to the twisted-wire pair "P3" of the circuit 152 and the contacts "CT-W7" and "CT-W8" of the contacts 163B connected to the twisted-wire pair "P4" of the circuit 153.

To further improve isolation, on the top layer 141, the first layer "GPL1" of the ground plane "GP-2" has the portion 172*a* positioned between the traces "TC-4" and "TC-5," connected to the VIAs "V-4" and "V-5," respectively, and the traces "TC-1" and "TC-2," connected to the VIAs "V-1" and "V-2," respectively. Similarly, on the bottom layer 144, the fourth layer "GPL4" of the ground plane "GP-2" has portions 172*b* and 172*c* positioned between the traces "TC-3" and "TC-6," connected to the VIAs "V-3" and "V-6," respectively, and the traces "TC-7" and "TC-8," connected to the VIAs "V-7" and "V-8," respectively.

To improve isolation between the circuit 152 and nearby circuits (e.g., the circuits 151 and 153), portions of the first layer "GPL1" of the ground plane "GP-2" substantially surround the first portion "C-T" of the circuit 152, portions of the second layer "GPL2" of the ground plane "GP-2" substantially surround the second portion "C-M" of the circuit 152, and portions of the fourth layer "GPL4" of the ground plane "GP-2" substantially surround the third portion "C-B" of the circuit 152.

Circuit 153

Turning to the circuit 153 having portions illustrated in each of FIGS. 4C, 4D, and 4F, as mentioned above, the twisted-wire pairs "P1" and "P2" (see FIG. 5) of the cable "C3" (see FIG. 2D) are connected to the circuit 153 on the top layer 141 (e.g., using the insulation displacement connectors "IDC-4," "IDC-5," "IDC-1," and "IDC-2" illustrated in FIGS. 4A and 4B) and the twisted-wire pairs "P3" and "P4" (see FIG. 5) of the cable "C2" (see FIG. 2D) are connected to the circuit 153 on the bottom layer 144 (e.g., using the insulation displacement connectors "IDC-3," "IDC-6," "IDC-7," and "IDC-8" illustrated in FIGS. 4A and 4B).

The wires "W-4" and "W-5" of the twisted-wire pair "P1" of the cable "C3" are connected to the VIAs "V-4" and "V-5," respectively, of the circuit 153 (e.g., by the insulation displacement connectors "IDC-4" and "IDC-5," respectively). On the top layer 141, the VIA "V-4" is connected to the contact "CT-W4" of the contacts 163T by a trace "TC-4." Thus, the wire "W-4" of the cable "C3" is connected to the contact "CT-W4" of the contacts 163T. On the top layer 141, the VIA "V-5" is connected to the contact "CT-W5" of the contacts 163T by a trace "TC-5." Thus, the wire "W-5" of the cable "C3" is connected to the contact "CT-W5" of the contacts 163T.

The wires "W-1" and "W-2" of the twisted-wire pair "P2" of the cable "C3" are connected to the VIAs "V-1" and "V-2," respectively, of the circuit 153 (e.g., by the insulation displacement connectors "IDC-1" and "IDC-2," respectively). On the top layer 141, the VIA "V-1" is connected to the contact "CT-W1" of the contacts 163T by a trace "TC-1." Thus, the wire "W-1" of the cable "C3" is connected to the contact "CT-W1" of the contacts 163T. On the top layer 141, the VIA "V-2" is connected to the "CT-W2" of the contacts 163T by a trace "TC-2." Thus, the wire "W-2" of the cable "C3" is connected to the contact "CT-W2" of the contacts 163T.

The wires "W-3" and "W-6" of the twisted-wire pair "P3" of the cable "C3" are connected to the VIAs "V-3" and "V-6," respectively, of the circuit 153 (e.g., by the insulation displacement connectors "IDC-3" and "IDC-6," respectively). On the bottom layer 144, the VIA "V-3" is connected to the contact "CT-W3" of the contacts 163B by a trace "TC-3." Thus, the wire "W-3" of the cable "C3" is connected to the contact "CT-W3" of the contacts 163B. On the bottom layer 144, the VIA "V-6" is connected to the contact "CT-W6" of the contacts 163B by a trace "TC-6." Thus, the wire "W-6" of the cable "C3" is connected to the contact "CT-W6" of the contacts 163B.

The wires "W-7" and "W-8" of the twisted-wire pair "P4" of the cable "C3" are connected to the VIAs "V-7" and "V-8," respectively, of the circuit 153 (e.g., by the insulation displacement connectors "IDC-7" and "IDC-8," respectively). On the bottom layer 144, the VIA "V-7" is connected to the contact "CT-W7" of the contacts 163B by a trace "TC-7." Thus, the wire "W-7" of the cable "C3" is connected to the contact "CT-W7" of the contacts 163B. On the bottom layer 144, the VIA "V-8" is connected to the contact "CT-W8" of the contacts 163B by a trace "TC-8." Thus, the wire "W-8" of the cable "C3" is connected to the contact "CT-W8" of the contacts 163B.

On the top layer 141, within the contacts 163T, the contact "CT-Gb" (which is connected to the first layer "GPL1" of the ground plane "GP-3") is positioned between the contacts "CT-W4" and "CT-W5" connected to the twisted-wire pair "P1" of the cable "C3" and the contacts "CT-W1" and "CT-W2" connected to the twisted-wire pair "P2" of the cable "C3." This arrangement may help improve isolation between the twisted-wire pairs "P1" and "P2" of the cable "C3." This arrangement also positions the contacts "CT-W4" and "CT-W5" connected to the twisted-wire pair "P1" of the cable "C3" between the contacts "CT-Ga" and "CT-Gb" connected to the first layer "GPL1" of the ground plane "GP-3." This arrangement further positions the contacts "CT-W1" and "CT-W2" connected to the twisted-wire pair "P2" of the cable "C3" between the contacts "CT-Gb" and "CT-Gc" connected to the first layer "GPL1" of the ground plane "GP-3."

Similarly, on the bottom layer 144, within the contacts 163B, the contact "CT-Ge" (which is connected to the fourth layer "GPL4" of the ground plane "GP-3") is positioned between the contacts "CT-W3" and "CT-W6" connected to the twisted-wire pair "P3" of the cable "C3" and the contacts "CT-W7" and "CT-W8" connected to the twisted-wire pair "P4" of the cable "C3." This arrangement may help improve isolation between the twisted-wire pair "P3" and the twisted-wire pair "P4" of the cable "C3." This arrangement also positions the contacts "CT-W3" and "CT-W6" connected to the twisted-wire pair "P3" of the cable "C3" between the contacts "CT-Ge" and "CT-Gf" connected to the fourth layer "GPL4" of the ground plane "GP-3." This arrangement further positions the contacts "CT-W7" and "CT-W8" connected to the twisted-wire pair "P4" of the cable "C3" between the contacts "CT-Gd" and "CT-Ge" connected to the fourth layer "GPL4" of the ground plane "GP-3."

To further improve isolation, on the top layer 141, the first layer "GPL1" of the ground plane "GP-3" has portions 173*a* and 173*b* positioned between the traces "TC-4" and "TC-5," connected to the VIAs "V-4" and "V-5," respectively, and the traces "TC-1" and "TC-2," connected to the VIAs "V-1" and "V-2," respectively. Similarly, on the bottom layer 144, the fourth layer "GPL4" of the ground plane "GP-3" has portion 173*c* positioned between the traces "TC-3" and "TC-6," connected to the VIAs "V-3" and "V-6," respectively, and the traces "TC-7" and "TC-8," connected to the VIAs "V-7" and "V-8," respectively.

To improve isolation between the circuit 153 and nearby circuits (e.g., the circuit 152), portions of the first layer "GPL1" of the ground plane "GP-3" substantially surround the first portion "C-T" of the circuit 153, portions of the second layer "GPL2" of the ground plane "GP-3" substantially surround the second portion "C-M" of the circuit 153, and portions of the fourth layer "GPL4" of the ground plane "GP-3" substantially surround the third portion "C-B" of the circuit 153.

Edge Card Female Connector

The male-type connector 10 includes an edge card female connector 180 attached to the edge card male connector 120 of the substrate 70 and an edge card female connector 182 attached to the edge card male connector 120 of the substrate 72. The edge card female connectors 180 and 182 attached to the substrates 70 and 72, respectively, are configured to receive the edge card male connectors 120 of the substrates 74 and 76, respectively, of the female-type connector 12. The edge card female connectors 180 and 182 each include a first plurality of contacts 188T (see FIG. 2D) configured to be connected to the contacts "CT-Ga," "CT-W4," "CT-W5," "CT-Gb," "CT-W1," "CT-W2," and "CT-Gc" of the contacts 161T, 162T, and 163T on the first side 80 of the edge card male connector 120 of the substrates 70 and 72, respectively, to form electrical connections therewith. Further, the edge card female connectors 180 and 182 each include a second plurality of contacts 188B (see FIG. 2D) configured to be connected to the contacts "CT-Gd," "CT-W7," "CT-W8," "CT-Ge," "CT-W6," "CT-W3," and "CT-Gf" of the contacts 161B, 162B, and 163B on the second side 82 of the edge card male connector 120 of the substrates 70 and 72, respectively, to form electrical connections therewith.

In the embodiment illustrated, the second edge portion 124 of the substrate 70 includes a first through-hole 190 and a second through-hole 192 spaced apart therefrom for each of the circuit 151, 152, and 153. Each of the through-holes 190 and 192 is spaced apart from the VIAs "V-1" to "V-8" of the corresponding circuits 151, 152, and 153. Each of the pairs of the first and second through-holes 190 and 192 is configured to permit a conventional cable tie 194 (see FIG. 2D) to pass therethrough.

Referring to FIG. 2D, the substrate 70 may include additional through-holes 196-199 for use with a cable attachment assembly 200 configured to connect the cables "C1," "C2," and "C3" to the substrate 70.

Cable Attachment Assembly

Referring to FIG. 2C, as mentioned above, the male-type connector 10 illustrated includes the substrate 70 and the substrate 72. A cable attachment assembly 202 substantially identical to the attachment assembly 200 may be used to connect the cables "C1," "C2," and "C3" to the substrate 72. Further, referring to FIG. 3C, the female-type connector 12 illustrated includes the substrate 74 and the substrate 76. A cable attachment assembly 204 substantially identical to the cable attachment assembly 200 (see FIG. 2D) may be used to connect the cables "C1," "C2," and "C3" to the substrate 74 and a cable attachment assembly 206 substantially identical to the attachment assembly 200 may be used to connect the cables "C1," "C2," and "C3" to the substrate 76.

Because the cable attachment assemblies 200, 202, 204, and 206 are substantially identical to one another, only the cable attachment assembly 200 will be described in detail. However, those of ordinary skill in the art appreciate that the cable attachment assemblies 202, 204, and 206 each include structures substantially identical to those of the cable attachment assembly 200.

Turning to FIG. 2D, in the embodiment illustrated, the cable attachment assembly 200 includes a first wire securing member 210, a second wire securing member 212, a first cable securing member 214, a second cable securing member 216, and an intermediate member 218. Optionally, the cable attachment assembly 200 may include a first multi-wire holder "H-1" and a second multi-wire holder "H-2" for each of the circuits 151, 152, and 153.

Turning to FIGS. 2F, 4A, and 4B, the first wire securing member 210 includes apertures 220 configured to receive the insulation displacement connectors "IDC-4," "IDC-5," "IDC-1," and "IDC-2" connected to each of the circuits 151, 152, and 153 on the first side 80 of the substrate 70. The first wire securing member 210 includes wire channels "WC-1," "WC-2," and "WC-3" for the cables "C1," "C2," and "C3," respectively, through which the wires "W-4," "W-5," "W-1," and "W-2," of the cables may extend toward the insulation displacement connectors "IDC-4," "IDC-5," "IDC-1," and "IDC-2," respectively, when these insulation displacement connectors are positioned inside the apertures 220.

Turning to FIG. 2D, the first wire securing member 210 includes split fingers 226 and 228 configured to extend through the through-holes 198 and 199, respectively, in the substrate 70. The first wire securing member 210 includes openings 232 and 234 aligned with the through-holes 196 and 197 in the substrate 70 when the split fingers 226 and 228 are extending through the through-holes 198 and 199 in the substrate 70. Returning to FIG. 2E, the wire channels "WC-1," "WC-2," and "WC-3" of the first wire securing member 210 include slots "S-1," "S-2," "S-3," respectively, configured to receive one of the first multi-wire holders "H-1." At the bottom of the slots "S-1," "S-2," "S-3," the wire channels "WC-1," "WC-2," and "WC-3" each include apertures 236 and 237 illustrated in FIG. 2F.

Turning to FIGS. 2H, 4A, and 4B, the second wire securing member 212 includes apertures 240 configured to receive the insulation displacement connectors "IDC-7," "IDC-8," "IDC-6," and "IDC-3" connected to each of the circuits 151, 152, and 153 on the second side 82 of the substrate 70. Turning to FIG. 2I, the second wire securing member 212 includes channels "WC-4," "WC-5," and "WC-6" for the cables "C1," "C2," and "C3," respectively, through which the wires "W-7," "W-8," "W-6," and "W-3," of the cables may extend toward the insulation displacement connectors "IDC-7," "IDC-8," "IDC-6," and "IDC-3," respectively, when these insulation displacement connectors are positioned inside the apertures 240 (see FIG. 2H).

Returning to FIG. 2D, the second wire securing member 212 includes split fingers 246 and 248 configured to extend through the through-holes 196 and 197 in the substrate 70 and into the openings 232 and 234 of the first wire securing member 210. The openings 232 and 234 of the first wire securing member 210 are configured to receive and retain the split fingers 246 and 248 of the second wire securing member 212. The second wire securing member 212 includes openings 252 and 254 aligned with the through-holes 198 and 199 in the substrate 70 when the split fingers 246 and 248 are extending through the through-holes 196 and 197 in the substrate 70. The openings 252 and 254 are configured to receive and retain the split fingers 226 and 228 of the first wire securing member 210. The first and second wire securing members 210 and 212 are held in place at least in part along the first and second sides 80 and 82, respectively, of the substrate 70 by engagement between the split fingers 226 and 228 of the first wire securing member 210 and the openings 252 and 254 of the second wire securing member 212 and engagement between the split fingers 246 and 248 of the second wire securing member 212 and the openings 232 and 234 of the first wire securing member 210.

Turning to FIG. 2I, the wire channels "WC-4," "WC-5," and "WC-6" of the second wire securing member 212 include slots "S-4," "S-5," "S-6," respectively, each configured to receive one of the second multi-wire holders "H-2." At the bottom of the slots "S-4," "S-5," "S-6," the wire channels "WC-4," "WC-5," and "WC-6" each include apertures 256 and 257 (see FIG. 2H).

Turning to FIGS. 2F and 2H, each of the first and second multi-wire holders "H-1" and "H-2" includes open-ended channels 261, 262, 263, and 264 configured to receive four of the wires "W-1" to "W-8" (see FIG. 5) and allow them to pass therethrough. Each of the first and second multi-wire holders "H-1" and "H-2" includes transverse openings 271, 272, 273, and 274 into the channels 261, 262, 263, and 264, respectively. Each of the openings 271, 272, 273, and 274 is configured to receive one of the insulation displacement connectors "IDC-1" to "IDC-8" (see FIGS. 4A and 4B) and allow it to pass therethrough into one of the channels 261, 262, 263, and 264 to form an electrical connection with one of the wires "W-1" to "W-8" positioned therein. Each of the first and second multi-wire holders "H-1" and "H-2" also includes a first projection 276 and a second projection 277. The first and second projections 276 and 277 of the first multi-wire holders "H-1" are receivable inside the apertures 236 and 237, respectively, of the wire channels "WC-1," "WC-2," and "WC-3" of the first wire securing member 210. Turning to FIG. 2H, the first and second projections 276 and 277 of the second multi-wire holders "H-2" are receivable inside the apertures 256 and 257, respectively, of the wire channels "WC-4," "WC-5," and "WC-6" of the second wire securing member 212.

Turning to FIG. 2D, the first cable securing member 214 includes tie supports 281, 282, and 283 each positionable on the first side 80 of the substrate 70 between the first and second through-holes 190 and 192 flanking one of the circuits 151, 152, and 153. Turning to FIG. 2E, the first cable securing member 214 includes dividers "D1," "D2," and "D3" positioned adjacent to the tie supports 281, 282, and 283, respectively, and optionally extending along a portion thereof. The dividers "D1," "D2," and "D3" separate the twisted-wire pair "P1" of the cables "C1," "C2," and "C3," respectively, from the twisted-wire pair "P2" of the cables "C1," "C2," and "C3," respectively. In other words, the twisted-wire pairs "P1" and "P2" of the cables "C1," "C2," and "C3" flank the dividers "D1," "D2," and "D3," respectively, and extend long opposing sides of the tie supports 281, 282, and 283, respectively. One or more of the dividers "D1," "D2," and "D3" may include a stop portion 186.

Turning to FIG. 2F, the first cable securing member 214 includes outwardly opening cable channels 287, 288, and 289 into which the cables "C1," "C2," and "C3," respectively, may extend toward the dividers "D1," "D2," and "D3," respectively. As illustrated in FIG. 2D, an end portion of the cable sheaths 138 (see FIG. 5) of the cables "C1," "C2," and "C3," may be removed to expose the twisted-wire pairs "P1" to "P4." Portion of the cables "C1," "C2," and "C3" positioned within the cable channels 287, 288, and 289 may include their cable sheaths 138.

Referring to FIG. 2G, in the embodiment illustrated, a first transverse sidewall 290 spaced apart from a second transverse sidewall 292 extend transversely across each of the cable channels 287, 288, and 289. A discontinuous transverse channel 293 is defined between the first and second transverse sidewalls 290 and 292.

The first cable securing member 214 includes apertures 296, 297, 298, and 299.

Turning to FIG. 2I, the second cable securing member 216 includes outwardly opening cable channels 301, 302, and 303 into which the cables "C1," "C2," and "C3" (see FIG. 2D), respectively, may extend toward the second wire securing member 212. In the embodiment illustrated in FIG. 2J, a first transverse sidewall 310 spaced apart from a second transverse sidewall 312 extend transversely across each of the cable channels 301, 302, and 303. A discontinuous transverse channel 313 is defined between the first and second transverse sidewalls 310 and 312.

The second cable securing member 216 includes tabs 316, 317, 318, and 319. The apertures 296, 297, 298, and 299 of the first cable securing member 214 are configured to receive the tabs 316, 317, 318, and 319, respectively, and form a snap-fit connection therewith. When connected together, the outwardly opening cable channels 287, 288, and 289 of the first cable securing member 214 are aligned with the outwardly opening cable channels 301, 302, and 303 of the second cable securing member 216 to form cable passageways (not shown) through which the cables "C1," "C2," and "C3," respectively, may pass to enter the cable attachment assembly 200. These cable passageways are terminated by the dividers "D1," "D2," and "D3" of the first cable securing member 214 and the intermediate member 218.

Further, when the first and second cable securing members 214 and 216 are connected together, the first and second transverse sidewalls 290 and 292 of the first cable securing member 214 are aligned with the first and second transverse sidewalls 310 and 312, respectively, of the second cable securing members 216 to align the discontinuous transverse channel 293 with the discontinuous transverse channel 313.

Annular members 321, 322, and 323 (shown in FIG. 2D) may be positioned tightly on the cables "C1," "C2," and "C3," respectively. The annular members 321, 322, and 323 may be positioned inside the aligned transverse channels 293 and 313 to help provide strain relief along the second edge portion 124 of the substrate 70. Before the first and second cable securing members 214 and 216 are connected together, the annular members 321, 322, and 323 may be placed in the discontinuous transverse channel 293 of the first cable securing member 214 or the discontinuous transverse channel 313 of the second cable securing member 216. In this manner, after the first and second cable securing members 214 and 216 are joined together, the annular members 321, 322, and 323 will be trapped within the aligned transverse channels 293 and 313 by the aligned sidewalls 290, 292, 310, and 312.

Turning to FIG. 2I, the second cable securing member 216 includes outwardly extending tabs 330 and 332 that extend toward the cable attachment assembly 202 (see FIG. 2C).

Turning to FIG. 2D, the intermediate member 218 is positioned between the second wire securing member 212 and the second cable securing member 216. The intermediate member 218 includes tie supports 341, 342, and 343 positionable on the second side 82 of the substrate 70 between the first and second through-holes 190 and 192 flanking the circuits 151, 152, and 153, respectively. Turning to FIG. 2I, the intermediate member 218 includes dividers "D4," "D5," and "D6" positioned adjacent to the tie supports 341, 342, and 343, respectively, and optionally extending along a portion thereof. The dividers "D4," "D5," and "D6" separate the twisted-wire pair "P3" of the cables "C1," "C2," and "C3," respectively, from the twisted-wire pair "P4" of the cables "C1," "C2," and "C3," respectively. In other words, the twisted-wire pairs "P3" and "P4" of the cables "C1," "C2," and "C3" flank the dividers "D4," "D5," and "D6," respectively, and extend long opposing sides of the tie supports 341, 342, and 343, respectively. One or more of the dividers "D4," "D5," and "D6" may include a stop portion 346.

Returning to FIG. 2D, the cable attachment assembly 200 may include a plurality of conventional cable ties identified individually by reference numeral 194. One of the cable ties 194 extends around the tie support 281 of the first cable securing member 214 and the twisted-wire pairs "P1" and "P2" of the cable "C1," passes through the through-holes 190 and 192 formed in the substrate 70 flanking the circuit 151 connected to the cable "C1," and extends around the tie support 341 of the intermediate member 218 and the twisted-wire pairs "P3" and "P4" of the cable "C1" to tie all of these components together securely. If the tie support 281 includes the stop portion 186, the cable tie 194 is positioned between the divider "D1" and the stop portion 186. If the tie support 341 includes the stop portion 346, the cable tie 194 is positioned between the divider "D4" and the stop portion 346.

A different one of the cable ties 194 extends around the tie support 282 of the first cable securing member 214 and the twisted-wire pairs "P1" and "P2" of the cable "C2," passes through the through-holes 190 and 192 formed in the substrate 70 flanking the circuit 152 connected to the cable "C2," and extends around the tie support 342 of the intermediate member 218 and the twisted-wire pairs "P3" and "P4" of the cable "C2" to tie all of these components together securely. If the tie support 282 includes the stop portion 186, the cable tie 194 is positioned between the divider "D2" and the stop portion 186. If the tie support 342 includes the stop portion 346, the cable tie 194 is positioned between the divider "D5" and the stop portion 346.

A different one of the cable ties 194 extends around the tie support 283 of the first cable securing member 214 and the twisted-wire pairs "P1" and "P2" of the cable "C3," passes through the through-holes 190 and 192 formed in the substrate 70 flanking the circuit 153 connected to the cable "C3," and extends around the tie support 343 of the intermediate member 218 and the twisted-wire pairs "P3" and "P4" of the cable "C3" to tie all of these components together securely. If the tie support 283 includes the stop portion 186, the cable tie 194 is positioned between the divider "D3" and the stop portion 186. If the tie support 343 includes the stop portion 346, the cable tie 194 is positioned between the divider "D6" and the stop portion 346.

Latch Mechanisms

Turning to FIGS. 2C and 3C, the male and female-type connectors 10 and 12 include releasable latch mechanisms 350 and 360, respectively, configured to removably latch the male and female-type connectors together. The male and female latch mechanisms 350 and 360 are configured to be manually releasable.

Referring to FIG. 2I, as mentioned above, the second cable securing member 216 includes the tabs 330 and 332. Turning to FIG. 2C, the male latch mechanism 350, includes a slidable locking member 352 having a biasing member 354 (e.g., a coil spring). The locking member 352 includes an aperture 355 configured to receive the tab 330 of the second cable securing member 216. In the embodiment illustrated, the biasing member 354 is positioned inside an aperture 356 configured to also receive the tab 332. The biasing member 354 may be attached to an inside wall portion of the aperture 356 opposite the location whereat the aperture 356 receives the tab 332. Thus, the biasing member 354 may be positioned between the tab 332 and an inside portion of the aperture 356. In such embodiments, the biasing member 354 biases the locking member 352 rearwardly toward the cables "C1," "C2," and "C3." The locking member 352 includes a mating portion 358 positioned between the edge card female connectors 180 of the male-type connector 10.

Turning to FIG. 3C, the female latch mechanism 360, includes a slidable locking member 362 having a biasing member 364 (e.g., a coil spring). The locking member 362 includes an aperture 365 configured to receive the tab 330 of the second cable securing member 216. In the embodiment illustrated, the biasing member 364 is positioned inside an aperture 366 configured to also receive the tab 332. The biasing member 364 may be attached to an inside portion of the aperture 366 opposite the location whereat the aperture 366 receives the tab 332. Thus, the biasing member 364 may be positioned between the tab 332 and an inside wall portion of the aperture 366. In such embodiments, the biasing member 364 biases the locking member 362 rearwardly toward the cables "C1," "C2," and "C3." The locking member 362 includes a mating portion 368 positioned between the edge card male connectors 120 of the female-type connector 12.

Turning to FIGS. 2C and 3C, the male and female latch mechanisms 350 and 360 are connected together by engagement between their mating portions 358 and 368, respectively. When the frontward facing portions of the male and female-type connectors 10 and 12 are pressed together, the mating portion 368 of the female latch mechanism 360 catches on the mating portion 358 of the male latch mechanism 350. To release the male and female latch mechanisms 350 and 360, the locking members 352 and 362 may be pressed inwardly to force the mating portions 358 and 368 out of engagement with one another.

Turning to FIGS. 2K and 2L, the housing 60 of the male-type connector 10 includes a frontward facing portion 370 that is insertable into a frontward facing portion (described below) of the female-type connector 12. The frontward facing portion 370 includes a support member 372 positioned between the cable attachment assemblies 200 and 202. The support member 372 is configured to support the mating portion 358 of the locking member 352 of the male latch mechanism 350 and position the mating portion 358 to engage the mating portion 368 of the female latch mechanism 360. The frontward facing portion 370 may include one or more stops 374 configured to limit how far the frontward facing portion 370 may be inserted into the frontward facing portion (described below) of the female-type connector 12.

The housing 60 has a substantially hollow interior 376 defined by at least one outer sidewall 378. Inwardly extending support members 380, 381, 382, and 383 may be positioned on the sidewall 378 to extend into the interior 376. The substrate 70 and/or the cable attachment assembly 200 may be supported by the support members 380 and 381 and the substrate 72 and/or the cable attachment assembly 202 may be supported by the support members 382 and 383.

Figure 3E:
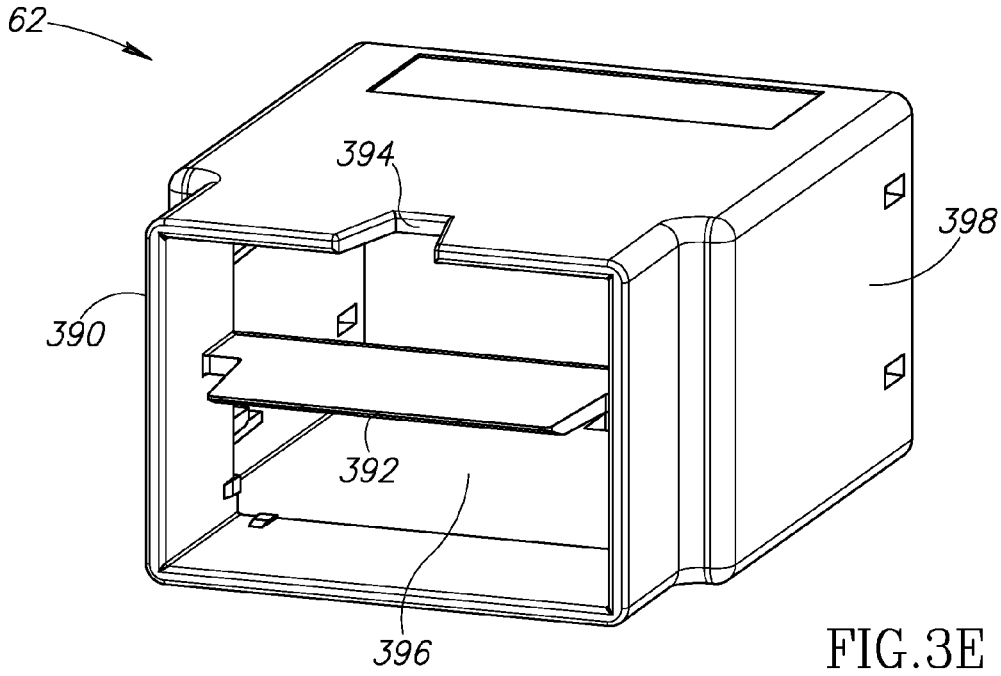
FIG. 3E is a perspective view of a front portion of the housing of the female-type connector of FIG. 3A.
Figure 3F:
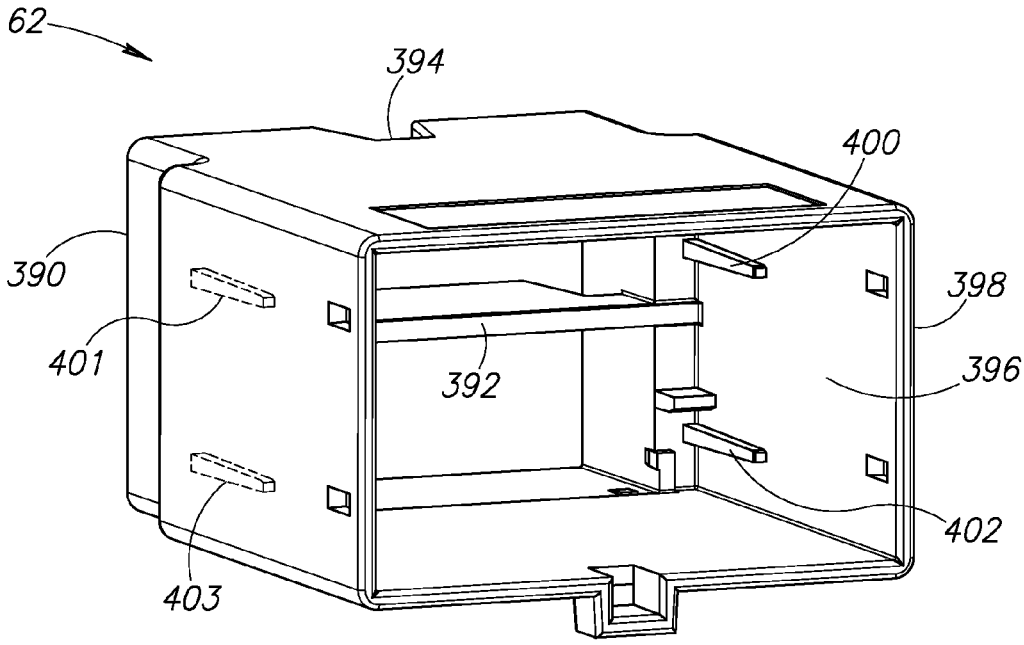
FIG. 3F is a perspective view of a rear portion of the housing of the female-type connector of FIG. 3A.

Turning to FIGS. 3E and 3F, the housing 62 of the female-type connector 12 includes a frontward facing portion 390 configured to receive the frontward facing portion 370 of the male-type connector 10. The frontward facing portion 390 includes a support member 392 positioned between the cable attachment assemblies 204 and 206. The support member 392 is configured to support the mating portion 368 of the locking member 362 of the female latch mechanism 360 and position the mating portion 368 to engage the mating portion 358 of the male latch mechanism 350. The frontward facing portion 390 may include one or more stop receiving portions 394 configured to receive the one or more stops 374 of the housing 60 of the male-type connector 10 to limit how far the frontward facing portion 370 of the male-type connector 10 may be inserted into the frontward facing portion 390 of the female-type connector 12.

The housing 60 has a substantially hollow interior 396 defined by at least one outer sidewall 398. Inwardly extending support members 400, 401, 402, and 403 may be positioned on the sidewall 398 to extend into the interior 396. The substrate 74 and/or the cable attachment assembly 204 may be supported by the support members 400 and 401 and the substrate 76 and/or the cable attachment assembly 206 may be supported by the support members 402 and 403.

The male and female-type connectors 10 and 12 may be configured for use in high-speed data communication applications and structured cabling systems. The male-type connector 10 may be configured as 100 ohm balanced multi-cable termination connectors that provide high levels of isolation between the circuits 151, 152, and 153 of the substrates 70 and 72. Similarly, the female-type connector 12 may be configured as 100 ohm balanced multi-cable termination connectors that provide high levels of isolation between the circuits 151, 152, and 153 of the substrates 74 and 76. The male and/or female-type connectors 10 and 12 may be configured to interconnect several Augmented Category 6A circuits simultaneously. In particular, implementations of the male and/or female-type connectors 10 and 12 provide the high degree of isolation needed for Augmented Category 6 connectivity. Further, the male and female-type connectors 10 and 12 may be sized and shaped for incorporation into an ultra high density patch panel system (e.g., a patch panel having 48 ports in a single rack unit ("RU")).

Six cables 130 may be terminated at the substrates 70 and 72 of the male-type connector 10. The cables 130 may be installed with the substrates 70 and 72 in place. Similarly, six cables 130 may be terminated at the substrates 74 and 76 of the female-type connector 12. The cables 130 may be installed with the substrates 74 and 76 in place.

Isolation between the circuits 151, 152, and 153 on each of the substrates 70, 72, 74, and 76 is accomplished through the strategic positioning of components on the substrate and the positioning of the layers "GPL1" to "GPL4" of the ground planes "GP-1" to "GP-3" on the four layers 141-144, respectively, of the substrates 70, 72, 74, and 76 to improve isolation.

Time and cost savings may be realized by reduced installation time required to connect the male and female-type connectors 10 and 12 to one another.

Multi-Outlet Module for Patch Panel

Turning to FIG. 6A, the multi-outlet module 44 includes the plurality of outlets 42 each configured to receive one of the plugs 52 (see FIG. 1). Each of the outlets 42 includes a plurality of outlet contacts (e.g., outlet contacts "JT-1" to "JT-8"). In each of the outlets 42, the outlet contacts "JT-1" to "JT-8" are electrically connected to conductive pins "P-1" to "P-8" (see FIG. 6D), respectively. The outlets 42 are housed inside a housing 490 having a frontward facing portion 492 opposite a rearward facing portion 494.

In the embodiment illustrated, the plurality of outlets 42 includes an outlet for each of the circuits 151, 152, and 153 (see FIGS. 4A and 4B) of the substrates 70 and 72 of the male-type connector 10. Thus, the plurality of outlets 42 includes an outlet 500-1 for the circuit 151 of the substrate 70, an outlet 500-2 for the circuit 152 of the substrate 70, an outlet 500-3 for the circuit 153 of the substrate 70, an outlet 502-1 for the circuit 151 of the substrate 72, an outlet 502-2 for the circuit 152 of the substrate 72, and an outlet 502-3 for the circuit 153 of the substrate 72. However, through application of ordinary skill in the art to the present teachings, an embodiment of the multi-outlet module 44 may be constructed for use with the female-type connector 12. Therefore, such embodiments are within the scope of the present teachings.

Turning again to FIG. 6D, the outlets 500-1, 500-2, and 500-3 are electrically connected to a first substrate 510, and the outlets 502-1, 502-2, and 502-3 are electrically connected to a second substrate 512. The outlets 500-1, 500-2, and 500-3 may be electrically connected to the first substrate 510 in a conventional manner. For example, the outlets 500-1, 500-2, and 500-3 may be electrically connected to the first substrate 510 by their respective pins "P-1" to "P-8." The outlets 502-1, 502-2, and 502-3 may be electrically connected to a second substrate 512 in a conventional manner. For example, the outlets 502-1, 502-2, and 502-3 may be electrically connected to the first substrate 512 by their respective pins "P-1" to "P-8."

The outlets 500-1, 500-2, and 500-3 and the first substrate 510 form a first electrical subassembly 514 and the outlets 502-1, 502-2, and 502-3 and the second substrate 512 form a second electrical subassembly 516. The first and second electrical subassemblies are substantially identical to one another. Therefore, only the first electrical subassembly 514 will be described in detail. However, those of ordinary skill in the art appreciate that the second electrical subassembly 516 includes substantially identical structures to those described with respect to the first electrical subassembly 514.

Like the substrate 70, the substrate 510 has a first side 580 (see FIG. 6C) opposite a second side 582. The substrate 510 differs from the substrate 70 along a second edge portion 524 whereat the "P-1" to "P-8" of the outlets 500-1, 500-2, and 500-3 are pressed into the substrate 510. At the second edge portion 524, the pins "P-1" to "P-8" of each of the outlets 500-1, 500-2, and 500-3 are pressed into VIAs 601-608, respectively. The VIAs 601-608 may be substantially identical to the VIAs "V-1" to "V-8" formed in the substrate 70. However, the VIAs 601-608 formed in the substrate 510 may arranged in a substantially linear manner along the second edge portion 524 instead of in the offset manner in which the VIAs "V-1" to "V-8" formed in the substrate 70.

The first substrate 510 includes circuits 221, 222, and 223 substantially identical to the circuits 151, 152, and 153 positioned on the substrate 70. However, instead of conducting signals between the cables "C1," "C2," and "C3" and the edge card male connector 120, the circuits 221, 222, and 223 on the first substrate 510 conduct signals between the outlets 500-1, 500-2, and 500-3 and an edge card male connector 520. The edge card male connector 520 is substantially identical to the edge card male connector 120 and is therefore receivable inside the edge card female connector 180 of the male-type connector 10.

The substrate 510 also includes ground planes (not shown) for the circuits 221, 222, and 223 that are substantially similar to the ground planes "GP-1," "GP-2," and "GP-3" of the substrate 70.

As explained above, the edge card male connector 120 of the substrate 70 includes seven contacts 161T, 162T, and 163T on the first side 80 of the substrate for each of the circuits 151, 152, and 153, respectively, and seven contacts 161B, 162B, and 163B on the second side 82 of the substrate for each of the circuits 151, 152, and 153, respectively. For each of the circuits 151, 152, and 153, on the first side 80 of the substrate 70, each of the sets of seven contacts 161T, 162T, and 163T includes three contacts (e.g., the contacts "CT-Ga," "CT-Gb," and "CT-Gc") connected one of the ground planes "GP-1," "GP-2," and "GP-3," and four contacts (i.e., the contacts "CT-W4," "CT-W5," "CT-W1," and "CT-W2") for the wires "W-4," "W-5," "W-1," and "W-2," respectively, of one of the cables "C1," "C2," and "C3." For each of the circuits 151, 152, and 153, on the second side 82 of the substrate 70, each of the sets of seven contacts 161B, 162B, and 163B includes three contacts (e.g., the contacts "CT-Gd," "CT-Ge," and "CT-Gf") connected one of the ground planes "GP-1," "GP-2," and "GP-3," and four contacts (i.e., the contacts "CT-W7," "CT-W8," "CT-W6," and "CT-W3") for the wires "W-7," "W-8," "W-6," and "W-2," respectively, of one of the cables "C1," "C2," and "C3."

Similarly, the edge card male connector 520 includes seven contacts 561T, 562T, and 563T on the first side 580 of the substrate 510 for each of the circuits 221, 222, and 223, and seven contacts 561B, 562B, and 563B on the second side 582 of the substrate 510 for each of the circuits 221, 222, and 223. For each of the circuits 221, 222, and 223, on the first side 580 of the substrate 510, the seven contacts 561T, 562T, and 563T each include three contacts connected one of the ground planes (not shown) substantially similar to the ground planes "GP-1," "GP-2," and "GP-3," and four contacts for the outlet contacts "JT-4," "JT-5," "JT-1," and "JT-2" of one of the outlets 500-1, 500-2, and 500-3. For each of the circuits 221, 222, and 223, on the second side 582 of the substrate 510, the seven contacts 561B, 562B, and 563B each include three contacts connected one of the ground planes (not shown) substantially similar to the ground planes "GP-1," "GP-2," and "GP-3," and four contacts for the outlet contacts "JT-7," "JT-8," "JT-6," and "JT-2" of one of the outlets 500-1, 500-2, and 500-3.

When the male-type connector 10 is connected to the multi-outlet module 44, the edge card female connector 180 connected to the edge card male connector 120 of the substrate 70 electrically connects with the edge card male connector 520 of the multi-outlet module 44. When so connected, the contacts of the edge card male connector 520 and the contacts of the edge card male connector 120 are connected together in accordance with Table A below.

TABLE A

| | | Circuit | | Side | Contact | |
|---|---|---|---|---|---|---|
| Cable | Outlet | male-type connector 10 | multi-outlet module 44 | of edge card male connector 120 | male-type connector 10 | multi-outlet module 44 |
| C1 | 500-1 | 151 | 221 | First | CT-Ga | CT-Ga |
| | | | | First | CT-W4 | CT-JT4 |
| | | | | First | CT-W5 | CT-JT5 |
| | | | | First | CT-Gb | CT-Gb |
| | | | | First | CT-W1 | CT-JT1 |
| | | | | First | CT-W2 | CT-JT2 |
| | | | | First | CT-Gc | CT-Gc |
| | | | | Second | CT-Gd | CT-Gd |
| | | | | Second | CT-W7 | CT-JT7 |
| | | | | Second | CT-W8 | CT-JT8 |
| | | | | Second | CT-Ge | CT-Ge |
| | | | | Second | CT-W6 | CT-JT6 |
| | | | | Second | CT-W3 | CT-JT3 |
| | | | | Second | CT-Gf | CT-Gf |
| C2 | 500-2 | 152 | 222 | First | CT-Ga | CT-Ga |
| | | | | First | CT-W4 | CT-JT4 |
| | | | | First | CT-W5 | CT-JT5 |
| | | | | First | CT-Gb | CT-Gb |
| | | | | First | CT-W1 | CT-JT1 |
| | | | | First | CT-W2 | CT-JT2 |
| | | | | First | CT-Gc | CT-Gc |
| | | | | Second | CT-Gd | CT-Gd |
| | | | | Second | CT-W7 | CT-JT7 |
| | | | | Second | CT-W8 | CT-JT8 |
| | | | | Second | CT-Ge | CT-Ge |
| | | | | Second | CT-W6 | CT-JT6 |
| | | | | Second | CT-W3 | CT-JT3 |
| | | | | Second | CT-Gf | CT-Gf |
| C3 | 500-3 | 153 | 223 | First | CT-Ga | CT-Ga |
| | | | | First | CT-W4 | CT-JT4 |
| | | | | First | CT-W5 | CT-JT5 |
| | | | | First | CT-Gb | CT-Gb |
| | | | | First | CT-W1 | CT-JT1 |
| | | | | First | CT-W2 | CT-JT2 |
| | | | | First | CT-Gc | CT-Gc |
| | | | | Second | CT-Gd | CT-Gd |
| | | | | Second | CT-W7 | CT-JT7 |
| | | | | Second | CT-W8 | CT-JT8 |
| | | | | Second | CT-Ge | CT-Ge |
| | | | | Second | CT-W6 | CT-JT6 |
| | | | | Second | CT-W3 | CT-JT3 |
| | | | | Second | CT-Gf | CT-Gf |

As is apparent from Table A above, the ground planes "GP-1," "GP-2," and "GP-3," of the male-type connector 10 are connected to the ground planes of the multi-outlet module 44 across the connection formed by the male-type connector 10 and the multi-outlet module 44. This is true for the connection between the substrate 70 and the substrate 510 as well as for the connection between the substrate 72 and the substrate 512. Similarly, the ground planes "GP-1," "GP-2," and "GP-3," of the male-type connector 10 are connected to the ground planes "GP-1," "GP-2," and "GP-3," of the female-type connector 12 across the connection formed by the male-type connector 10 and the female-type connector 12. This is true for the connection between the substrate 70 and the substrate 74 as well as for the connection between the substrate 72 and the substrate 76.

Figure 6B:
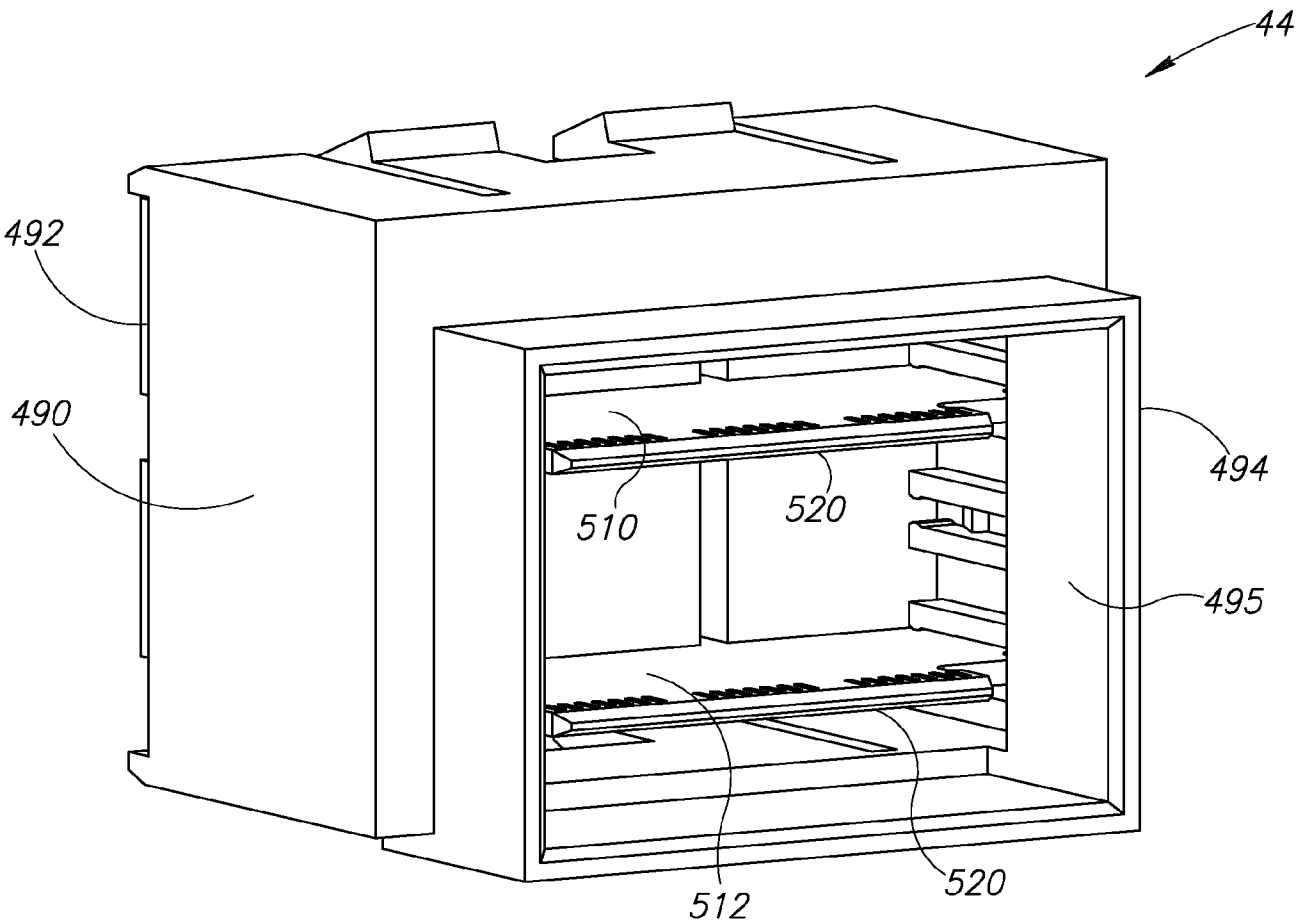
FIG. 6B is a perspective view of a rearward facing portion of the multi-outlet module of FIG. 6A.
Figure 6C:
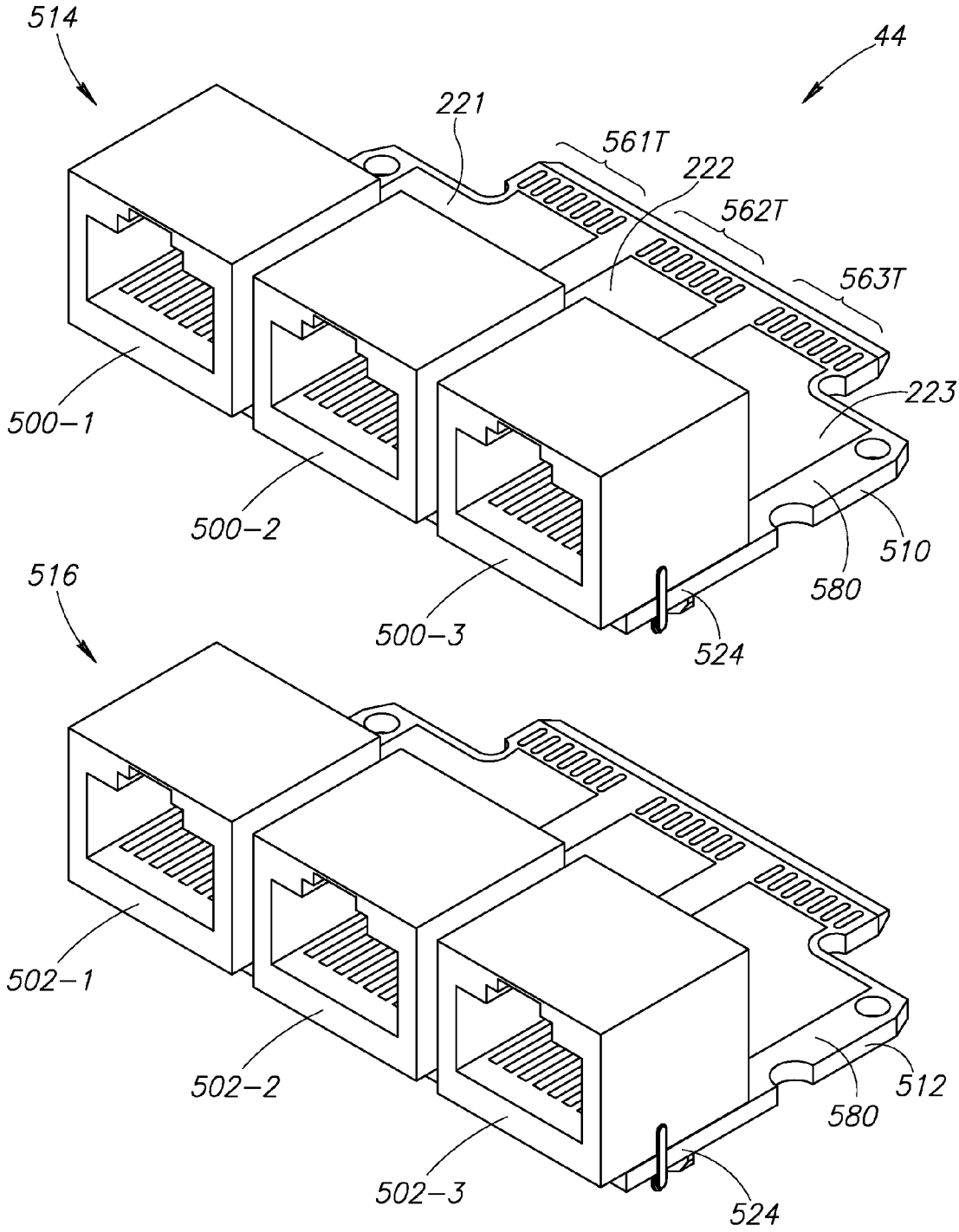
FIG. 6C is a partially exploded perspective view of the multi-outlet module of FIG. 6A illustrating an upper and lower subassembly each including a plurality of outlets connected to a substrate.
Figure 6D:
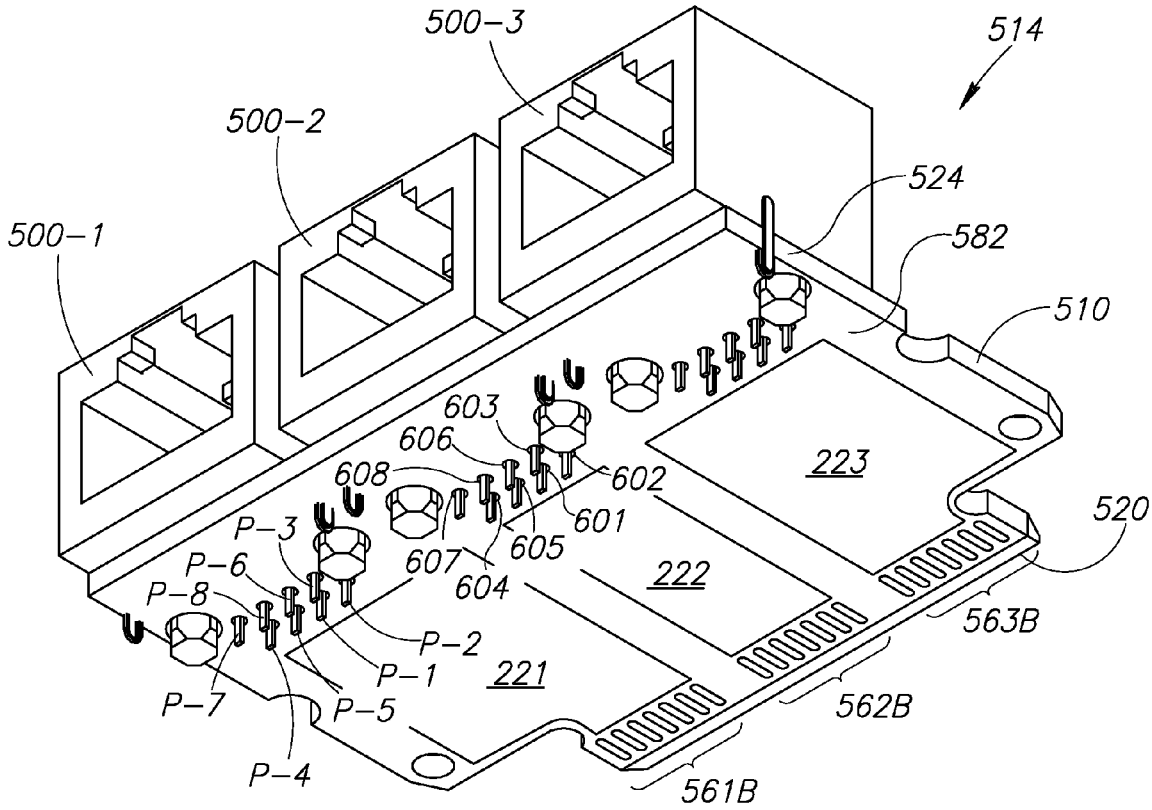
FIG. 6D is a partially exploded perspective view of the upper subassembly of the multi-outlet module of FIG. 6C.

Turning to FIG. 6A, the housing 490 has a forward facing portion 492 has an opening 493 positioned to allow the plugs 52 (see FIG. 1) to be inserted into the outlets 42. Turning to FIG. 6B, the rearward facing portion 494 of the housing 490 has a rearwardly facing opening 495 positioned to allow the edge card female connectors 180 of the male-type connector 10 to be connected to the edge card male connectors 520 of the substrates 510 and 512 of the multi-outlet module 44. Thus, the rearwardly facing opening 495 is sized and shaped to allow the forward facing portion 370 (see FIGS. 2K and 2L) of the housing 60 of the male-type connector 10 to pass therethrough.

Figure 6E:
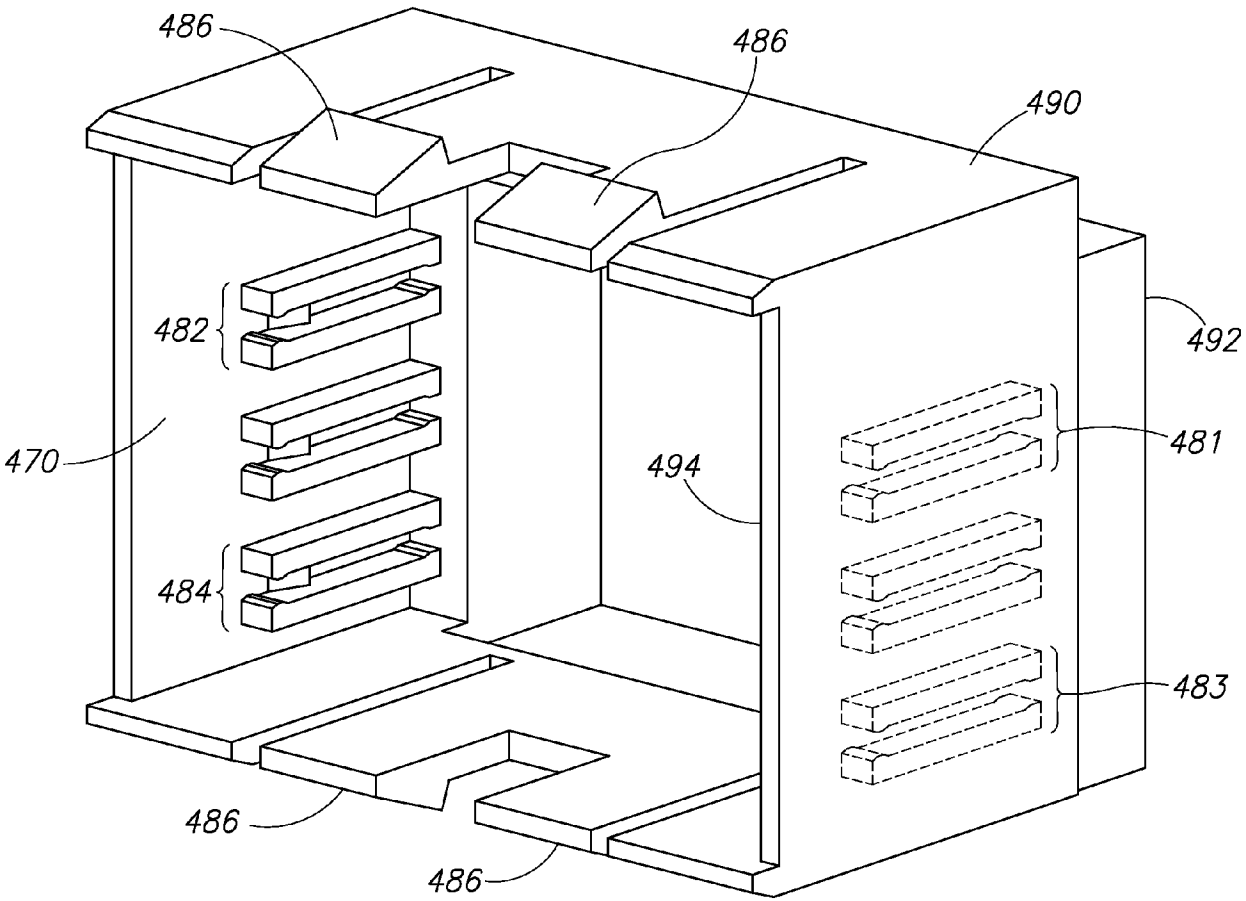
FIG. 6E is a perspective view of a rear portion of the housing of the multi-outlet module of FIG. 6A.

Turning to FIG. 6E, the housing 490 has a substantially hollow interior portion 470 and includes a first pair of spaced apart side rails 481 juxtaposed with a second pair of spaced apart side rails 482 across the hollow interior portion 470 for the substrate 510, and a third pair of spaced apart side rails 483 juxtaposed with a fourth pair of spaced apart side rails 484 across the hollow interior portion 470 for the substrate 512. Opposing side edges of the substrate 510 are receivable inside the first and second pairs of side rails 481 and 482. The first and second pairs of side rails 481 and 482 may be tapered or include gripping projections configured to help maintain the substrate 510 inside the first and second pairs of side rails. Opposing side edges of the substrate 512 are receivable inside the third and fourth pairs of side rails 483 and 484. The third and fourth pairs of side rails 483 and 484 may be tapered or include gripping projections configured to maintain the substrate 510 inside the third and fourth pairs of side rails.

The housing 490 includes one or more tabs 486 configured to removably secure the multi-outlet module 44 to the patch panel 30 (see FIG. 1).

The multi-outlet module 44 may be configured such that when six like modules are used to construct the patch panel 30, the patch panel includes forty-eight outlets (e.g., RJ-45 type outlets) in a single rack unit. Each of the outlets 42 may be configured for use with Augmented Category 6 cabling, and the like.

Once installed in the male-type connector 10, the cables 130 may be easily terminated to the multi-outlet module 44. For example, six cables containing eight contacts each (48 connections in total) can be terminated in one simple motion (i.e., pushing the male-type connector 10 and the multi-outlet module 44 together). Time and cost savings may be realized by reduced installation time required to connect the male-type connector 10 and the multi-outlet module 44 together. Further, the male-type connector 10, the female-type connector 12, and/or the multi-outlet module 44 may be used in ultra high density systems.

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Accordingly, the invention is not limited except as by the appended claims.

The invention claimed is:

1. A substrate comprising:

a plurality of circuits;

a plurality of ground planes comprising a ground plane corresponding to each of the plurality of circuits, each of the plurality of ground planes being spaced apart and disconnected from others of the plurality of ground planes;

an edge card male connector comprising a first and second plurality of contacts;

a first layer comprising a first portion of each of the plurality of circuits, and a first portion of each of the plurality of ground planes, the first plurality of contacts being on the first layer and including contacts corresponding to the first portion of each of the plurality of circuits, for each of the plurality of circuits, the contacts of the first plurality of contacts corresponding to the circuit comprising at least one ground plane contact electrically connected to the first portion of the ground plane corresponding to the circuit and at least one circuit contact electrically connected to the first portion of the circuit;

a second layer comprising a second portion of each of the plurality of circuits, and a second portion of each of the plurality of ground planes, the second plurality of contacts being on the second layer and including contacts corresponding to the second portion of each of the plurality of circuits, for each of the plurality of circuits, the contacts of the second plurality of contacts corresponding to the circuit comprising at least one ground plane contact electrically connected to the second portion of the ground plane corresponding to the circuit and at least one circuit contact electrically connected to the second portion of the circuit;

a first intermediate layer positioned between the first and second layers, the first intermediate layer comprising a third portion of each of the plurality of ground planes; and a second intermediate layer positioned between the first intermediate layer and the second layer, the second intermediate layer comprising a fourth portion of each of the plurality of ground planes, for each of the plurality of ground planes, the first, second, third and fourth portions of the ground plane being electrically interconnected.

2. The substrate of claim 1, wherein each of the plurality of ground planes is a localized, electrically floating, isolated ground plane.

3. The substrate of claim 1, further comprising:

a first substrate layer having a first surface opposite a second surface;

a second substrate layer having a first surface opposite a second surface; and an insulating layer disposed between the first and second substrate layers, the second surface of the first substrate layer being adjacent the insulating layer and the first surface of the second substrate layer being adjacent the insulating layer, the first layer being positioned on the first surface of the first substrate layer, the second layer being positioned on the second surface of the second substrate layer, the first intermediate layer being positioned on the second surface of the first substrate layer, and the second intermediate layer being positioned on the first surface of the second substrate layer.

4. The substrate of claim 3, further comprising:

for each of the plurality of ground planes, a plurality of vertical interconnect accesses ("VIAs") interconnecting the first, second, third and fourth portions of the ground plane.

5. The substrate of claim 1, wherein each of the plurality of circuits comprises conductive elements, and the ground plane corresponding to each of the plurality of circuits is a localized, electrically floating, isolated ground plane located in close proximity to the conductive elements of the circuit so as to provide an electrically conductive structure to which energy can be conveyed from the conductive elements of the circuit to thereby limit an amount of electro-magnetic energy radiated outwardly from the conductive elements to at least one of surrounding circuits and conductors.

6. The substrate of claim 1, wherein at least one of the plurality of circuits comprises a pair of conductive elements arranged relative to the ground plane corresponding to the circuit such that the pair of conductive elements have a selected amount of overall common mode impedance to the ground plane, and the ground plane corresponding to the at least one of the plurality of circuits is a localized, electrically floating, isolated ground plane.

7. The substrate of claim 1, wherein at least one of the plurality of circuits comprises a pair of conductive elements each having a length, the pair of conductive elements being arranged relative to the ground plane corresponding to the circuit and configured such that the pair of conductive elements have a selected amount of common mode impedance to the ground plane at any point along their length, and the ground plane corresponding to the at least one of the plurality of circuits is a localized, electrically floating, isolated ground plane.

8. The substrate of claim 1, wherein at least one of the plurality of circuits comprises a pair of conductive elements arranged relative to the ground plane corresponding to the circuit such that at least one of the pair of conductive elements has a selected amount of overall impedance to the ground plane, and the ground plane corresponding to the at least one of the plurality of circuits is a localized, electrically floating, isolated ground plane.

9. The substrate of claim 1, wherein at least one of the plurality of circuits comprises a pair of conductive elements, a first conductive element of the pair of conductive elements has a length, the first conductive element is arranged continuously along its length relative to the ground plane corresponding to the circuit such that the first conductive element has a selected amount of common mode impedance to the ground plane at any point along its length, and the ground plane corresponding to the at least one of the plurality of circuits is a localized, electrically floating, isolated ground plane.

10. The substrate of claim 1, wherein at least one of the plurality of circuits comprises a pair of conductive elements arranged relative to each other and the ground plane corresponding to the circuit such that the pair of conductive elements have a selected amount of overall differential mode impedance to the ground plane, and the ground plane corresponding to the at least one of the plurality of circuits is a localized, electrically floating, isolated ground plane.

11. The substrate of claim 1, wherein at least one of the plurality of circuits comprises a pair of conductive elements having a length, the conductive elements of the pair are arranged continuously along their length relative to each other and the ground plane corresponding to the circuit such that the pair of conductive elements have a selected amount of differential mode impedance to the ground plane at any point along their length, and the ground plane corresponding to the at least one of the plurality of circuits is a localized, electrically floating, isolated ground plane.

12. The substrate of claim 1 for use with a plurality of insulation displacement connectors, the substrate further comprising:

for each of the plurality of circuits, a plurality of VIAs each configured to receive an insulation displacement connector.

13. The substrate of claim 1 for use with a plurality of insulation displacement connectors, the substrate further comprising:

for each of the plurality of circuits, a first plurality of VIAs configured to receive a portion of the plurality of insulation displacement connectors positioned to extend outwardly away from the first layer, the first plurality of VIAs of adjacent ones of the plurality of circuits being offset from one another relative to the edge card male connector; and for each of the plurality of circuits, a second plurality of VIAs configured to receive a portion of the plurality of insulation displacement connectors positioned to extend outwardly away from the second layer, the second plurality of VIAs of adjacent ones of the plurality of circuits being offset from one another relative to the edge card male connector.

14. The substrate of claim 1, for use with a plurality of cables, one of the plurality of cables corresponding to each of the plurality of circuits, each cable comprising a plurality of wires, wherein the first portion of each of the plurality of circuits comprises an electrical connection between one of the plurality of wires of the cable corresponding to the circuit and one of the contacts of the first plurality of contacts corresponding to the circuit, and the second portion of each of the plurality of circuits comprises an electrical connection between one of the plurality of wires of the cable corresponding to the circuit and one of the contacts of the second plurality of contacts corresponding to the circuit.

15. The substrate of claim 1, for use with a plurality of cables, one of the plurality of cables corresponding to each of the plurality of circuits, each cable comprising a plurality of wires arranged in twisted pairs, wherein the first portion of each of the plurality of circuits comprises first electrical connections between a first twisted pair of the plurality of wires of the cable corresponding to the circuit and a first pair of the contacts of the first plurality of contacts corresponding to the circuit, and second electrical connections between a second twisted pair of the plurality of wires of the cable corresponding to the circuit and a second pair of the contacts of the first plurality of contacts corresponding to the circuit, a portion of the first portion of the ground plane corresponding to the circuit being positioned between the first and second electrical connections, and the second portion of each of the plurality of circuits comprises third electrical connections between a third twisted pair of the plurality of wires of the cable corresponding to the circuit and a first pair of the contacts of the second plurality of contacts corresponding to the circuit, and fourth electrical connections between a fourth twisted pair of the plurality of wires of the cable corresponding to the circuit and a second pair of the contacts of the second plurality of contacts corresponding to the circuit, a portion of the second portion of the ground plane corresponding to the circuit being positioned between the third and fourth electrical connections.

16. The substrate of claim 1, for use with a plurality of cables, one of the plurality of cables corresponding to each of the plurality of circuits, each cable comprising a plurality of wires arranged in twisted pairs, wherein the first portion of each of the plurality of circuits comprises first electrical connections between a first twisted pair of the plurality of wires of the cable corresponding to the circuit and a first pair of the contacts of the first plurality of contacts corresponding to the circuit, and second electrical connections between a second twisted pair of the plurality of wires of the cable corresponding to the circuit and a second pair of the contacts of the first plurality of contacts corresponding to the circuit, the at least one ground plane contact connected to the first portion of the ground plane being positioned between the first pair of the first plurality of contacts corresponding to the circuit and the second pair of the first plurality of contacts corresponding to the circuit, the second portion of each of the plurality of circuits comprises third electrical connections between a third twisted pair of the plurality of wires of the cable corresponding to the circuit and a first pair of the contacts of the second plurality of contacts corresponding to the circuit, and fourth electrical connections between a fourth twisted pair of the plurality of wires of the cable corresponding to the circuit and a second pair of the contacts of the second plurality of contacts corresponding to the circuit, the at least one ground plane contact connected to the second portion of the ground plane being positioned between the first pair of the second plurality of contacts corresponding to the circuit and the second pair of the second plurality of contacts corresponding to the circuit.

17. The substrate of claim 16, wherein the first pair of the first plurality of contacts of each of the plurality of circuits is positioned between ones of the first plurality of contacts corresponding to the circuit connected to the first portion of the ground plane corresponding to the circuit, the second pair of the first plurality of contacts of each of the plurality of circuits is positioned between ones of the first plurality of contacts corresponding to the circuit connected to the first portion of the ground plane corresponding to the circuit, the first pair of the second plurality of contacts of each of the plurality of circuits is positioned between ones of the second plurality of contacts corresponding to the circuit connected to the second portion of the ground plane corresponding to the circuit, and the second pair of the second plurality of contacts of each of the plurality of circuits is positioned between ones of the second plurality of contacts corresponding to the circuit connected to the second portion of the ground plane corresponding to the circuit.

18. The substrate of claim 1, wherein the first portion of each of the plurality of circuits is at least partially surrounded by a portion of the first portion of the ground plane corresponding to the circuit and the second portion of each of the plurality of circuits is at least partially surrounded by a portion of the second portion of the ground plane corresponding to the circuit.

19. A connector for terminating a first plurality of cables, each cable comprising a plurality of wires, the connector comprising a substrate having:

a first surface opposite a second surface;

a circuit corresponding to each of the first plurality of cables, each circuit comprising a first portion disposed on the first surface of the substrate, and a second portion disposed on the second surface of the substrate, a first portion of the plurality of wires of the cable being connected to the first portion of the circuit on the first surface of the substrate, and a second portion of the plurality of wires of the cable being connected to the second portion of the circuit on the second surface of the substrate;

an edge card male connector comprising for each of the first plurality of cables, a first plurality of contacts on the first surface of the substrate and a second plurality of contacts on the second surface of the substrate, ones of the first plurality of contacts being electrically connected to the first portion of the plurality of wires of the cable by the first portion of the circuit corresponding to the cable, and ones of the second plurality of contacts being electrically connected to the second portion of the plurality of wires of the cable by the second portion of the circuit corresponding to the cable; and a ground plane corresponding to each of the first plurality of cables, the ground plane being electrically connected to ones of the first plurality of contacts corresponding to the cable and ones of the second plurality of contacts corresponding to the cable.

20. The connector of claim 19, wherein for each of the first plurality of cables, the ones of the first plurality of contacts connected to the ground plane corresponding to the cable are interposed between selected adjacent ones of the first plurality of contacts connected to the first portion of the plurality of wires of the cable, and the ones of the second plurality of contacts connected to the ground plane corresponding to the cable are interposed between selected adjacent ones of the second plurality of contacts connected to the second portion of the plurality of wires of the cable.

21. The connector of claim 19 for use with a second plurality of cables, wherein the substrate is a first substrate, and the connector further comprises:

a second substrate like the first substrate for use with the second plurality of cables, the first substrate being substantially parallel and aligned with the second substrate.

22. The connector of claim 19, further comprising:

an edge card female connector having (a) an edge card male connector receiving portion and (b) an edge card male connector attachment portion opposite the edge card male connector receiving portion, the edge card male connector receiving portion being operable to removably receive an edge card male connector other than the edge card male connector of the substrate and form a plurality of electrical connections therewith, the edge card male connector attachment portion comprising a first plurality of contacts and a second plurality of contacts, the edge card female connector being connectable to the edge card male connector of the substrate to form a first plurality of electrical connections between the first plurality of contacts of the edge card male connector attachment portion of the edge card female connector and the first plurality of contacts of the edge card male connector, and a second plurality of electrical connections between the second plurality of contacts of the edge card male connector attachment portion of the edge card female connector and the second plurality of contacts of the edge card male connector.

23. The connector of claim 19, further comprising:

a cable attachment assembly configured to connect the plurality of cables to the substrate.

24. The connector of claim 23, wherein the cable attachment assembly comprises an annular member positioned circumferentially on each of the first plurality of cables and a transverse channel in which each of the annular members is positioned.

25. The connector of claim 23, wherein the substrate comprises a first through-hole spaced apart from a second through-hole for each of the cables, the cable attachment assembly comprises a cable tie corresponding to each of the cables, and for each of the cables, the corresponding cable tie passes through each of the first and second through-holes corresponding to the cable and around a portion of the corresponding cable to secure the cable to the substrate.

26. The connector of claim 25, wherein the cable attachment assembly comprises for each of the cables:

a first cable tie support positioned between the first and second through-holes corresponding to the cable on the first surface of the substrate;

a second cable tie support positioned between the first and second through-holes corresponding to the cable on the second surface of the substrate;

the cable tie corresponding to the cable passing through each of the first and second through-holes corresponding to the cable, and around a portion of the corresponding cable and portions of each of the first and second cable tie supports to secure the cable to the substrate.

27. The connector of claim 26, wherein for each of the cables:

the first portion of the plurality of wires of the cable connected to the first portion of the circuit on the first surface of the substrate extend along the first cable tie support corresponding to the cable; and the second portion of the plurality of wires of the cable connected to the second portion of the circuit on the second surface of the substrate extend along the second cable tie support corresponding to the cable.

28. The connector of claim 27, wherein for each of the cables:

the cable attachment assembly includes a first divider adjacent the first cable tie support, the first portion of the plurality of wires being separated into two pairs of wires by the first divider; and the cable attachment assembly includes a second divider adjacent the second cable tie support, the second portion of the plurality of wires being separated into two pairs of wires by the second divider.

29. The connector of claim 19, further comprising:

a frontward facing portion, the edge card male connector being positioned adjacent the frontward facing portion; and a latch mechanism having a mating portion adjacent the frontward facing portion, the mating portion being configured to engage a mating portion of a different connector.

30. The connector of claim 19, wherein for each circuit:

the first portion of the plurality of wires of the cable corresponding to the circuit are connected to the first portion of the circuit on the first surface of the substrate by insulation displacement connectors, and the second portion of the plurality of wires of the cable corresponding to the circuit are connected to the second portion of the circuit on the second surface of the substrate by insulation displacement connectors.

31. A multi-outlet module for terminating a first plurality of cables, each cable comprising a plurality of wires, the module comprising:

a housing having a frontward facing opening opposite a rearward facing opening;

a substrate positioned inside the housing; and an outlet corresponding to each of the first plurality of cables, the outlets being mounted on the substrate and accessible through the frontward facing opening of the housing, the substrate comprising:

a first surface opposite a second surface;

a circuit corresponding to each of the first plurality of cables, each circuit comprising a first portion disposed on the first surface of the substrate, and a second portion disposed on the second surface of the substrate, a first portion of the plurality of wires of the cable being connected to the first portion of the circuit on the first surface of the substrate, and a second portion of the plurality of wires of the cable being connected to the second portion of the circuit on the second surface of the substrate;

an edge card male connector accessible through the rearward facing opening of the housing, the edge card male connector comprising for each of the first plurality of cables, a first plurality of contacts on the first surface of the substrate and a second plurality of contacts on the second surface of the substrate, ones of the first plurality of contacts being electrically connected to the first portion of the plurality of wires of the cable by the first portion of the circuit corresponding to the cable, and ones of the second plurality of contacts being electrically connected to the second portion of the plurality of wires of the cable by the second portion of the circuit corresponding to the cable; and a ground plane corresponding to each of the first plurality of cables, the ground plane being electrically connected to ones of the first plurality of contacts corresponding to the cable and ones of the second plurality of contacts corresponding to the cable.

32. The module of claim 31, wherein the housing is configured to be mounted within a single rack unit sized patch panel.

33. The module of claim 31, wherein for each of the first plurality of cables, the ones of the first plurality of contacts connected to the ground plane corresponding to the cable are interposed between selected adjacent ones of the first plurality of contacts connected to the first portion of the plurality of wires of the cable, and the ones of the second plurality of contacts connected to the ground plane corresponding to the cable are interposed between selected adjacent ones of the second plurality of contacts connected to the second portion of the plurality of wires of the cable.

34. The module of claim 31 for use with a second plurality of cables, wherein the substrate is a first substrate, and the module further comprises:

a second substrate like the first substrate for use with the second plurality of cables, the first substrate being substantially parallel and aligned with the second substrate.

35. A method of reducing crosstalk in a communications connector, the method comprising:

positioning a ground plane on a substrate;

positioning a first conductive element on the substrate, the first conductive element being positioned on the substrate in close proximity to the ground plane, the first conductive element having a first impedance to the ground plane; and positioning a second conductive element on the substrate, the second conductive element being positioned on the substrate in close proximity to the ground plane, such that a second impedance of the second conductive element to the ground plane is substantially equal to the first impedance, the first and second conductive elements being configured to conduct a differential signal across at least a portion of the substrate.

36. The method of claim 35, wherein the first and second conductive elements are positioned relative to the ground plane such that the first and second conductive elements have a selected amount of overall average common mode impedance to the ground plane.

37. The method of claim 35 for use with a system having a common mode impedance, the communications connector being connectable to the system, wherein the selected amount of overall average common mode impedance to the ground plane is substantially equal to the common mode impedance of the system.

38. The method of claim 35, wherein the first and second conductive elements each have a length, the first and second conductive elements are arranged relative to the ground plane such that the first and second conductive elements have a selected amount of common mode impedance to the ground plane at any point along their lengths.

39. The method of claim 35, wherein the first conductive element has a length, the first conductive element is arranged continuously along its length relative to the ground plane such that the first conductive element has a selected amount of common mode impedance to the ground plane at any point along its length.

40. The method of claim 39, wherein the second conductive element has a length, the second conductive element is arranged continuously along its length relative to the ground plane such that the second conductive element has a selected amount of common mode impedance to the ground plane at any point along its length.

41. The method of claim 35, wherein the first and second conductive elements are arranged relative to each other and the ground plane such that the first and second conductive elements have a selected amount of overall average differential mode impedance to the ground plane.

42. The method of claim 41 for use with a system having a differential mode impedance, the communications connector being connectable to the system, wherein the selected amount of overall average differential mode impedance to the ground plane is substantially equal to the differential mode impedance of the system.

43. The method of claim 35, wherein the first and second conductive elements have a length, and the first and second conductive elements are arranged continuously along their length relative to each other and the ground plane such that the first and second conductive elements have a selected amount of differential mode impedance to the ground plane at any point along their length.

44. The method of claim 35, wherein the ground plane is a localized, electrically floating, isolated ground plane.

45. A connector for terminating a plurality of cables, the connector comprising a substrate having:

a different circuit corresponding to each of the plurality of cables, each circuit comprising conductive elements having an input portion connected to the cable corresponding to the circuit, and an output portion connectable to an external electrical component; and a different electrically floating ground plane corresponding to each of the circuits, the ground planes being spaced apart and disconnected from their respective circuits, the ground planes being positioned relative to the conductive elements of their respective circuits to receive electro-magnetic energy radiated outwardly from the conductive elements of their respective circuits and provide a localized common ground for the conductive elements of their respective circuits.

* * * * *